US006270408B1

(12) United States Patent
Sakamoto et al.

(10) Patent No.: US 6,270,408 B1
(45) **Date of Patent: *Aug. 7, 2001**

(54) GAME MACHINE INFORMING PRIZE MODE INFORMATION BASED ON VARIABLE DISPLAY STOP REQUEST

(75) Inventors: Yoshikazu Sakamoto; Hiroshi Yoshida, both of Tokyo (JP)

(73) Assignee: Aruze Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/195,552

(22) Filed: Nov. 19, 1998

(30) Foreign Application Priority Data

Nov. 19, 1997 (JP) ..... 9-334984
Sep. 4, 1998 (JP) ..... 10-251528

(51) Int. Cl.[7] ..... A63F 9/24
(52) U.S. Cl. ..... 463/20; 273/143 R
(58) Field of Search ..... 463/20, 16, 21; 273/143 R, 138.1, 138.2

(56) References Cited

U.S. PATENT DOCUMENTS 4,993,713 * 2/1991 Harada ..... 273/138 A
5,024,439 * 6/1991 Okada ..... 273/143 R
5,400,301 * 3/1995 Rackley ..... 368/72
5,603,659 * 2/1997 Okada ..... 463/25
5,667,219 * 9/1997 Ishibashi ..... 273/143 R
5,695,188 * 12/1997 Ishibashi ..... 273/143 R
5,722,891 * 3/1998 Inoue ..... 463/20
5,954,422 * 9/1999 Marchini et al. ..... 362/227
6,077,163 * 6/2000 Walker et al. ..... 463/26

OTHER PUBLICATIONS

U.S. Ser. No. 09/206,382 by Sakamoto et al..
U.S. Ser. No. 09/206,148 by Sakamoto.
U.S. Ser. No. 09/188,689 by Sakamoto.

* cited by examiner

*Primary Examiner*—Valencia Martin-Wallace
*Assistant Examiner*—Julie Kasick
(74) *Attorney, Agent, or Firm*—Pillsbury Winthrop LLP

(57) ABSTRACT

A game machine is disclosed in which interest in the game is created by the operation of stop buttons 16 through 18, and back lamps 57*a*, 57*b* and 57*c* for illuminating rotating reels 3 through 5. Patterns which differ in accordance with the kind of prize modes are announced to the player, for example, by simultaneously extinguishing the respective back lamps 57*a*, 57*b* and 57*c* of the rotating reels 3 through 5 when the stop buttons 16 through 18 are actuated, and the possibility of erecting a "BB" hit flag, signifying a big hit prize, is announced to the player.

21 Claims, 57 Drawing Sheets

— Prior Art —

Fig. 7

| Hit / No. of coins | Large | Medium | Small | | | | |
|---|---|---|---|---|---|---|---|
| | BB | RB | Water melon | Bell | 4 Cherry | 2 Cherry | Replay |
| 1 | a 1 | b 1 | c 1 | d 1 | e 1 | f 1 | g 1 |
| 2 | a 2 | b 2 | c 2 | d 2 | e 2 | f 2 | g 2 |
| 3 | a 3 | b 3 | c 3 | d 3 | e 3 | f 3 | g 3 |

Fig. 8

| Code No. | #1 reel | #2 reel | #3 reel |
|---|---|---|---|
| 0 | A | E | B |
| 1 | G | C | H |
| 2 | F | D | F |
| 3 | C | G | E |
| 4 | F | D | F |
| 5 | A | A | A |
| 6 | D | E | E |
| 7 | C | G | F |
| 8 | G | D | D |
| 9 | F | E | F |
| 10 | C | B | H |
| 11 | F | D | B |
| 12 | A | E | F |
| 13 | E | D | E |
| 14 | C | A | F |
| 15 | F | E | H |
| 16 | B | G | C |
| 17 | F | D | F |
| 18 | C | B | D |
| 19 | E | F | E |
| 20 | F | D | F |

| Hit flag | BB | RB | Water melon | Bell | 4 Cherry | 2 Cherry | Replay | Blank |
|---|---|---|---|---|---|---|---|---|
| Hit section Data | 0~200 (a3=201) | 201~380 (b3=381) | 381~800 (c3=801) | 801~1900 (d3=1901) | 1901~4000 (e3=4001) | 4001~10000 (f3=10001) | 10001~18000 (g3=18001) | 18001~65535 |
| Inform section Data | 0~150 20000~20200 | 201~340 20201~20380 | 381~770 20381~20800 | 801~1800 20801~21900 | 1901~3500 21901~24000 | 4001~9000 24001~30000 | 10001~17500 30001~38000 | 38001~65535 |

Fig. 9

Fig. 10

| Hit flag | Blank | JAC hit | | | | | | |
|---|---|---|---|---|---|---|---|---|
| in RB operation | P11 | 0 | | | | | | |
| Hit flag | Blank | 2 Cherry | 4 Cherry | Bell | Water melon | RB hit | | |
| General game in BB operation | P12 | P21 | P31 | P41 | P51 | P61 | | |
| Hit flag | Blank | 2 Cherry | 4 Cherry | Bell | Water melon | Replay | RB | BB |
| General game | P13 | P22 | P32 | P42 | P52 | P62 | P71 | P81 |
| Hit flag | Blank | 2 Cherry | 4 Cherry | Bell | Water melon | Replay | | |
| General game in inner hit of RB | P14 | P23 | P33 | P43 | P53 | P63 | | |
| Hit flag | Blank | 2 Cherry | 4 Cherry | Bell | Water melon | Replay | | |
| General game in inner hit of BB | P15 | P24 | P34 | P44 | P54 | P64 | | |

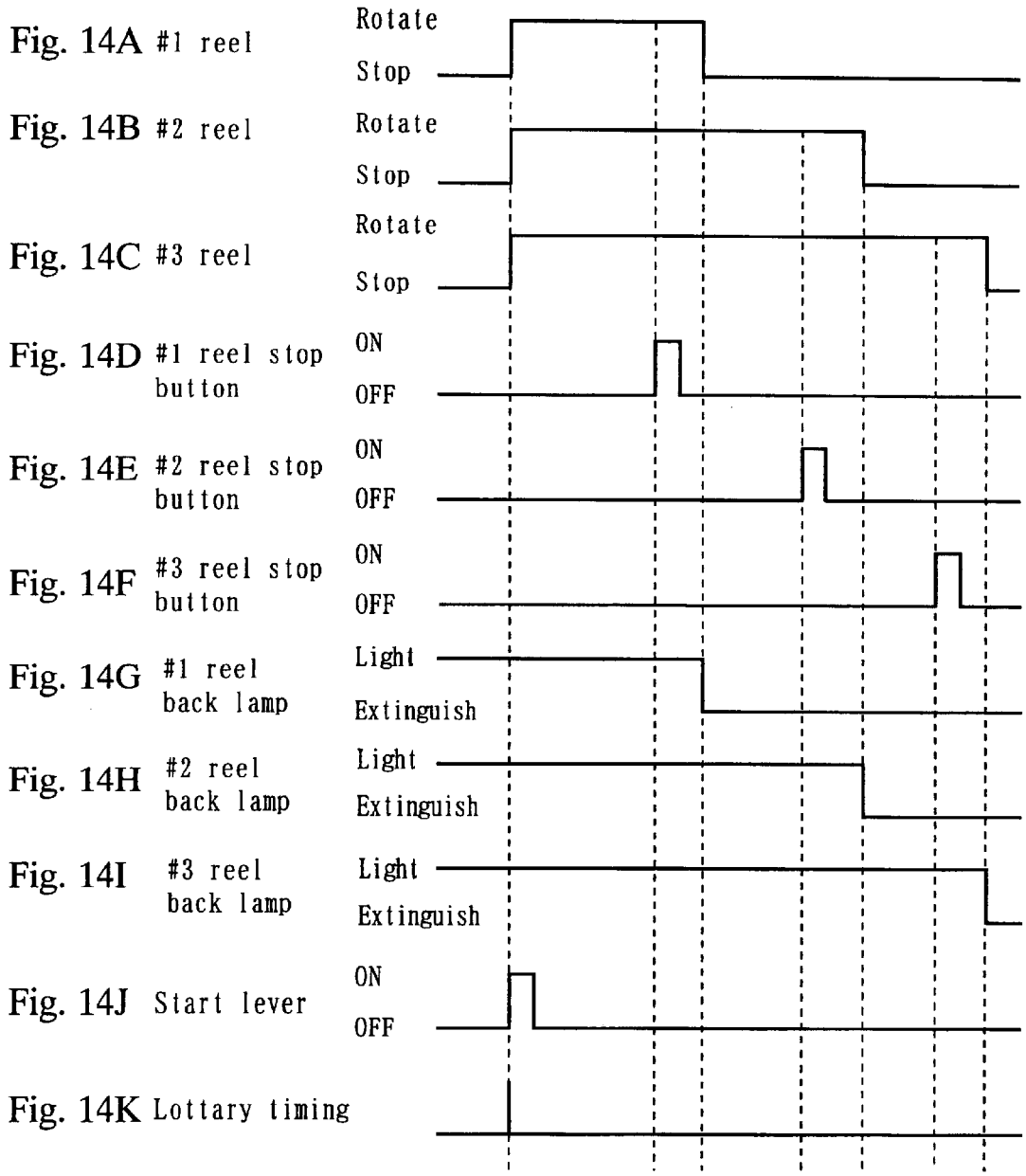
Fig. 14A #1 reel
Rotate
Stop
Fig. 14B #2 reel
Rotate
Stop
Fig. 14C #3 reel
Rotate
Stop
Fig. 14D #1 reel stop button
ON
OFF
Fig. 14E #2 reel stop button
ON
OFF
Fig. 14F #3 reel stop button
ON
OFF
Fig. 14G #1 reel back lamp
Light
Extinguish
Fig. 14H #2 reel back lamp
Light
Extinguish
Fig. 14I #3 reel back lamp
Light
Extinguish
Fig. 14J Start lever
ON
OFF
Fig. 14K Lottary timing

Fig. 16A

| #1 reel | #2 reel | #3 reel |
|---|---|---|
| F | ↓ | ↓ |
| A | ↓ | ↓ |
| E | ↓ | ↓ |

Fig. 16B

| #1 reel | #2 reel | #3 reel |
|---|---|---|
| F | D | ↓ |
| A | A | ↓ |
| E | E | ↓ |

Fig. 16C

| | #1 reel | #2 reel | #3 reel |
|---|---|---|---|
| Prize line L 1 | A | A | ↓ |
| 〃 L 2 A | F | D | ↓ |
| 〃 L 2 B | E | E | ↓ |
| 〃 L 3 A | F | A | ↓ |
| 〃 L 3 B | E | A | ↓ |

Fig. 17

| Code No. | Hit prediction flag | | | |
|---|---|---|---|---|
| | Big hit | Medium hit | Small hit | No prize |
| 0 | 0 | 0 | 0 | 1 |
| 1 | 0 | 1 | 0 | 0 |
| 2 | 0 | 1 | 0 | 0 |
| 3 | 0 | 0 | 0 | 1 |
| 4 | 0 | 0 | 0 | 1 |
| 5 | 1 | 0 | 1 | 0 |
| ⋮ | ⋮ | ⋮ | ⋮ | ⋮ |
| 20 | 0 | 0 | 0 | 1 |

Fig. 29
| | Light reel lamp | Extinguish reel lamp |
|---|---|---|
| #1 stop | Reel stop sound 1 (327.60 [ms] ) | Reel stop sound 2 (393.12 [ms] ) |
| #2 stop | Reel stop sound 1 (327.60 [ms] ) | Reel stop sound 3 (499.59 [ms] ) |
| #3 stop | Reel stop sound 1 (327.60 [ms] ) | Reel stop sound 4 (589.68 [ms] ) |
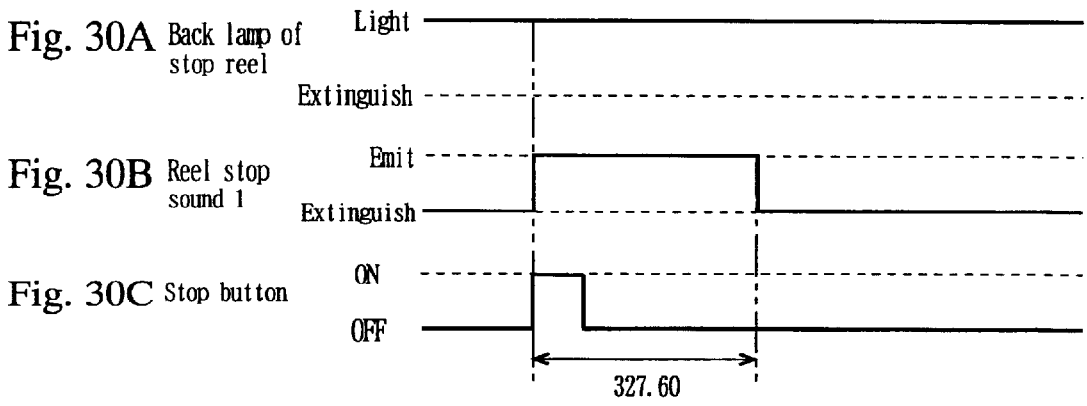
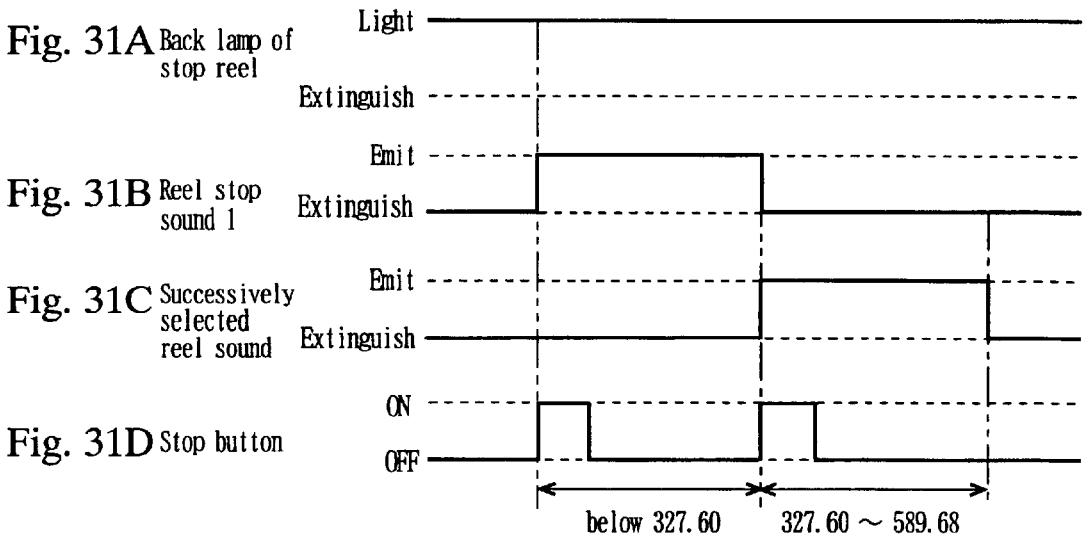

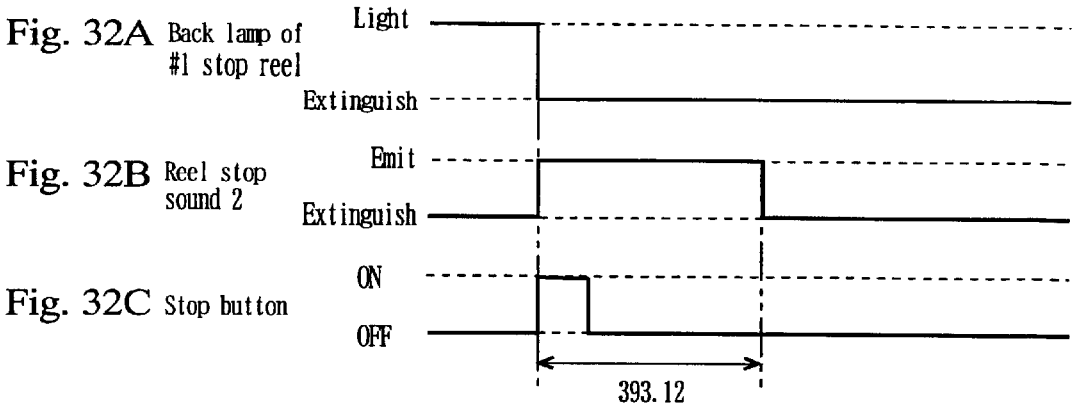
Fig. 32A Back lamp of #1 stop reel
Light
Extinguish
Fig. 32B Reel stop sound 2
Emit
Extinguish
Fig. 32C Stop button
ON
OFF
393.12

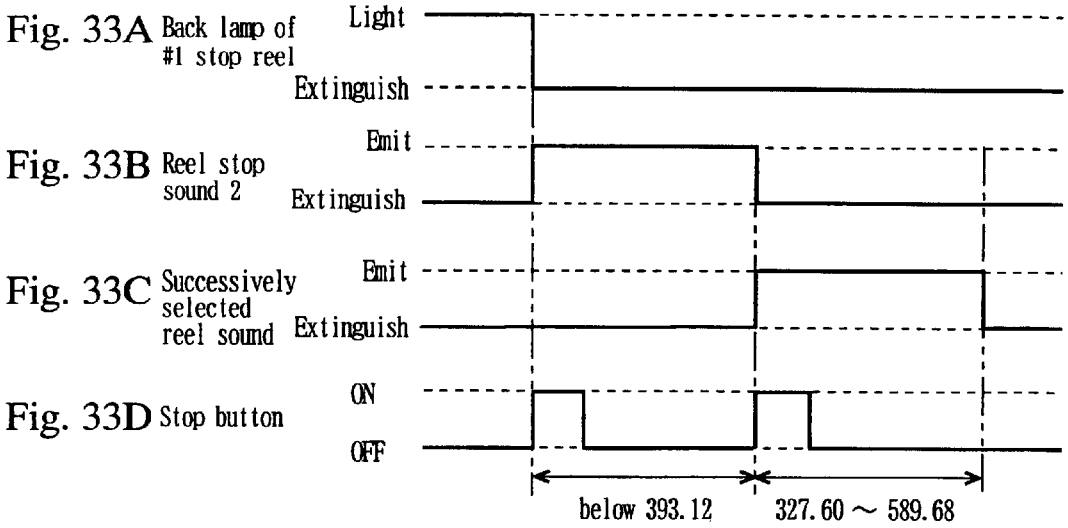
Fig. 33A Back lamp of #1 stop reel
Light
Extinguish
Fig. 33B Reel stop sound 2
Emit
Extinguish
Fig. 33C Successively selected reel sound
Emit
Extinguish
Fig. 33D Stop button
ON
OFF
below 393.12
327.60 ~ 589.68

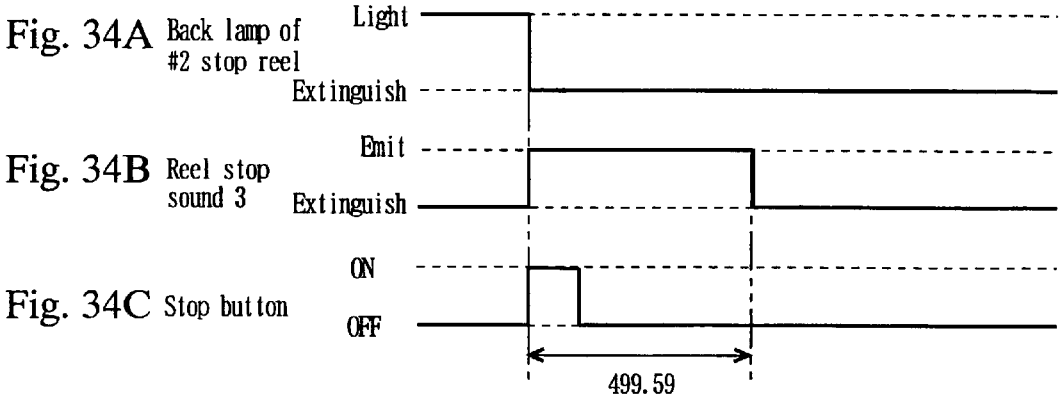
Fig. 34A Back lamp of #2 stop reel
Light
Extinguish
Fig. 34B Reel stop sound 3
Emit
Extinguish
Fig. 34C Stop button
ON
OFF
499.59

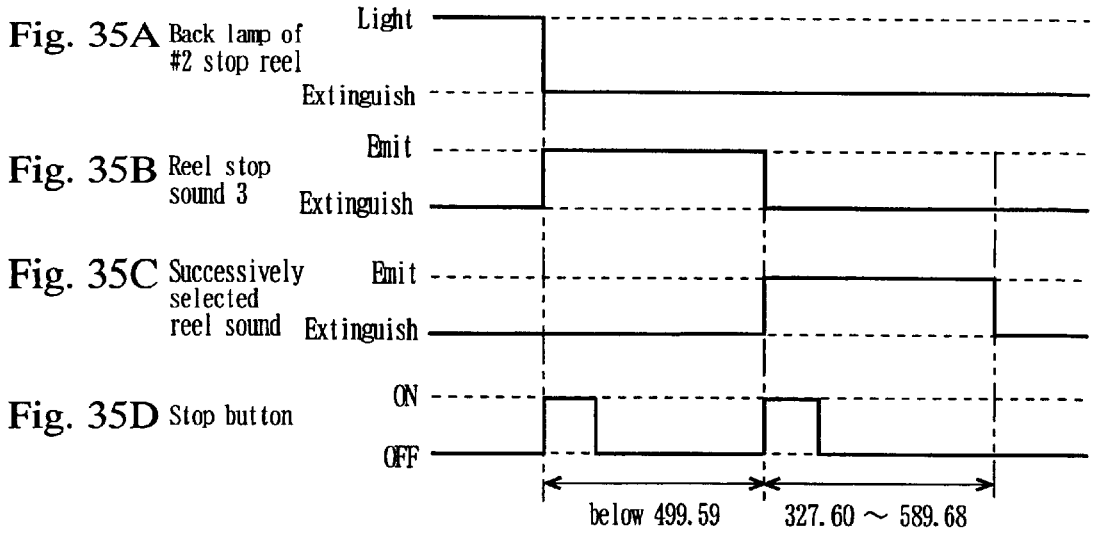
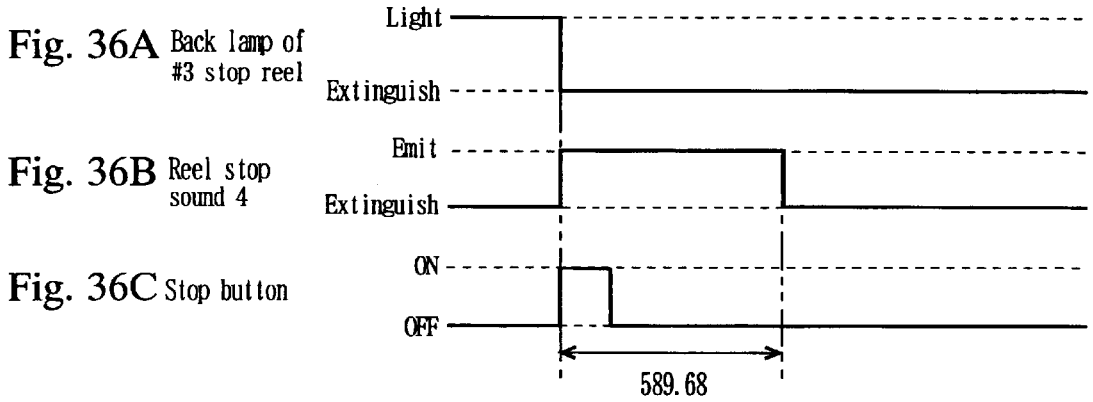
Fig. 37
| | Light reel lamp | Extinguish reel lamp |
|---|---|---|
| #1 stop | Reel stop sound 1 (do) | Reel stop sound 2 (re) |
| #2 stop | Reel stop sound 1 (do) | Reel stop sound 3 (mi) |
| #3 stop | Reel stop sound 1 (do) | Reel stop sound 4 (fa) |

Fig. 38

| GMLVSTS | FLGCTR | Table No. |
|---|---|---|
| in RB operation | Blank | 17 |
| | Hit | 17 |
| in BB operation | Blank | 17 |
| | 2 Cherry | 17 |
| | 4 Cherry | 17 |
| | Bell | 17 |
| | Watermelon | 17 |
| | Replay | 17 |
| in General game | Blank | 0 |
| | 2 Cherry | 1 |
| | 4 Cherry | 2 |
| | Bell | 3 |
| | Watermelon | 4 |
| | Replay | 5 |
| | RB | 6 |
| | BB | 7 |
| in inner hit of RB | Blank | 8 |
| | 2 Cherry | 9 |
| | 4 Cherry | 10 |
| | Bell | 11 |
| | Watermelon | 12 |
| | Replay | 13 |
| in inner hit of BB | Blank | 14 |
| | 2 Cherry | 9 |
| | 4 Cherry | 15 |
| | Bell | 11 |
| | Watermelon | 16 |
| | Replay | 13 |

Fig. 39

| Table No. | Lottery value | Reel lamp extinguish |
|---|---|---|
| No. 0 | 100 | 1 |
| | 9 | 2 |
| | 8 | 3 |
| | 3 | 4 |
| | 8 | 4 |
| No. 1 | 93 | 2 |
| | 26 | 2 |
| | 4 | 3 |
| | 5 | 1 |
| No. 2 | 3 | 1 |
| | 10 | 1 |
| | 5 | 2 |
| | 49 | 3 |
| | 30 | 5 |
| | 1 | 5 |
| | 30 | 5 |
| No. 3 | 70 | 1 |
| | 18 | 1 |
| | 30 | 2 |
| | 2 | 2 |
| | 8 | 5 |
| No. 4 | 60 | 1 |
| | 42 | 4 |
| | 14 | 4 |
| | 12 | 6 |
| No. 5 | 97 | 1 |
| | 18 | 2 |
| | 8 | 3 |
| | 3 | 4 |
| | 2 | 4 |
| No. 6 | 36 | 1 |
| | 26 | 1 |
| | 20 | 3 |
| | 10 | 3 |
| | 18 | 1 |
| | 7 | 4 |
| | 7 | 5 |
| | 4 | 6 |

Fig. 40

| | | |
|---|---|---|
| No. 7 | 55 | 1 |
| | 9 | 3 |
| | 12 | 3 |
| | 22 | 1 |
| | 6 | 4 |
| | 6 | 4 |
| | 18 | 5 |

| | | |
|---|---|---|
| No. 8 | 77 | 1 |
| | 6 | 2 |
| | 16 | 4 |
| | 16 | 6 |
| | 10 | 6 |
| | 3 | 6 |

| | | |
|---|---|---|
| No. 9 | 40 | 1 |
| | 20 | 2 |
| | 13 | 4 |
| | 36 | 7 |
| | 10 | 2 |
| | 9 | 4 |

| | | |
|---|---|---|
| No. 10 | 10 | 3 |
| | 50 | 7 |
| | 68 | 2 |

| | | |
|---|---|---|
| No. 11 | 38 | 1 |
| | 38 | 1 |
| | 24 | 4 |
| | 14 | 6 |
| | 7 | 6 |
| | 7 | 8 |

| | | |
|---|---|---|
| No. 12 | 37 | 1 |
| | 35 | 1 |
| | 28 | 5 |
| | 4 | 5 |
| | 14 | 5 |
| | 10 | 5 |

Fig. 41

| | | |
|---|---|---|
| No. 13 | 50 | 1 |
| | 8 | 2 |
| | 18 | 3 |
| | 14 | 5 |
| | 12 | 5 |
| | 16 | 1 |
| | 10 | 6 |

| | | |
|---|---|---|
| No. 14 | 80 | 1 |
| | 7 | 2 |
| | 15 | 4 |
| | 17 | 4 |
| | 2 | 4 |
| | 7 | 4 |

| | | |
|---|---|---|
| No. 15 | 42 | 5 |
| | 38 | 5 |
| | 48 | 2 |

| | | |
|---|---|---|
| No. 16 | 30 | 1 |
| | 32 | 5 |
| | 16 | 5 |
| | 2 | 4 |
| | 38 | 1 |
| | 10 | 5 |

| | | |
|---|---|---|
| No. 17 | 128 | 1 |

Fig. 42A

| GMLVSTS | | |
|---|---|---|
| Content | | Data |
| bit 7 | Not used | Normally 0 |
| 6 | | |
| 5 | | |
| 4 | in inner hit of BB | 0:off 1:on |
| 3 | in inner hit of RB | 0:off 1:on |
| 2 | in general game | 0:off 1:on |
| 1 | in BB operation | 0:off 1:on |
| 0 | in RB operation | 0:off 1:on |

Fig. 42B

| FLGCTR | |
|---|---|
| Content | Data |
| in blank | 0 0 H |
| in hit of 2 cherry | 0 1 H |
| in hit of 4 cherry | 0 2 H |
| in hit of bell | 0 3 H |
| in hit of watermelon | 0 4 H |
| in hit of replay | 0 5 H |
| in hit of RB | 0 6 H |
| in hit of BB | 0 7 H |

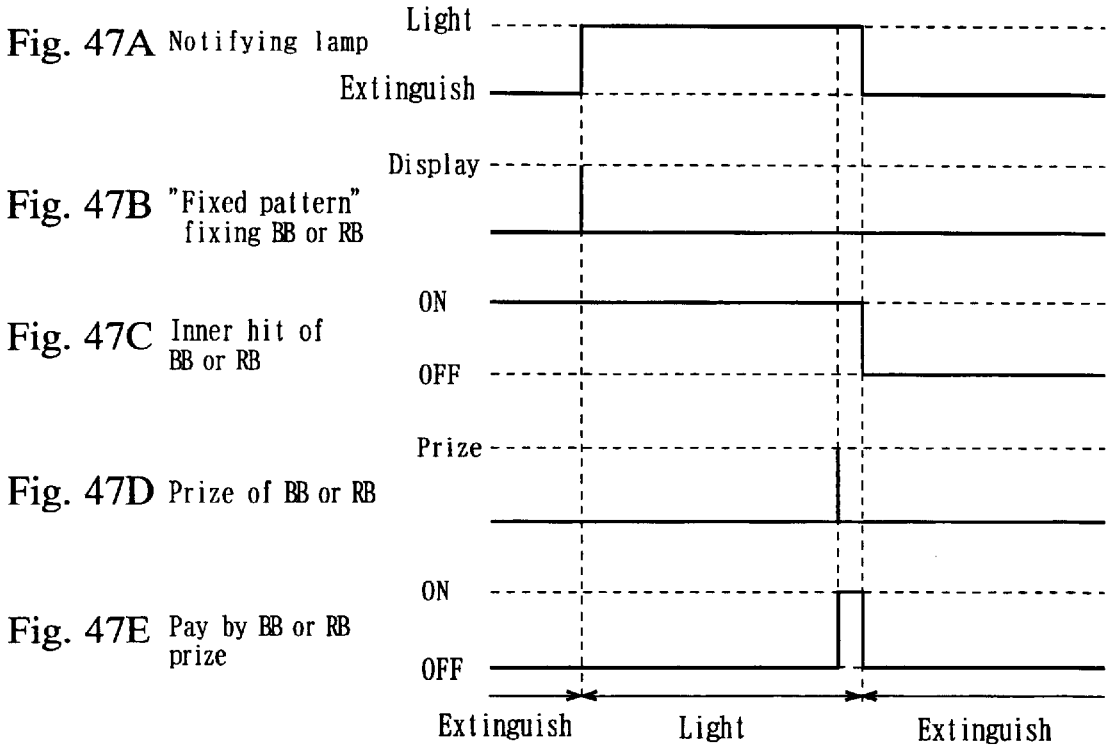
Fig. 47A Notifying lamp
Light
Extinguish
Fig. 47B "Fixed pattern" fixing BB or RB
Display
Fig. 47C Inner hit of BB or RB
ON
OFF
Fig. 47D Prize of BB or RB
Prize
Fig. 47E Pay by BB or RB prize
ON
OFF
Extinguish
Light
Extinguish

GAME MACHINE INFORMING PRIZE MODE INFORMATION BASED ON VARIABLE DISPLAY STOP REQUEST

This patent application claims priority based on the Japanese patent application, H09-334984, filed on Nov. 19, 1997 and H10-251528, filed on Sep. 4, 1998 the contents of which are incorporated herein by reference.

BACKGROUND OF THE INVENTION

1. Field of the Invention

The present invention relates to a game machine having a function of informing a prize mode determined by random number lottery to a player.

2. Description of Related Art

There has conventionally been, for example, a slot machine as a game machine of this kind. In a general slot machine, as shown by FIG. 1A, three reels 3, 4 and 5 are installed in parallel on a rear side of a front panel 2. Various patterns are illustrated on outer peripheries of the respective reels 3 through 5, and the patterns are illuminated by built-in light sources (back lights), not illustrated, installed at the respective reels and are observed via respective windows 6, 7 and 8 formed at the front panel 2. Five prize lines are described in the windows and the slot machine game is carried out in accordance with whether a combination of predetermined patterns is set on any of the prize lines.

The game is started when a player puts a coin into a slot and when the coin is put into the slot, as shown by FIG. 1A, all of the back lights are lighted. When a coin of the player has not been put thereinto by the player for a predetermined time period after finishing the game, or the like, all of the back lights are put off as shown by FIG. 1B. The respective reels 3 through 5 are rotated in accordance with operation of a start lever by the player and the respective windows 6 through 8 are displayed with the patterns which move to rotate in directions of columns thereof. When the respective reels 3 through 5 reach a constant speed, operation of respective stop buttons installed in correspondence with the respective reels 3 through 5 becomes effective.

The player operates the respective stop buttons while observing the moving patterns and stops rotation of the respective reels 3 through 5 to thereby stop and display desired patterns on any of the prize lines. The respective reels 3 through 5 stop rotating in accordance with operational timings of the respective stop buttons. When a predetermined combination of patterns is displayed on any of the prize lines in stopping them, a prize in accordance with the combination of patterns is obtained.

There are a big hit prize, a medium hit prize, a small hit prize and so on in prize modes and the big hit prize or the medium hit prize is caused when three of patterns "7" or patterns of a predetermined character are set on the prize line. A special game of big bonus game (BB game) in the case of the big hit prize or regular bonus game (RB game) in the case of the medium hit prize is carried out and a large amount of coins can be acquired. Further, the small hit prize is caused when three of patterns of "cherry" or "bell" or the like are aligned on the prize line and several coins can be acquired in the small hit prize. FIG. 1C shows a case in which patterns "bell" are aligned on a central prize line and in this case, back lights are winked.

Such prize modes are determined by a lottery of random numbers which is carried out immediately after operating the start lever and has already been determined before the respective reels are operated to stop by the player. The lottery of random numbers is executed by prize mode determining means constituted at inside of the game machine. When the big hit prize is determined by the lottery of random numbers, a display such as a notifying lamp installed at the front panel of the machine is lighted and the player is informed of the fact that the big hit prize is caused by the inner lottery of the machine. Thereafter, rotation of the respective reels are controlled to stop in accordance with operation of stopping the buttons by the player and the prize is caused when a combination of patterns of the prize determined by the lottery of random numbers is stopped and displayed on the prize line.

However, according to the above-described game machine, although the player is informed of the fact that the prize of the big hit is caused by the lottery at inside of the machine, this is informed by simply lighting the notifying lamp which is devoid of interest in game.

Further, according to the above-described conventional game machine, the player is informed of the fact that a situation of causing a big hit prize is brought about by the inner lottery by displaying a predetermined combination of patterns which is referred to as "reach spot" (hit anticipating state in mahjong game) in stopping to rotate the respective reels. However, only a skilled player accustomed to the game can read that the combination of patterns in stopping the reels constitutes the "reach spot" which is one of methods of informing establishment of big hit and a beginner of the game is difficult to read the "reach spot" from output display of the reels.

Further, according to the above-described conventional game machine, when a big hit prize is caused by the inner lottery, as mentioned above, the notifying lamp is immediately lighted and a result of the inner lottery is informed to the player. Therefore, according to the conventional game machine, a result of the inner lottery for causing the big hit prize is mechanically informed to the player as it is and the player cannot enjoy pleasure of searching the result of the inner lottery as in, for example, searching for the "reach spot".

Further, what is informed is only the case in which the big hit prize is caused by the inner lottery and information conveyed to the player is limited. Therefore, the result of the inner lottery which has been determined by the lottery of random numbers at inside of the machine is not known until the patterns are actually stopped and displayed at the respective windows with regard to prize modes other than the big hit prize. Accordingly, the player cannot previously grasp the result of the inner lottery and therefore, what patterns are to be aligned on the prize line cannot be known to the player at all when rotation of the reels are operated to stop initially.

SUMMARY OF THE INVENTION

The present invention has been carried out in order to resolve such problems and according an aspect of the present invention, there is provided a game machine comprising a variable display device for variably displaying various patterns in a plurality of columns, prize mode determining means for determining a prize mode of game by sampling a random number, and stopping means for stopping variable display of the variable display device at each of the respective columns, further comprising informing means informing to a player informing information in correspondence with the prize mode determined by the prize mode determining means at a predetermined probability based on an output of a request for stopping the variable display from the stopping means to the variable display device.

According to the constitution, for example, based on an output of the request for stopping at least in respect of one column of the variable display, or in connection with stopping the variable display at each of the respective columns, the informing information in accordance with a mode of prize determined by the inner lottery is informed to the player. For example, based on respective operation of the respective stop button, or based on an automatic output of the request for stopping the variable display, the respective light source for illuminating the respective rotating reel is controlled to light by a mode which differs in accordance with a kind of the mode of prize by which the mode of prize is informed to the player.

Accordingly, the mode of prize becomes clear when respectives of the variable display of a plurality of the columns are stopped. That is, not only the variable display of the variable display device is stopped by operating the respective stop buttons or the like but also the mode of prize determined by the inner lottery is informed to the player. As a result, operation of stop buttons or automatic stopping of the respective columns of variable display enhances the interest.

Further, the informing operation is not carried out in respect of all the result of the inner lottery but by a predetermined probability. Accordingly, the mode of prize may be informed to the player or may not be informed to the player. Accordingly, informing the mode of prize is expected by the player, the pleasure is also enhanced when the informing operation is carried out and operation of stop buttons or automatic stopping of columns of variable display further enhances the interest.

Further, the informing operation is carried out not only for a mode of the big hit prize but also for respective modes of prize and the player can be informed also of the result of the inner lottery other than the big hit prize. Therefore, operation of stop buttons is carried out easily.

Further, according to the above-described informing operation, informing information in correspondence with a mode of prize different from a mode of prize determined by the prize mode determining means may be informed at a predetermined probability. Therefore, the player may encounter a result different from a predicted prize and can further be excited by an unexpected feature of the game.

Further, according to another aspect of the present invention, further comprising notifying means for notifying to the player informing information by a specific informing mode on a condition in which the informing information informed by the informing means is predetermined informing information in correspondence with a specific prize mode determined by the prize mode determining means.

According to the constitution, when a specified prize mode is informed as predetermined informing information, the result of the inner lottery of causing the specific prize mode is notified to the player by the notifying means. In respect of the specified prize mode, when it is informed by informing information other than the predetermined informing information, the result of the inner lottery is not notified by the notifying means. Therefore, the player can be informed of the result of the inner lottery causing the specified prize mode by informing information informed by the informing means even when the result of the inner lottery of causing the specified prize mode is not notified by the notifying means.

Further, the notifying means notifies to the player the informing information by the specific informing mode on a condition in which the informing information informed by the informing means is informing information in correspondence with the specific prize mode determined by the prize mode determining means and predetermined informing information informed to the player at a probability of 100%.

According to the constitution, when the specified prize mode is informed at the probability of 100%, the result of the inner lottery of causing the specific prize mode is notified to the player by the notifying means. When the specific prize mode is informed at a probability smaller than 100%, that is, in the case in which even when the specific prize mode is caused by the inner lottery, the specific prize mode may not necessarily be informed, the result of the inner lottery is not notified by the notifying means. Therefore, even when the result of the inner lottery causing the specified prize mode is not notified by the notifying means, the player can be informed of the result of the inner lottery of causing the specified prize mode by informing information which is informed when the variable display is stopped by the stopping means.

That is, according to the present invention, the prize mode determined by the inner lottery is informed to the player based on the request for stopping the variable display. Therefore, the prize mode becomes clear based on, for example, operation of the plurality of respective stop buttons or automatic stopping control of the respective columns of the variable display and the operation of the stop buttons or automatic stopping of the columns of the variable display enhances the interest. Further, even a beginner of the game who cannot judge the "reach spot", can predict the prize mode to some degree by the informing operation. Further, the informing operation is carried out at a predetermined probability and therefore, when the informing operation is carried out, the pleasure is enhanced and the interest of operating the stop buttons or automatic stopping of the columns of the respective display is further enhanced. Also, the informing operation is carried out for the respective prize modes and therefore, operation of the stop buttons is easily carried out.

Further, even when the result of the inner lottery causing the specific prize is not notified by the notifying means, the player can be informed of the result of the inner lottery of causing the specific prize by the informing information of the informing means. Therefore, pleasure for searching occurrence of the specific prize mode is felt in the game from the informing information of the informing means.

BRIEF DESCRIPTION OF THE DRAWINGS

FIG. 7 is a diagram showing a prize probability table used in game process of the slot machines according to a first and a second respective embodiment;

FIG. 8 is a diagram showing a symbol table used in game process of the slot machines according to the first and the second respective embodiments.

FIG. 9 is a diagram showing a lottery probability table for informing selection of prize mode used in game process of the slot machine according to the first embodiment;

FIG. 10 is an appearance probability table showing probabilities of appearance of prediction informing patterns as a result of using the lottery probability table for informing selection of prize mode shown by FIG. 9;

FIGS. 14A, 14B, 14C, 14D, 14E, 14F, 14G, 14H, 14I, 14J and 14K are timing chart diagrams showing timings of respective processings executed in game process of the slot machine according to the first embodiment;

FIGS. 16A, 16B and 16C are diagrams showing a relationship among symbol codes which are allocated to the respective rotating reels and read in game process of the slot machine according to the first and the second respective embodiments.

FIG. 17 is a diagram showing a hit prediction flag table used in game process of the slot machine according to the first and the second respective embodiments;

FIG. 29 is a diagram showing a first reel stop sound selecting table used in game process of the slot machine according to the second embodiment;

FIGS. 30A, 30B and 30C are timing charts of reel stop sound 1 shown by FIG. 29;

FIGS. 31A, 31B, 31C and 31D are timing charts of the reel stop sound 1 when a successive stop button is pushed before stopping the reel stop sound 1;

FIGS. 32A, 32B and 32C are timing charts of reel stop sound 2 shown by FIG. 29;

FIGS. 33A, 33B, 33C and 33D are timing charts of the reel stop sound 2 when a successive stop button is pushed before stopping the reel stop sound 2;

FIGS. 34A, 34B and 34C are timing charts of reel stop sound 3 shown by FIG. 29;

FIGS. 35A, 35B, 35C and 35D are timing charts of the reel stop sound 3 when a successive stop button is pushed before stopping the reel stop sound 3;

FIGS. 36A, 36B and 36C are timing charts of reel stop sound 4 shown by FIG. 29;

FIG. 37 is a diagram showing a second reel stop sound selecting table used in game process of the slot machine according to the second embodiment;

FIG. 38 is a diagram showing a demonstration lottery table selecting table used in game process of the slot machine according to the second embodiment;

FIG. 39 is a diagram showing a first demonstration lottery table used in game process of the slot machine according to the second embodiment;

FIG. 40 is a diagram showing a second demonstration lottery table used in game process of the slot machine according to the second embodiment;

FIG. 41 is a diagram showing a third demonstration lottery table used in game process of the slot machine according to the second embodiment;

FIG. 42A is a diagram showing content of a game level status (GMLVSTS) storing region stored to RAM of the slot machine according to the second embodiment and FIG. 42B is a diagram showing content of a flag counter (FLGCTR) storing region stored to the RAM;

FIGS. 47A, 47B, 47C, 47D and 47E are diagrams showing timing charts of lighting a notifying lamp according to the second embodiment;

DESCRIPTION OF THE PREFERRED EMBODIMENTS

Next, an explanation will be given of a first embodiment in which a game machine according to the present invention is applied to a slot machine.

Figure 1A:
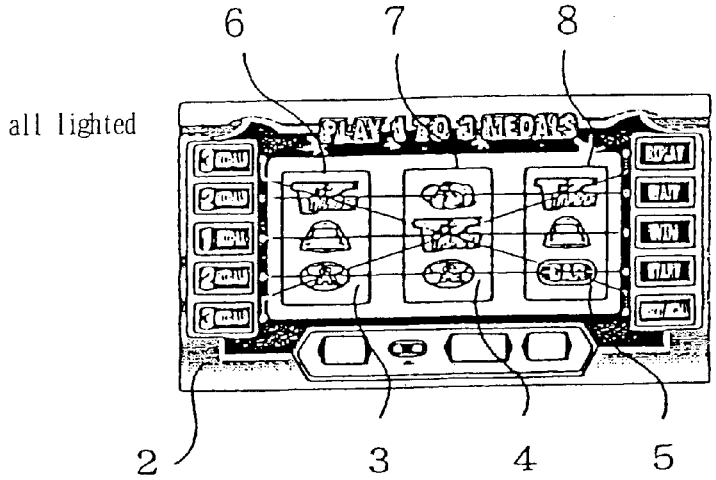
FIGS. 1A, 1B and 1C are views showing states of lighting respective reel back lamps in a conventional slot machine.
Figure 1B:
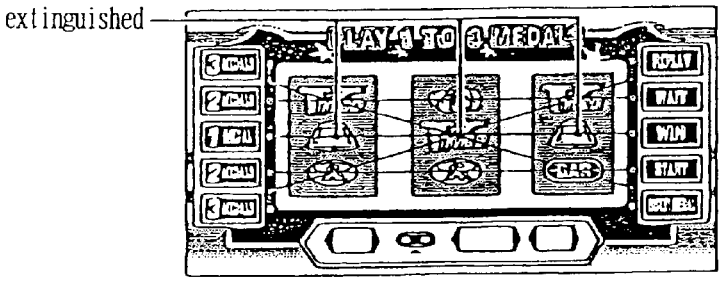
Figure 1C:
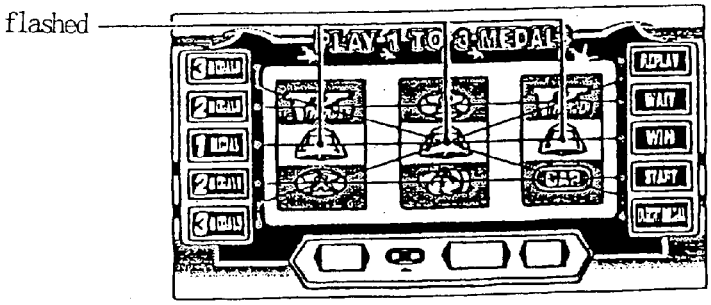
Figure 2:
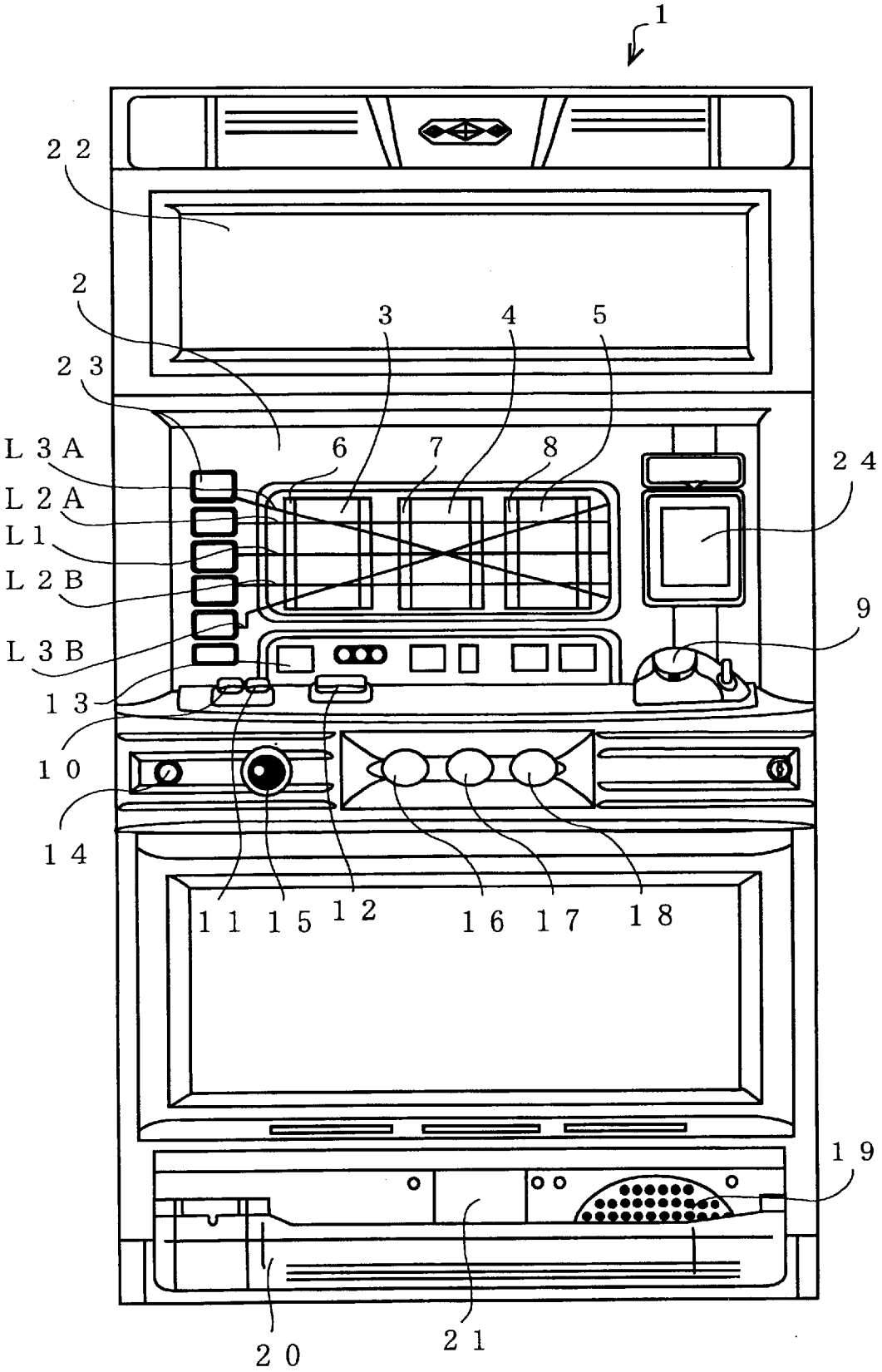
FIG. 2 is a front view showing an outlook of a slot machine according to a first embodiment of the present invention.

FIG. 2 is a front view of a slot machine 1 according to the embodiment.

Three reels 3, 4 and 5 constituting a variable display device are rotatably installed on a rear side of a front panel 2 of the slot machine 1. Columns of symbols comprising pluralities of kinds of patterns (hereinafter, referred to as symbol) are illustrated on outer peripheral faces of the respective reels 3, 4 and 5. Three of the symbols are observed via each of display windows 6, 7 and 8 at the front face of the slot machine 1. Further, a slot 9 into which a player inserts coins is installed on the lower right side of the display windows 6, 7 and 8.

Figure 3:
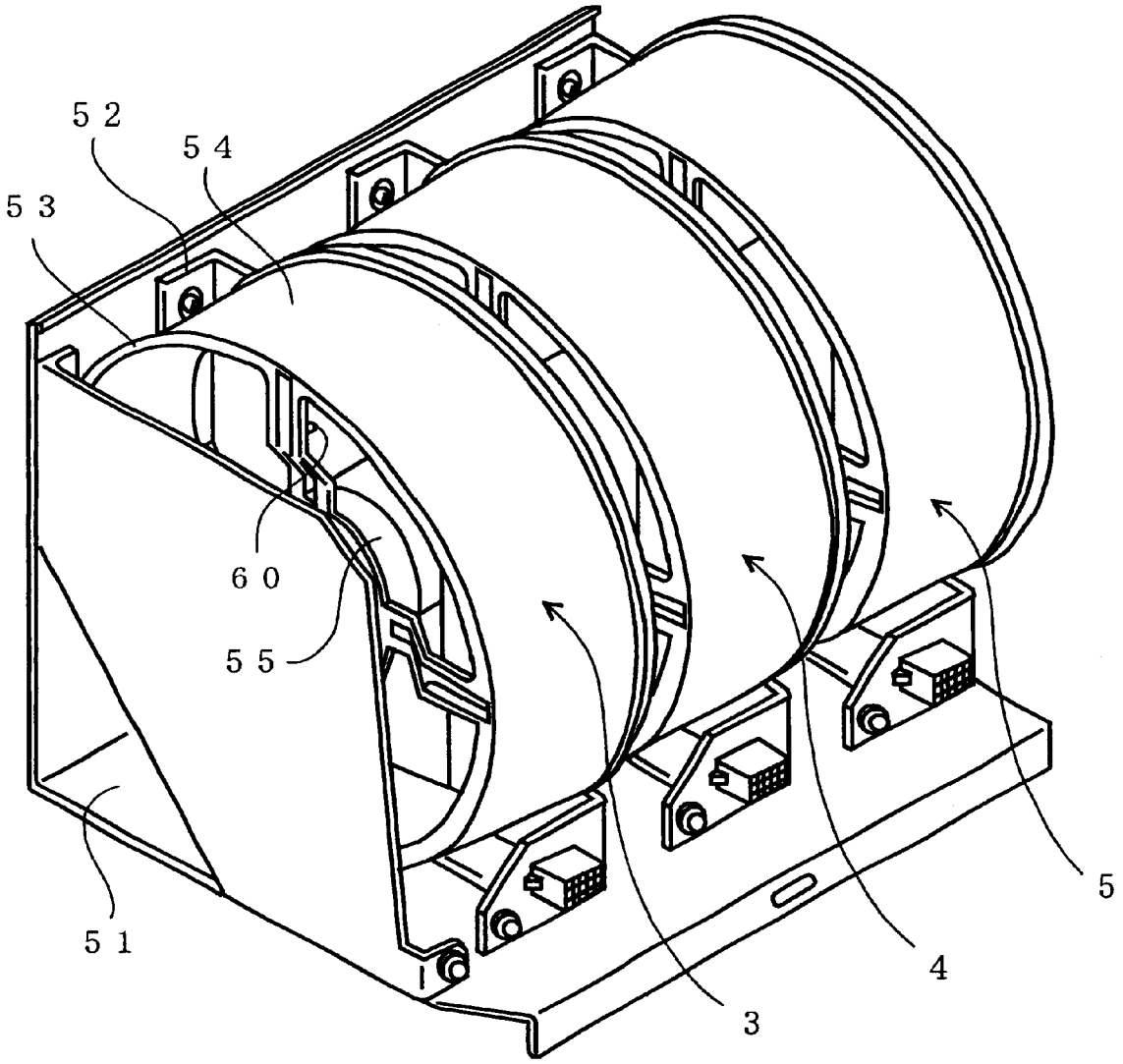
FIG. 3 is a perspective view showing a rotating reel unit of the stopping machine shown by FIG. 2.

The respective reels 3 through 5 are constituted as a rotating reel unit shown by FIG. 3 and are attached to a frame 51 via brackets 52. Each of the reels 3 through 5 is constituted by pasting a reel band 54 on the outer periphery of a reel drum 53. The above-described symbol column is illustrated on the outer peripheral face of the reel band 54. Further, each of the brackets 52 is installed with a stepping motor 55 and the respective reels 3 through 5 are rotated by being driven by the motors 55.

Figure 4A:
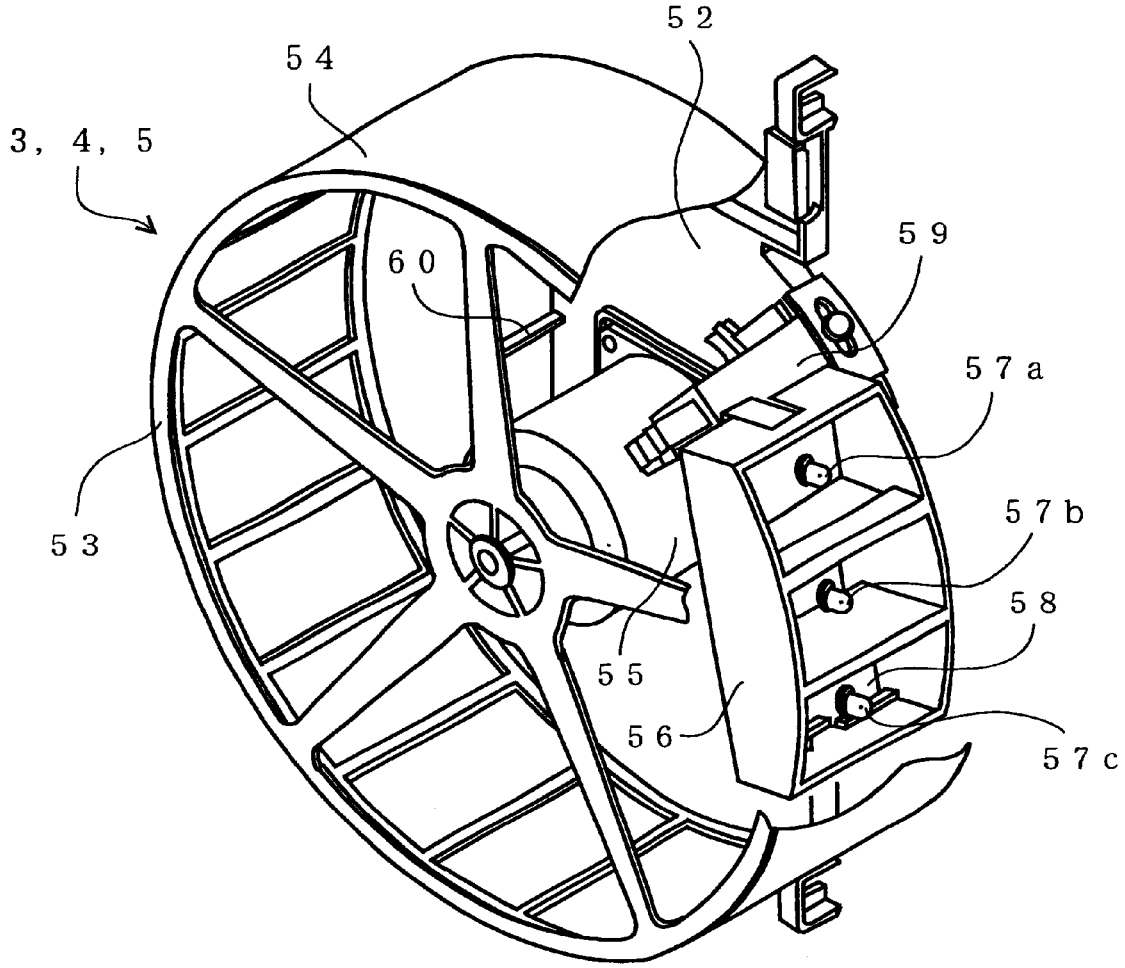
FIGS. 4A and 4B are perspective views showing structure of a rotating reel constituting the rotating reel unit shown by FIG. 3.
Figure 4B:
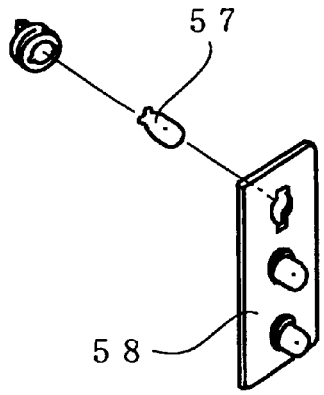

FIG. 4A shows the structure of each of the respective reels 3 through 5. Further, portions of FIGS. 4A and 4B the same as those in FIG. 3 are attached with the same notations and an explanation thereof will be omitted. A lamp case 56 is installed at inside of the reel drum 53 on the rear side of the reel band 54 and back lamps 57*a*, 57*b* and 57*c* are respectively attached to three respective chambers of the lamp case 56. As shown by FIG. 4B, the back lamps 57*a*, 57*b* and 57*c* are mounted on a board 58 and the board 58 is attached to the rear side of the lamp case 56. A photosensor 59 is attached to the bracket 52. The photosensor 59 detects a shield plate 60 installed to the reel drum 53 to pass through the photosensor 59 in accordance with rotation of the reel drum 53.

The respective back lamps 57*a*, 57*b* and 57*c* are individually controlled to light by a lamp drive circuit 48, mentioned later. By lighting the respective back lamps 57*a*, 57*b* and 57*c*, three symbols disposed on the front side of the respective back lamps 57*a*, 57*b* and 57*c* are individually lighted from the rear side among symbols illustrated on the reel bands 54 and three symbols are projected on each of the respective display windows 6 through 8.

Figure 5A:
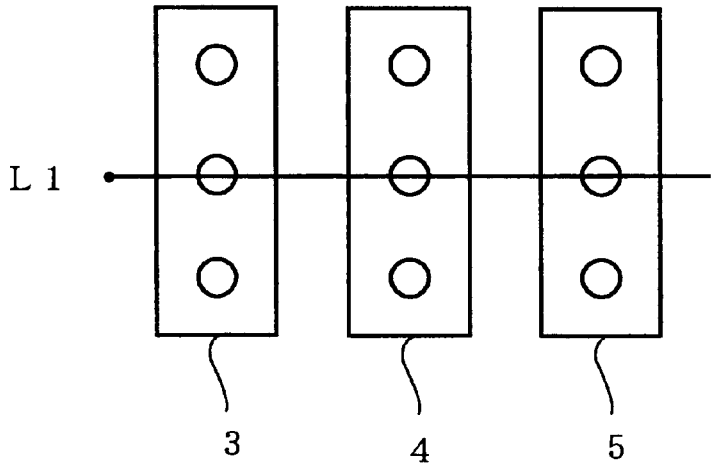
FIGS. 5A, 5B and 5C are views showing states in which prize lines described in display windows of the slot machine shown by FIG. 2 become successively effective.
Figure 5B:
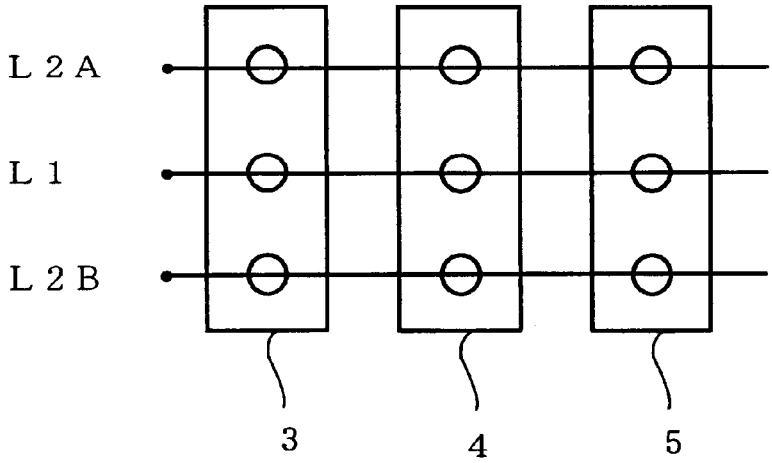

Further, the display windows 6 through 8 shown by FIG. 2 are described with prize lines of horizontal three lines (central line L1 and upper and lower lines L2A and L2B) as well as skew two lines (skew right downward line L3A and skew right upward line L3B). Before starting a game, when a player puts one sheet of coin into the coin slot 9, only the central prize line L1 of the respective reels 3 through 5 is made effective as shown by FIG. 5A. Further, when two sheets of coins are put into the slot 9, the upper and the lower prize lines L2A and L2B are added thereto and horizontal three lines of the prize lines L1, L2A and L2B are made effective as shown by FIG. 5B. Further, when three sheets of coins are put into the slot 9, all the prize lines L1, L2A, L2B, L3A and L3B are made effective as shown by FIG. 5C.

Figure 5C:
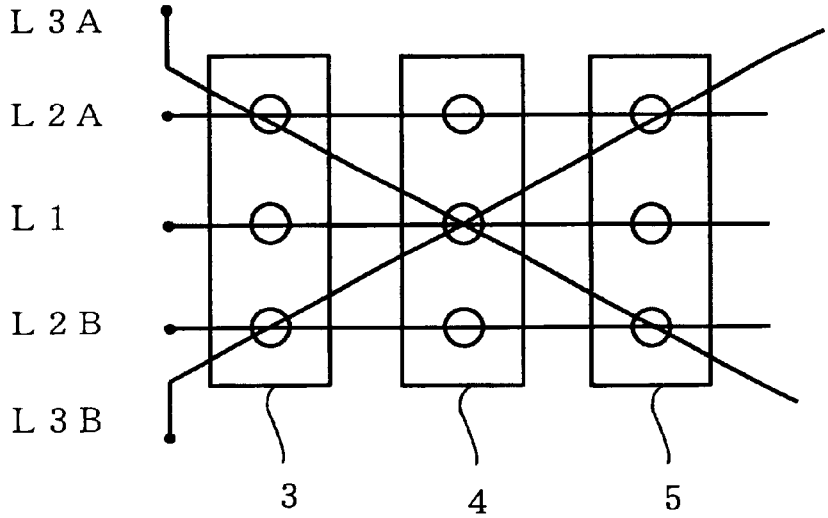

Further, circular marks in the FIGS. 5A, 5B and 5C represent symbols illustrated on the respective reels 3 through 5. The effectiveness of the prize line is displayed to the player by lighting effective line display lamps 23 (refer to FIG. 2) arranged at end portions of the respective prize lines.

Further, a 1BET switch 10, a 2BET switch 11 and a maxBET switch 12 are installed on the lower left side of the display windows 6 through 8. When coins are credited at a credit number display unit 13, instead of putting coins into the coin slot 9, by operating respective push buttons of the 1BET switch 10, the 2BET switch 11 and the maxBET switch 12, one sheet, two sheets and three sheets of coins are respectively betted in one game. The credit number display unit 13 is constituted by 7 segments LEDs (Light Emitting Diode) in accordance with a number of a digit of a displayed numerical value and displays a number of coins currently credited.

A credit/pay out switch (C/P switch) 14 and a start lever 15 are installed on the lower side of the BET switches 10 through 12 and stop buttons 16, 17 and 18 are installed at a central portion of the device on the right side of the start lever 15. By operating the push button of the C/P switch 14, game credit/pay out of coins can be switched.

Further, by lever operation of the start lever 15, rotation of the reels 3, 4 and 5 is simultaneously started. The stop buttons 16, 17 and 18 are arranged in correspondence with the respective reels 3, 4 and 5, the operation is made effective when rotation of the respective reels 3 through 5 reaches a constant speed and rotation of the respective reels are stopped in accordance with push button operation of the player.

Further, a sound emitting hole 19 and a coin tray 20 are installed on the lower side of the front face of the slot machine 1. The sound emitting hole 19 is for emitting sound generated from a speaker contained at inside of the device to outside. The coin tray 20 is for storing coins paid out from a coin outlet 21. Further, a prize display portion 22 indicating how much coins are to be paid out to respective prize is installed on the upper side of the front face of the slot machine 1.

Further, a liquid crystal display unit 24 is installed at a front panel 2 on the right side of the respective reels 3, 4 and 5. The liquid crystal display unit 24 is a display device displaying rotation of the respective reels 3, 4 and 5, displaying history of game or carrying out a representation in a bonus game.

Figure 6:
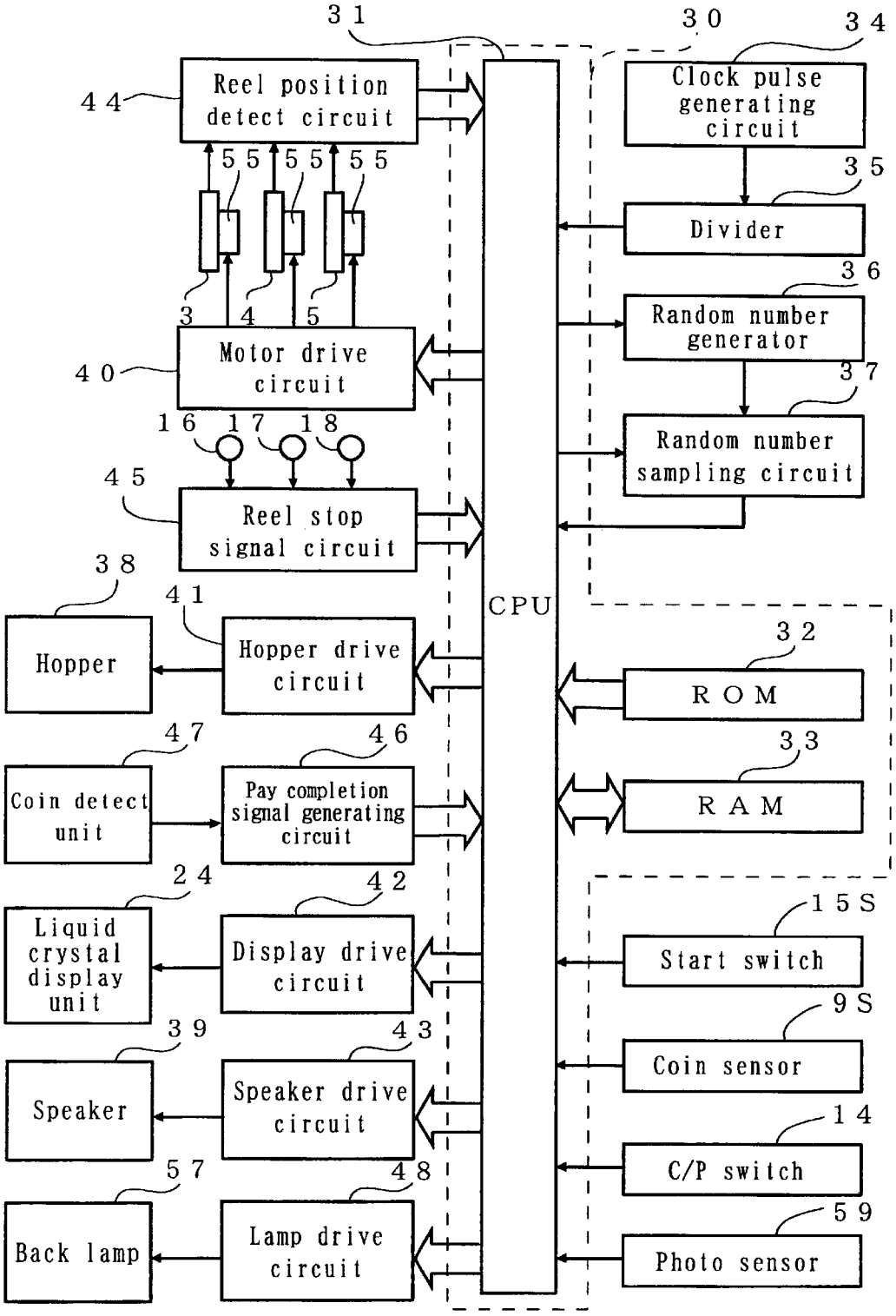
FIG. 6 is a block diagram showing a constitution of principal control circuits of the slot machine shown by FIG. 2.

FIG. 6 shows a circuit constitution including a control unit for controlling operation of game process operation in the slot machine 1 of the embodiment and peripheral devices (actuators) electrically connected thereto.

The control is constituted by a microcomputer (hereinafter, referred to as micon) 30 as a major constituent element and circuits for random number sampling in addition thereto. The micon 30 is constituted to include CPU 31, ROM 32 and RAM 33 as storing means. CPU 31 is connected with a clock pulse generating circuit 34 and a divider 35 for generating reference clock pulses, a random number generator 36 which is random number generating means for generating random numbers in constant ranges and a random number sampling circuit 37 which is random number sampling means for sampling an arbitrary random number among the generated random numbers.

As major actuators the operation of which are controlled by control signals from the micon 30, there are the respective stepping motors 55 for driving to rotate the reels 3, 4 and 5, a hopper 38 for containing coins, the liquid crystal display unit 24, a speaker 39 and the back lamps 57*a*, 57*b* and 57*c*. These are respectively driven by a motor drive circuit 40, a hopper drive circuit 41, a display drive circuit 42, a speaker drive circuit 43 and the lamp drive circuit 48. The drive circuits 40 through 43 and 48 are connected to CPU 31 via an I/O port of the micon 30. The respective stepping motors 15 are excited in 1 or 2 phase excitation by the motor drive circuit 40 and are respectively rotated by one rotation when drive signals of 400 pulses are supplied.

Further, as major input signal generating means for generating input signals necessary for forming control signals by the micon 30, there are a start switch 15S, a coin input sensor 9S and the C/P switch 14 mentioned above. Also, there are the photosensor 59 and a reel position detect circuit 44 for detecting rotational positions of the respective reels 3, 4 and 5 by receiving an output pulse signal from the photosensor 59.

The photosensor 59 detects the shield plate 60 at each rotation of the respective reels 3, 4 and 5 and generates a reset pulse. The reset pulse is transmitted to CPU 31 via the reel position detect circuit 44. RAM 33 is stored with numerical values in correspondence with the rotational positions in a range of one rotation in respect of the reels 3 through 5 and when CPU 31 receives the reset pulse, CPU 31 clears the numerical values formed in RAM 33 to "0". By the clearing operation, a deviation caused between display of movement of each symbol and rotation of each stepping motor 55 is resolved at every rotation.

Further, there are provided a reel stop signal circuit 45 and a pay completion signal generating circuit 46 as the above-described input signal generating means. The reel stop signal circuit 45 generates signals for stopping corresponding ones of the reels 3, 4 and 5 when the stop buttons 16, 17 and 18 are pushed. Further, a coin detect unit 47 counts a number of coins paid out from the hopper 38 and the pay completion signal generating circuit 46 outputs a signal informing completion of pay out of coins to CPU 31 when a counted value of actually paid-out coins, which is inputted from the coin detect unit 47 reaches data of a predetermined number of prize.

ROM 32 is stored with a procedure of game process executed in the slot machine 1 as a sequence program as well as, a prize probability table, a symbol table, a prize symbol combination table, a prize mode informing selection lottery probability table and so on which are respectively classified from each other.

The prize probability table constitutes random number classifying means for classifying random numbers sampled by the sampling circuit 37 into respective prize modes and stores data for classifying random numbers in constant ranges generated by the random number generator 36 to respective prize modes. Such a prize probability table is constituted as shown by, for example, FIG. 7. Notations a1, a2 and a3, b1, b2 and b3, c1, c2 and c3, d1, d2 and d3, e1, e2 and e3, f1, f2 and f3, g1, g2 and g3, designate previously set numerical value data which are used in classifying random numbers sampled by the sampling circuit 37 into respective prize modes. According to the data, there are used combinations of respective numerical values of "a1, b1, c1, d1, e1, f1 and g1" when a number of sheets of inputted coins is one, "a2, b2, c2, d2, e2, f2 and g2" when it is two and "a3, b3, c3, d3, e3, f3 and g3" when it is three.

These numerical values are set under a large or small relationship of "a<b<c<d<e<f<g" and when a sampled random number value is less than a, a big hit prize (big hit) is constituted and a "BB" hit flag is erected. Further, when a sampled random number value is equal to or more than a and less than b, a medium hit prize (medium hit) is constituted and a "RB" hit flag is erected. Further, when a sampled random number value is equal to or more than b and less than f, a small hit prize (small hit) is constituted and in this case, when it is equal to or more than b and less than c, a "watermelon" hit flag is erected, when it is equal to or more than c and less than d, a "bell" hit flag is erected, when it is equal to or more than d and less than e, a "4 cherry" hit flag is erected and when it is equal to or more than e and less f, a "2 cherry" hit flag is erected. Further, when a sampled random number value is equal to or more than f and less than g, a "replay" hit flag is erected and when it is equal to or more than g, a "blank" hit flag with no prize is erected.

That is, a prize mode is determined by to which numerical value range a sampled random number value pertains and is represented by a total of 8 kinds of hit flags including "blank" and "replay". In this case, the random number generator 36, the sampling circuit 37, the prize probability table and the micon 30 constitute prize mode determining means. Various hits are caused under probabilities in accordance with data setting in such a prize probability table and therefore, they are not controlled extremely by the skill of the player and a total coin pay rate in, for example, business hours of one day is maintained substantially constant.

Further, FIG. 8 conceptually shows the symbol table. The symbol table corresponds the rotational positions of the respective reels 3 through 5 with symbols and represents columns of symbols by notations. The symbol table is stored with symbol codes in correspondence with code numbers. The code numbers are successively provided at constant rotational pitches of the respective reels 3 through 5 with the rotational position for generating the reset pulse mentioned above as a reference. The symbol codes designate symbols provided in correspondence with the respective code numbers.

Further, the prize symbol combination table is stored with symbol codes of respective prize symbol combinations displayed on a prize display portion 22, symbol codes of symbol combinations constituting the "reach spot" indicating to the player that flags for causing a specific game are established, prize determination codes representing respective prizes, a number of sheets of coins for prize and so on. The prize symbol combination table is referred when the first reel 3, the second reel 4 and the third reel 5 are controlled to stop and when prize is confirmed after stopping all of the reels.

Further, the prize mode informing selection lottery probability table is referred when a prize mode determined by the prize mode determining means is informed to a player at a predetermined probability. The lamp drive circuit 48, the back lamps 57*a*, 57*b* and 57*c* and the micon 30 constitute informing means for informing the prize mode and inform the prize mode as mentioned later by controlling to light the respective back lamps 57*a*, 57*b* and 57*c* in 8 patterns which differ in accordance with the kind of the prize mode in connection with the respective operation of the respective stop buttons 16 through 18.

Informing probabilities are previously determined in accordance with kinds of hit flags, game states and a number of inserting coins and, for example, the prize mode informing selection lottery probability table which is used in carrying out general game with three sheets betting, is constituted, for example, as shown by FIG. 9.

The probability table is shown in correspondence with a probability table of three sheets betting in the prize probability table shown by FIG. 7. That is, the respective values of the numerical value data a3, b3, c3, d3, e3, f3 and g3 which are hit section data in three sheets betting shown by FIG. 7 are indicated at upper columns of the informing selection lottery probability table shown by FIG. 9. Further, respective values of inform section data in carrying out general game of three sheets betting are indicated at lower columns thereof. In this case, the random number generator 36 generates random numbers in a range of 0 through 65535 (=$2^{16}$).

According to the table, when a random number in a range of 0 through 200 is sampled by the sampling circuit 37 in determining the prize, the result of the inner lottery constitutes a big hit prize and the "BB" hit flag is erected and when a random number in a range of 201 through 380 is sampled by the sampling circuit 37, the result of inner lottery constitutes a medium hit prize and the "RB" hit flag is selected. Similarly, when a random number in a range of 381 through 10000 is sampled, either of small hit prize hit flags of the respective prizes is selected and when a random number in a range of 10001 through 18000 is sampled, the "replay" hit flag is erected and when a random number in a range of 18001 through 65535 is sampled, the "blank" hit flag is erected.

Further, when a random number in a range of 0 through 150 or 20000 through 20200 is sampled by the sampling circuit 37 in determining the prize, the respective back lamps 57*a*, 57*b* and 57*c* are controlled to light by a prize mode informing pattern of the "BB" hit flag. That is, when a random number in a range of 0 through 150 is sampled and the "BB" hit flag is erected, the prize mode of the "BB" hit flag is informed. Further, also when a random number in a range of 20000 through 20200 is sampled and the "blank" hit flag is erected, the prize mode of the "BB" hit flag is informed. Meanwhile, even when a random number in a range of 151 through 200 is sampled and the "BB" hit flag is erected, the random number in this range is out of the range of the inform section data of the "BB" hit flag and accordingly the prize mode of the "BB" hit flag is not informed.

That is, even when the prize mode of the "BB" hit flag is informed, the "BB" hit flag is not necessarily erected by the inner lottery and further, even when the prize mode of the "BB" hit flag is not informed, it is not necessarily established that the "BB" hit flag is not erected by the inner lottery. The prize mode of the "BB" hit flag is informed under a predetermined degree of reliability and in the case of the table shown by FIG. 9, the probability of informing the prize mode when the "BB" hit flag is erected is 151/352 or about 43% {(151 of 0–150)/a sum of 151 of 0–150 and 201 of 2000–20200)}. Further, a probability of informing the prize mode when the "BB" hit flag is not erected is 201/352 or about 57%. As a result, operation of informing the prize mode is failed at the probability of about 57%.

Such an operation of informing the prize mode is carried out similarly also in respect of the "RB" hit flag, the respective hit flags of the small hit prizes and the "replay" hit flag. However, the reliability of informing the prize mode needs not to be made uniform in all of the flags but may differ in accordance with a number of inserting coins or states of game. For example, according to the table shown by FIG. 9, the probability of hitting of information of the "watermelon" hit flag is 390/810 or about 48% and a probability of failing of the information is 420/810 or about 52%.

An appearance probability table in FIG. 10 shows probabilities of informing the respective hit flags by controlling to light the respective back lamps 57*a*, 57*b* and 57*c* as a result of carrying out the above-described prize mode informing selection lottery, that is, probabilities of appearing respective back lamp informing patterns. The appearance probabilities differ in accordance with kinds of hit flags and the states of game, for example, a probability of appearing a blank prize mode informing pattern is changed as P11, P12, P13, P14 and P15 depending on states of game.

In this case, in respect of kinds of states of game, there are five kinds of "RB operation", "general game in BB operation", "general game", "general game in inner hit of RB" and "general game in inner hit of BB".

Notation RB signifies a regular bonus game mentioned above and in the RB game, a bonus game in which a plurality of times of high prize games constitute one set can be carried out once. "RB operation" represents a state of game in the RB game and either of blank and JAC hit is caused. Further, notation BB signifies a big bonus game mentioned above and in the BB game, sets of general game and the above-described bonus game can be carried out by a plurality of times. "General game in BB operation" signifies the general game in the BB game and in the general game, a small hit prize is caused at a high probability. Further, "general game" is a state of game in which no prize is caused. "General game in inner hit of RB" and "general game in inner hit of BB" represent a general game state in which although the RB hit flag or the BB hit flag is erected, a predetermined prize combination of symbols is not stopped to display and the game does not enter an RB game or a BB game yet.

Next, an explanation will be given of the operation of the game machine controlled by the micon 30 according to the embodiment.

Figure 11:
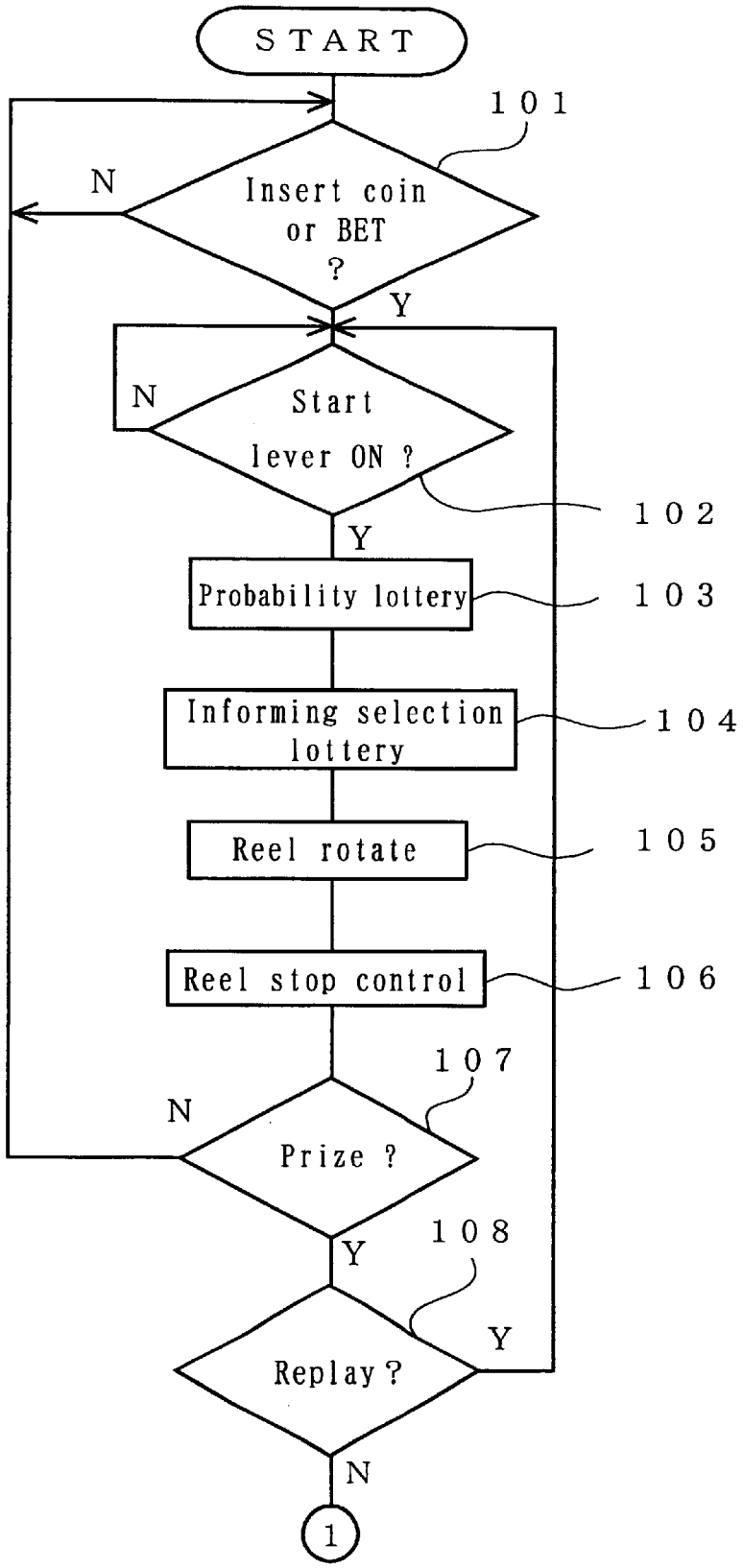
FIG. 11 is a first flowchart showing game process of the slot machine according to the first embodiment.
Figure 12:
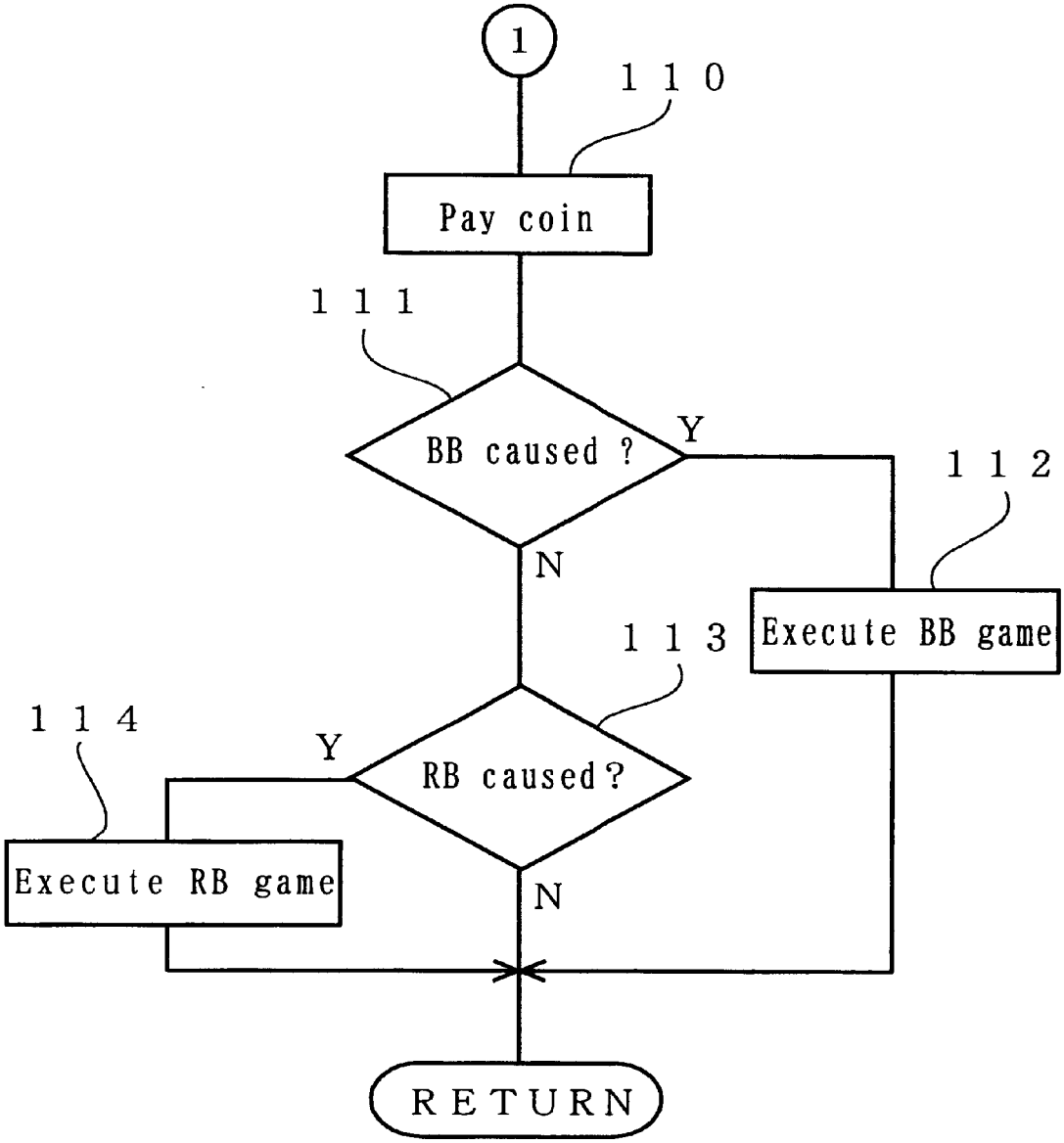
FIG. 12 is a second flowchart showing game process of the slot machine according to the first and the second respective embodiments.

FIG. 11 and FIG. 12 are flowcharts showing an outline of the game process.

First, whether a coin BET is carried out is determined by CPU 31 (refer to step 101 of FIG. 11). The determination is "YES" when a coin is inserted into the coin slot 9 and a detection signal from the coin sensor 9S is inputted or signals from the BET switches 10, 11 and 12 are inputted. In this case, the respective back lamps 57*a*, 57*b* and 57*c* built in the first reel 3, the second reel 4 and the third reel 5 are lighted shown by timing charts of FIG. 14G, FIG. 14H and FIG. 14I by control of the lamp drive circuit 48 by CPU 31. Next, whether a start signal from the start switch 15S is inputted by operating the start lever 15 is determined (step 102).

When the determination is "YES", the determination of prize (probability lottery processing) is carried out (step 103) and successive to the prize determination processing, informing selection lottery processing of the prize mode is carried out (step 104). Timing of carrying out prize determination and informing selection lottery processing is shown by a timing chart of FIG. 14K and is carried out immediately after operating the start lever 15 shown by FIG. 14J.

As mentioned above, the prize determination is carried out by determining to which prize group a random number value generated at the random number generator 36 and specified by the sampling circuit 37, pertains in the prize probability table (refer to FIG. 7). The prize mode determined by prize mode determining means is represented by a kind of a hit flag and either one of 8 kinds of "blank", "replay", "2 cherry", "4 cherry", "bell", "watermelon", "RB" and "BB" is set to a predetermined region of RAM 33.

Further, the informing selection lottery processing of the prize mode is carried out by using the informing selection lottery probability table exemplified in FIG. 9 and is carried out by determining to which section of the inform section data of the probability table a random number value specified by the sampling circuit 37 pertains. The result of the informing selection lottery is written to a predetermined region of RAM 33 and an informing flag is set at step 104 when the prize mode is informed as a prediction. The set informing flag is to represent also a kind of the informed prize mode.

Figure 13:
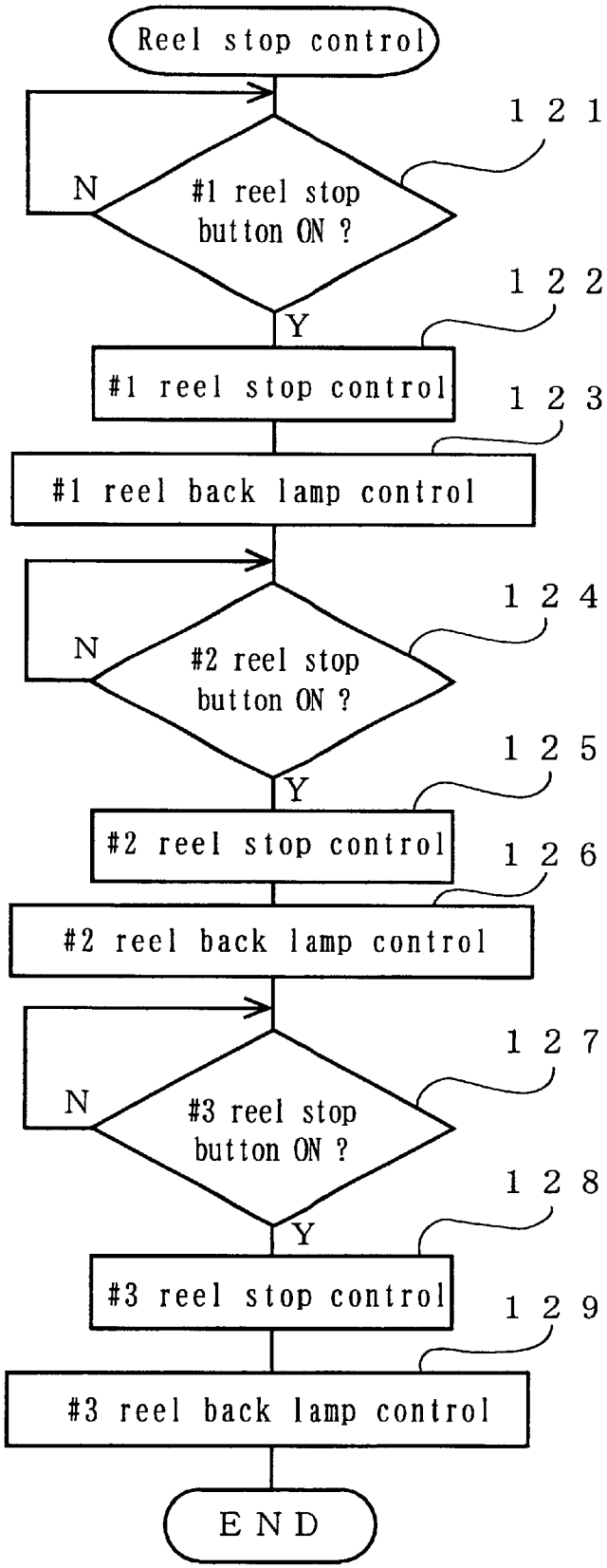
FIG. 13 is a flowchart showing content of processing of reel stop control shown by FIG. 11.

Next, a processing of rotating the first reel 3, the second reel 4, the third reel 5 is carried out (step 105) and the respective reels 3, 4 and 5 start to rotate simultaneously as shown by FIG. 14A, FIG. 14B and FIG. 14C. Successive to the reel rotating processing, a control of stopping the respective reels 3, 4 and 5 is carried out (step 106). An outline of the reel stop control processing is shown by a flowchart of FIG. 13.

Further, according to the reel stop control, for convenience, an explanation will be given of a case in which the first reel stop button 16, the second reel stop button 17 and the third reel stop button 18 are operated in this order as shown by FIG. 14D, FIG. 14E and FIG. 14F and as shown by FIG. 14A, FIG. 14B and FIG. 14C, the respective reels 3 through 5 are stopped in the order of the first reel 3, the second reel and the third reel 5. However, the order of stopping the respective reels 3 through 5 is not limited thereto but, for example, they may be stopped by a random stop order as in the first reel stop button 16, the third reel stop button 18 and the second reel stop button 17.

As mentioned above, the operation of the respective stop buttons 16 through 18 by the player is detected by CPU 31 via the reel stop signal circuit 45. When ON operation of the first reel stop button 16 is detected at step 121 of FIG. 13 and a request for stopping the variable display is outputted from the stopping means to the variably display device, the stop control processing of the first reel 3 is carried out (step 122). That is, at a time point at which the first reel stop button 16 is operated by the player, a number of drive pulses supplied to the stepping motor 55 of the first reel 3 is read from RAM 33 and is made to correspond to the rotational position of the first reel 3. When the rotational position of the first reel 3 is known, three symbols appeared in the observation window 6 are grasped as symbol codes by referring to the symbol table (refer to FIG. 8).

In this case, when a hit flag of a big hit is erected, whether there is a symbol constituting a big hit is present on the effective prize line of the observation window 6, is checked. Similarly, when a hit flag of a medium hit or a small hit is erected, whether there is a symbol constituting a medium hit or a small hit is present on the effective prize line of the observation window 6 is checked. When there is a symbol in correspondence with a hit flag is present on the effective prize line, CPU 31 immediately stops the first reel 3. Further, in consideration of the fact that the first reel 3 cannot be stopped instantaneously, the processing may be carried out several steps before the rotational position of the reel.

When a symbol in correspondence with a hit flag is not present on the effective prize line of the observation window 6 by the above-described check processing, what symbol appears when the first reel 3 is further rotated by four of symbols is checked. When there is a symbol in correspondence with a hit flag is present in the symbols, the first reel 3 is rotated to the position of the symbol and stops there. The draw control processing is carried out in respective stop control processings of the second reel 4 and the third reel 5, mentioned later.

Next, a processing of controlling the back lamps of the first reel is carried out (step 123). The control processing is carried out when the informing flag is set by informing selection lottery processing at step 104 mentioned above. When the informing flag is set, the back lamps 57*a*, 57*b* and 57*c* built in the first reel 3 are controlled to extinguish by a pattern in accordance with a kind of the informing flag. For example, when the informing flag corresponds to the "BB" hit flag, the back lamps 57*a*, 57*b* and 57*c* of the first reel 3 are extinguished at the timing shown by the timing chart of FIG. 14G.

Figure 15A:
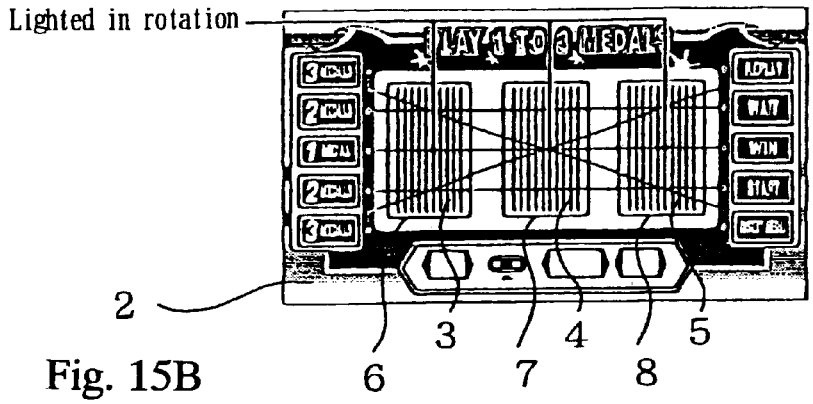
FIGS. 15A, 15B, 15C and 15D are views showing light extinguishing patterns of informing a first prize mode informed to the player in game process of the slot machine according to the first and the second respective embodiments.
Figure 15B:
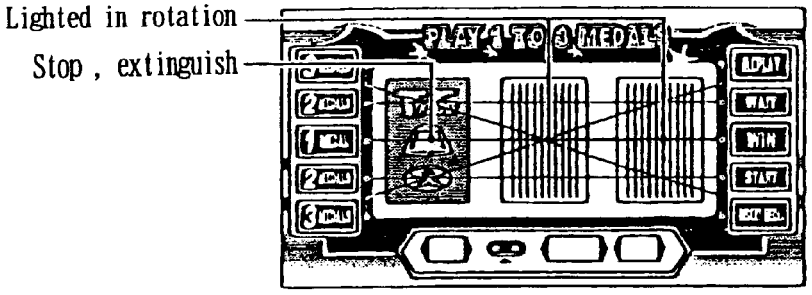

Although the back lamps 57*a*, 57*b* and 57*c* of the respective reels 3 through 5 are lighted in rotation as shown by FIG. 15A, by the processing at step 123, the lamps 57*a*, 57*b* and 57*c* of the first reel 3 are put off as shown by FIG. 15B. In this case, the second reel 4 and the third reel 5 are still rotating and the respective back lamps 57*a*, 57*b* and 57*c* of the respective reels 4 and 5 are lighted. Further, in FIGS. 15A, 15B, 15C and 15D, portions the same as those in FIG. 2 are attached with the same notations and an explanation thereof will be omitted.

Next, whether the stop button 17 of the second reel 4 is operated is detected (step 124) and when ON operation of the stop button 17 is detected, the stop control processing of the second reel 4 is carried out (step 125). In the stop control processing, in a state of rotating the second reel 4, firstly, assuming that symbols of 21 ways having code numbers of 0 through 20 are stopped on the prize line L1 at the center of the observation window 7, a combination with the symbol of the first reel 3 which has already been stopped on the effective prize line is read. Further, in respect of the third reel 5, a rotation code representing that the third reel 5 is rotating is read. Further, although the second reel 4 is also rotating, a rotation code thereof is not read since it is assumed that the second reel 4 is to be stopped by the above-described processing.

When a combination of symbol codes is read in this way, the above-described prize symbol combination table is referred, in respect of the symbol determined by stopping the first reel 3, what prize may be caused on the effective prize line when the second reel 4 is stopped at 21 ways of rotational positions is successively determined. For example, when the second reel 4 is stopped at a code number "5" as shown by FIG. 16B, the combination of symbols on the respective prize lines L1, L2A, L2B, L3A and L3B is as shown by FIG. 16C.

An arrow mark of the third reel 5 designates a rotation code indicating that the reel is rotating and depending on the position of stopping the third reel, there are possibilities of causing a big hit prize of "A—A—A" on the prize line L1 and a small hit prize of "E—E—E" on the prize line L2B. Accordingly, in respect of the code number "5" of the second reel 4, as shown by FIG. 17, a prediction flag of big hit and a prediction flag of small hit are set. Presence or absence of such a prediction flag is checked with respect to all of the code numbers of the second reel 4 and these data are written to RAM 33.

In this way, the prediction flag data written to RAM 33 is referred in controlling to stop the second reel 4. That is, when the stop button 17 of the second reel 4 is operated, prediction flags in correspondence with code numbers of the second reel 4 are referred and when a prediction of big hit is caused, control of stopping the second reel 4 is executed such that the symbol of big hit is stopped on the effective prize line.

When the above-described reel stop control processing at step 125 has been finished, successively, a processing of controlling the back lamps of the second reel is carried out (step 126). The control processing is also carried out when an informing flag is set at the informing section lottery processing at step 104 mentioned above. When the informing flag has been set, the back lamps 57*a*, 57*b* and 57*c* built in the second reel 4 are controlled to extinguish by a pattern in accordance with the kind of the informing flag.

Figure 15C:
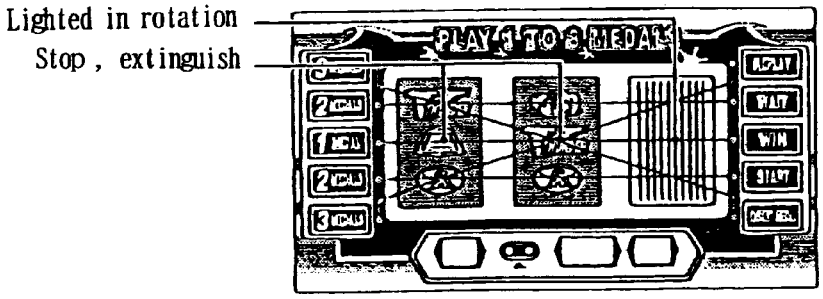

For example, when the informing flag corresponds to the "BB" hit flag, the back lamps 57*a*, 57*b* and 57*c* of the second reel 4 are extinguished at a timing indicated by the timing chart of FIG. 14H. Accordingly, successive to control of extinguishing the back lamps 57*a*, 57*b* and 57*c* of the first reel 3 by the processing at step 123 as shown by FIG. 15B, at this occasion, by the above-described processing at step 126, the back lamps 57*a*, 57*b* and 57*c* of the second reel 4 are controlled to extinguish as shown by FIG. 15C. In this case, the third reel 5 is rotating and the back lamps 57*a*, 57*b* and 57*c* of the reel 5 are lighted.

Next, whether the stop button 18 of the third reel 5 is made ON is detected (step 127) and when the stop button 18 is made ON, the processing of controlling to stop the third reel 5 is carried out (step 128). In the stop control processing, the first reel 3 and the second reel 4 have already been stopped and a combination of symbols is specified and accordingly, a possibility of prize is determined with regard to the combination of symbols for each of respective code numbers of the third reel 5 and a prize prediction flag is erected similar to the table shown by FIG. 17.

The prediction flag data is also referred when the stop button 18 of the third reel 5 is operated and when a big hit prediction is established, control of stopping the third reel 5 is executed such that a big hit symbol is stopped on the effective prize line. In controlling to stop the third reel 5, a position of stopping the reel is controlled such that not only a prize in accordance with the hit flag is obtained by a combination with the symbols of the first reel 3 and the second reel 4 but also a prize different from the hit flag is not obtained.

By the processing of controlling to stop the first reel at step 122, by the processing of controlling to stop the second reel at step 125 and the processing of controlling to the third reel at step 128, when the hit flag is "blank", the respective reels 3 through 5 are controlled to stop such that no prize combination of symbols is set on any of the effective prize lines.

Further, when the hit flag is "2 cherry", the respective reels 3 through 5 are controlled to stop such that a combination of symbols "cherry" is set on any of the effective prize lines. Further, when the hit flag is "4 cherry", the respective reels 3 through 5 are controlled to stop such that the combination of "cherry"'s is set respectively on any two of the effective prize lines. Further, when the hit flag is "bell" or "watermelon", the respective reels 3 through 5 are controlled to stop such that a combination of symbols "bell" or "watermelon" is set on any of the effective prize lines.

Further, when the hit flag is "RB" or "BB", the respective reels 3 through 5 are controlled to stop such that a set of symbols "7" or predetermined character symbols is set on any of the prize lines.

Next, when the processing of controlling to stop the reel has been finished, control processing of the back lamps of the third reel is carried out (step 129). The control processing is also executed when the informing flag is set in the informing selection lottery processing at step 104 mentioned above. When the informing flag is set, the back lamps 57*a*, 57*b* and 57*c* built in the third reel 5 are controlled to extinguish by a pattern in accordance with the kind of the informing flag.

Figure 15D:
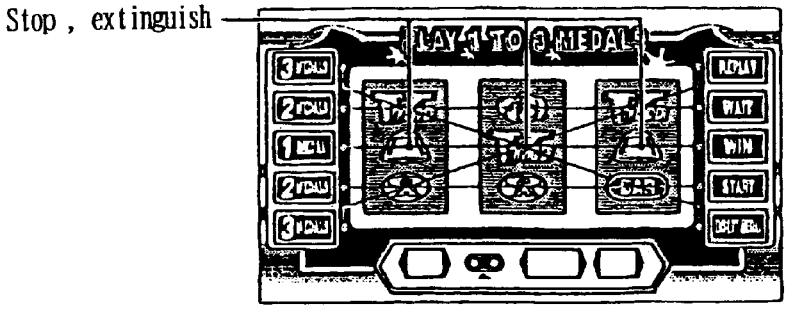

For example, when the informing flag corresponding to the "BB" hit flag, the back lamps 57*a*, 57*b* and 57*c* of the third reel 5 are extinguished at a timing indicated by the timing chart of FIG. 14I. Accordingly, successive to the control of extinguishing the respective back lamps 57*a*, 57*b* and 57*c* of the first reel 3 and the second reel 4 by the processings at steps 123 and 126 as shown by FIG. 15B and FIG. 15C, the back lamps 57*a*, 57*b* and 57*c* of the third reel 5 are controlled to extinguish as shown by FIG. 15D. As a result, the respective back lamps 57*a*, 57*b* and 57*c* of all the reels 3 through 5 are extinguished.

Further, according to the reel stop control processing mentioned above, the control of stopping the respective reels 3 through 5 (steps 122, 125 and 128) after operation of the respective stop buttons 16 through 18 has been detected and thereafter, control of the respective reel back lamps 57*a*, 57*b* and 57*c* (steps 123, 126 and 129) is carried out. However, the processing of controlling to stop the reels and the processing of controlling the back lamps of the reels may be carried out at any order so far as the operations are carried out after operating the stop buttons or after detecting signals for requesting automatic stop. That is, after the operation of the respective stop buttons 16 through 18 or detection of the automatic stop request signals, control of the respective reel back lamps 57*a*, 57*b* and 57*c* (steps 123, 126 and 129) may be carried out and thereafter, the stop control of the respective reels 3 through 5 (steps 122, 125 and 128) may be carried out.

When the reel stop control processing at step 106 in FIG. 11 has been finished, successively, whether the display in stopping all the reels constitutes a prize combination of symbols is determined in reference to the prize symbol combination table (FIG. 11, step 107). That is, the reel stop control is not carried out entirely by the machine but timings of operating the respective stop buttons 16 through 18 by the player matter and therefore, even in the case in which a prize hit flag is erected as a result of the inner lottery, unless the stop buttons 16 through 18 are operated at predetermined timings, a prize combination of symbols is not set on the effective prize line and no prize is awarded.

When the prize is not awarded, determination at step 107 becomes "NO" and the processing returns to the initial step 101. Further, in the case of replay game (game again) as a result of the determination of prize, the processing returns to the processing waiting for operating the start lever 15 at step 102 (step 108). In the case of a prize except that for a replay game, the hopper drive circuit 41 is controlled by CPU 31 and a predetermined number of coins are paid out to the coin tray 20 by the hopper 38 (step 110 in FIG. 12).

For example, in the case of a small hit prize of "2 cherry", two coins are paid out and in the case of a small hit prize of "4 cherry", four coins are paid out. Further, in the case of a small hit prize of "bell", six coins are paid out and in the case of a small hit prize of "watermelon", eight coins are paid out. Further, in the case of a big hit prize of "BB" or "RB", fifteen coins are respectively paid out.

Next, whether BB game is caused is determined (step 111) and when BB game is caused, BB game is carried out (step 112). Further, when BB game is not caused, successively, whether RB game is caused is determined (step 113) and when RB game is caused, RB game is carried out (step 114). Thereafter, the above-described processings are repeated and game of the slot machine is carried out.

According to the embodiment, in connection with respective operation of the respective stop buttons 16 through 18, the respective back lamps 57*a*, 57*b* and 57*c* for illuminating the respective rotating reels 3 through 5 are extinguished by a pattern which differs in accordance with the kind of the prize mode by which the prize mode is informed to the player.

According to the explanation of the above-described embodiment, by successively extinguishing the respective back lamps 57*a*, 57*b* and 57*c* of the respective rotating reels 3 through 5 in connection with operation of the respective stop buttons 16 through 18, a prediction in correspondence with the "BB" hit flag of a big hit prize is informed to the player. Other than the pattern of extinguishing light for informing the "BB" hit flag, the respective back lamps 57*a*, 57*b* and 57*c* are controlled to light as follows by various patterns in accordance with the kinds of the respective hit flags and the prize mode is informed to the player.

Figure 18A:
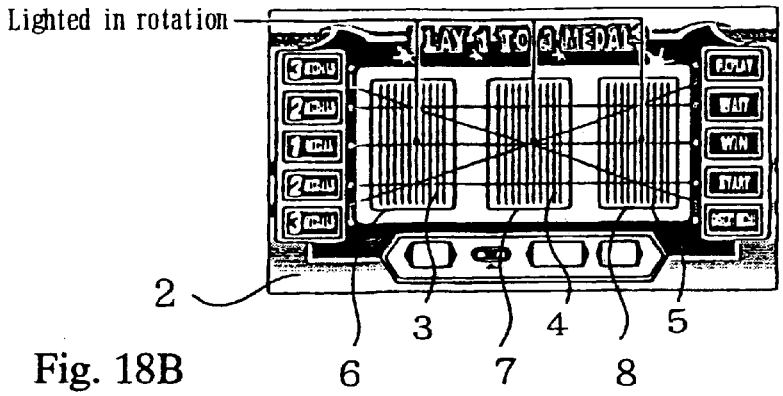
FIGS. 18A, 18B, 18C and 18D are views showing light extinguishing patterns of informing a second prize mode informed to the player in game process of the slot machine according to the first and the second respective embodiments.
Figure 18B:
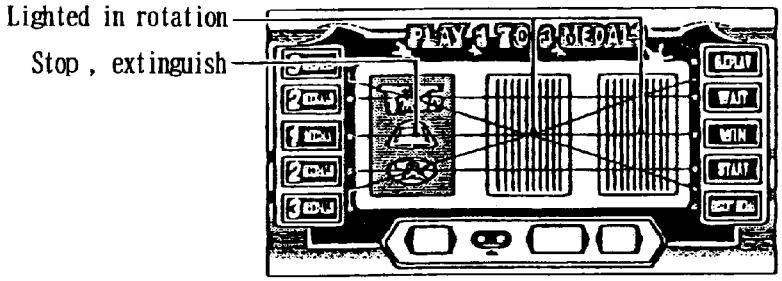
Figure 18C:
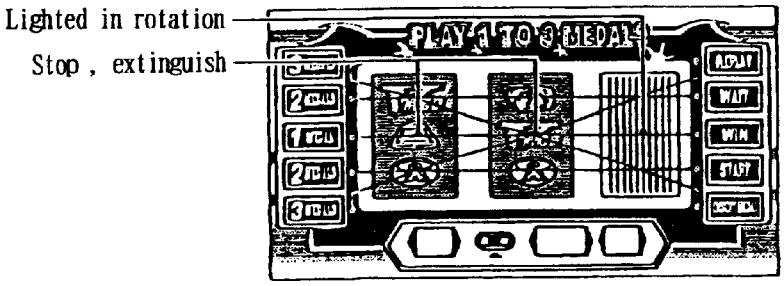
Figure 18D:
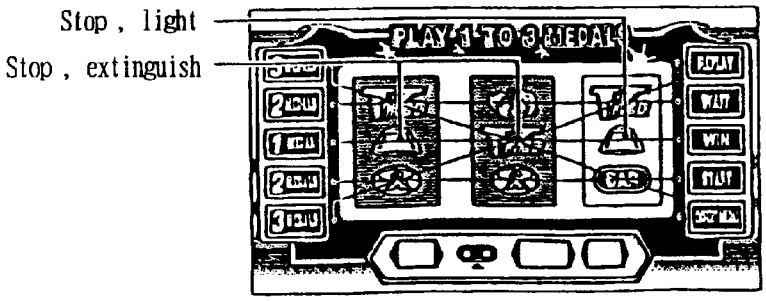

That is, when an informing flag in correspondence with the "RB" hit flag is erected in the informing selection lottery processing at step 104 (refer to FIG. 11), in the control processing of the back lamps of the first reel at step 123 (refer to FIG. 13), the back lamps 57*a*, 57*b* and 57*c* of the first reel 3 are extinguished as shown by FIG. 18B. Further, also in this case, the respective back lamps 57*a*, 57*b* and 57*c* are all lighted in rotating the respective reels 3 through 5 as shown by FIG. 18A. Thereafter, in the control processing of the back lamps of the second reel at step 126, the back lamps 57*a*, 57*b* and 57*c* of the second reel 4 are extinguished as shown by FIG. 18C. Further, in the control processing of the back lamps of the third reel at step 129, the back lamps 57*a*, 57*b* and 57*c* of the third reel are brought into a state where they remain lighted as shown by FIG. 18D.

In connection with the respective operation of the respective stop buttons 16 through 18, the player recognizes a light extinguishing pattern for extinguishing, extinguishing and lighting the respective back lamps 57*a*, 57*b* and 57*c* of the respective reels 3 through 5 in this order by which the player can be informed of the fact that there is a possibility in which the "RB" hit flag of a medium hit prize is erected by the inner lottery at inside of the machine. The "BB" hit flag causing a big hit prize and the "RB" hit flag causing a medium hit prize are carried over to successive game and therefore, at the successive game, the player can operate the respective stop buttons 16 through 18 to previously aim to stop the respective reels 3 through 5 to display a combination of symbols of the "BB" game prize or a combination of symbols of the "RB" game prize.

Figure 19A:
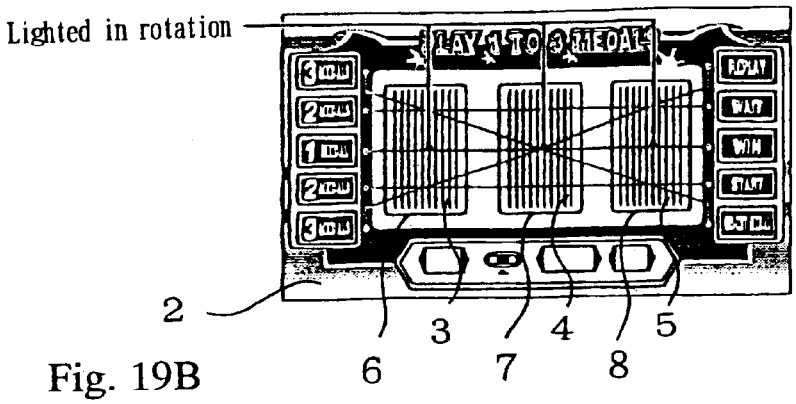
FIGS. 19A, 19B, 19C and 19D are views showing light extinguishing patterns of informing a third prize mode informed to the player in game process of the slot machine according to the first and the second respective embodiments.
Figure 19B:
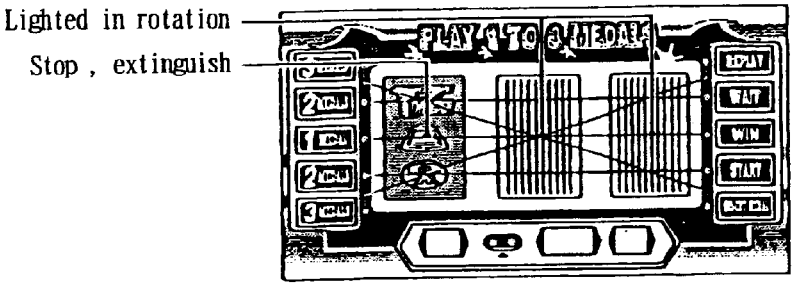
Figure 19C:
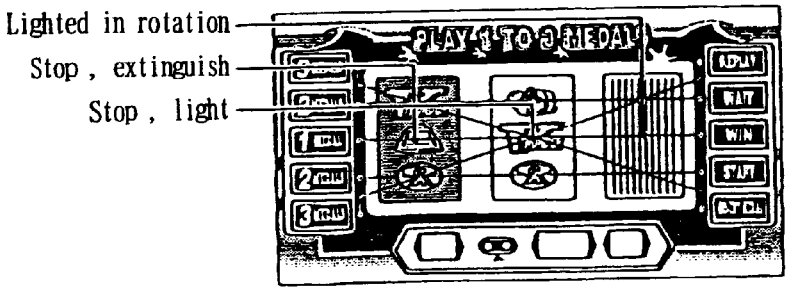
Figure 19D:
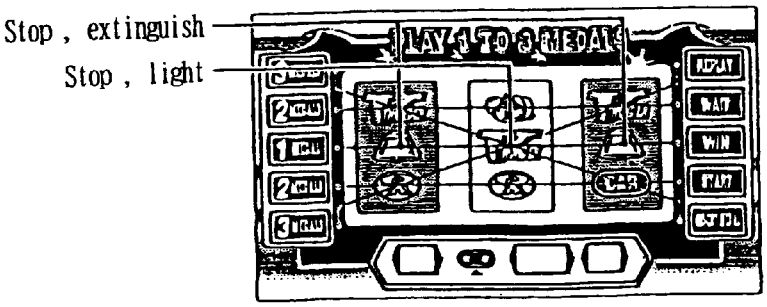

Further, when an informing flag in correspondence with the "watermelon" hit flag is erected by the informing selection lottery processing, in the control processing of the back lamps of the first reel, the back lamps 57*a*, 57*b* and 57*c* of the first reels 3 are extinguished as shown by FIG. 19B. Further, also in this case, the respective back lamps 57*a*, 57*b* and 57*c* are all lighted when the respective reels 3 through 5 are rotating as shown by FIG. 19A. Thereafter, in the control processing of the back lamps of the second reel, the back lamps 57*a*, 57*b* and 57*c* of the second reel 4 are brought into a state where they remain lighted as shown by FIG. 19C. In the control processing of the back lamps of the third reel, the back lamps 57*a*, 57*b* and 57*c* of the third reel are extinguished as shown by FIG. 19D.

In connection with the respective operation of the respective stop buttons 16 through 18, the player recognizes a light extinguishing pattern for extinguishing, lighting and extinguishing the respective back lamps 57*a*, 57*b* and 57*c* of the respective reels 3 through 5 in this order by which the player can be informed of the fact that there is a possibility in which the "watermelon" hit flag of a small hit prize is erected by the inner lottery. The hit flag of the small hit prize is not carried over to successive game and is a flag only for the current game, different from the hit flag of a big hit prize and the hit flag of a medium hit prize. Accordingly, it seems that it is meaningless to recognize that the "watermelon" hit flag is erected at a time point at which the game has been finished.

However, when the back lamps of the initial two reels are extinguished and lighted in this order in repeating the game, the player can grasp that there is a possibility of electing the "watermelon" hit flag and the player can operate to stop the reel aiming at a symbol of the "watermelon" in operating the stop button of the third reel. Further, by informing the hit flag to the player in accordance with a pattern of extinguishing the back lamps of the reels in this way, in operating the respective stop buttons 16 through 18, the interest of predicting the light extinguishing pattern is newly created and tastefulness of the game is promoted.

Figure 20A:
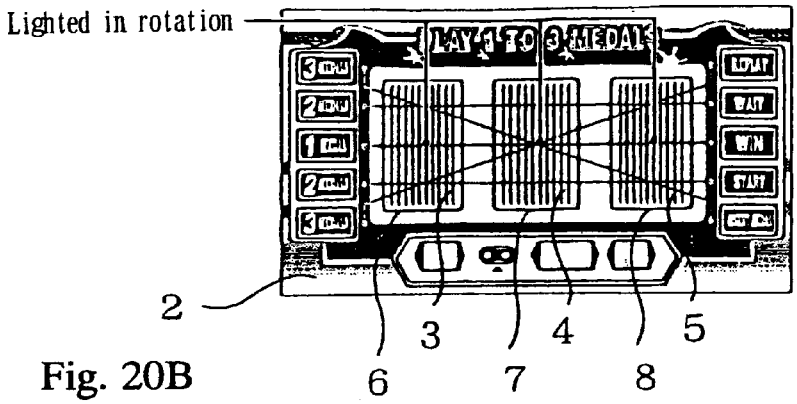
FIGS. 20A, 20B, 20C and 20D are views showing light extinguishing patterns of informing a fourth prize mode informed to the player in game process of the slot machine according to the first and the second respective embodiments.
Figure 20B:
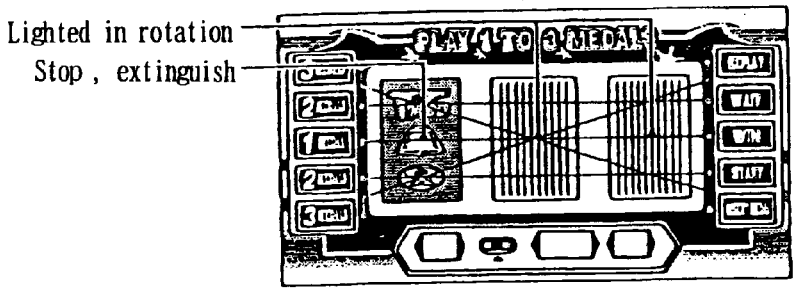
Figure 20C:
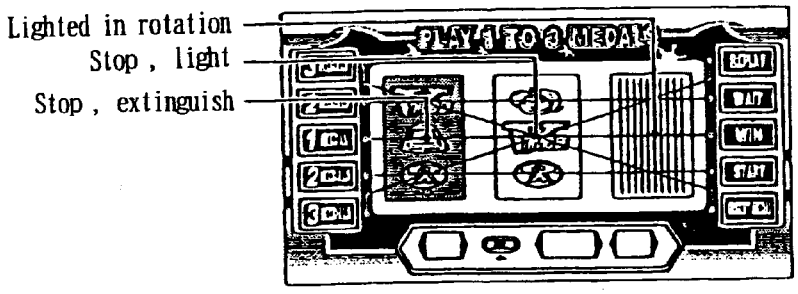
Figure 20D:
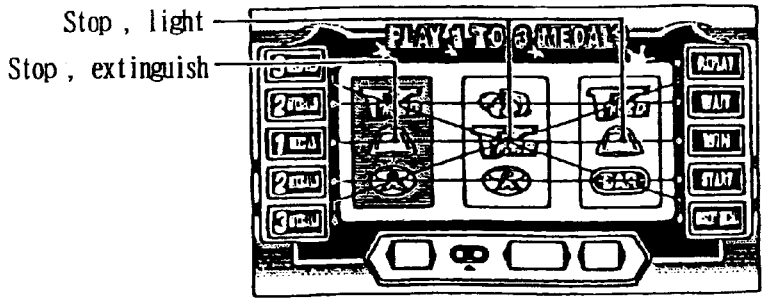

Further, when an informing flag in correspondence with the "bell" hit flag is erected by the informing selection lottery processing, in the control processing of the back lamps of the first reel, the back lamps 57*a*, 57*b* and 57*c* of the first reel 3 are extinguished as shown by FIG. 20B. Further, also in this case, the respective back lamps 57*a*, 57*b* and 57*c* are all lighted as shown by FIG. 20A when the respective reels 3 through are rotating. Thereafter, in the control processing of the back lamps of the second reel, the back lamps 57*a*, 57*b* and 57*c* of the second reel 4 are brought into a state where they remain lighted as shown by FIG. 20C. Further, also in the control processing of the back lamps of third reel, the back lamps 57*a*, 57*b* and 57*c* of the third reel are brought into a state where they remain lighted as shown by FIG. 20D.

In connection with the respective operation of the respective stop buttons 16 through 18, the player recognizes a light extinguishing pattern of extinguishing, lighting and lighting the respective back lamps 57*a*, 57*b* and 57*c* of the respective reels 3 through 5 in this order by which the player can be informed of the fact that there is a possibility in which the "bell" hit flag of a small hit prize is erected by the inner lottery.

Figure 21A:
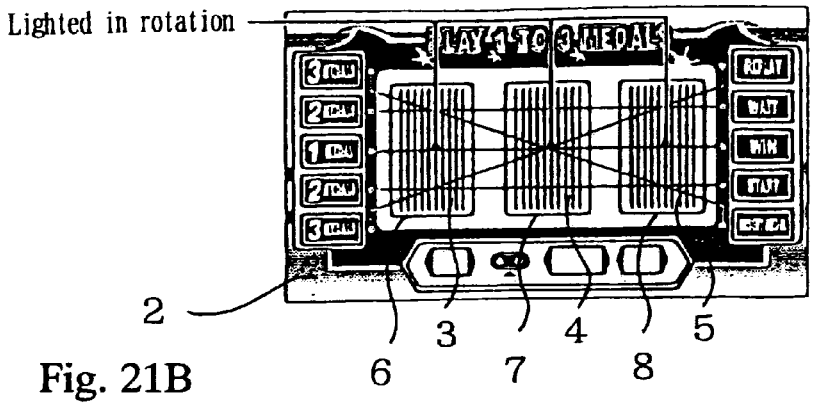
FIGS. 21A, 21B, 21C and 21D are views showing light extinguishing patterns of informing a fifth prize mode informed to the player in game process of the slot machine according to the first and the second respective embodiments.
Figure 21B:
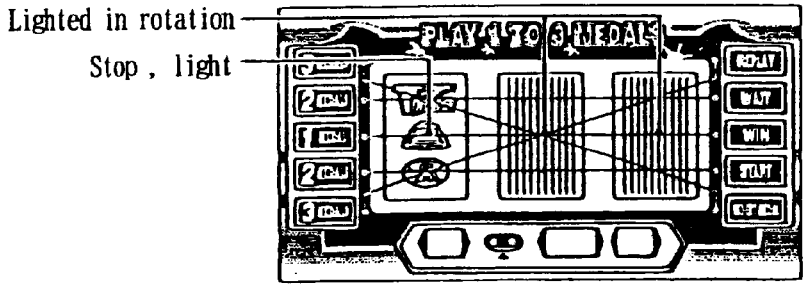
Figure 21C:
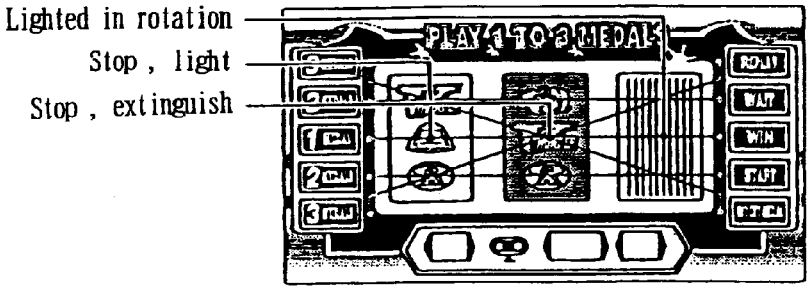
Figure 21D:
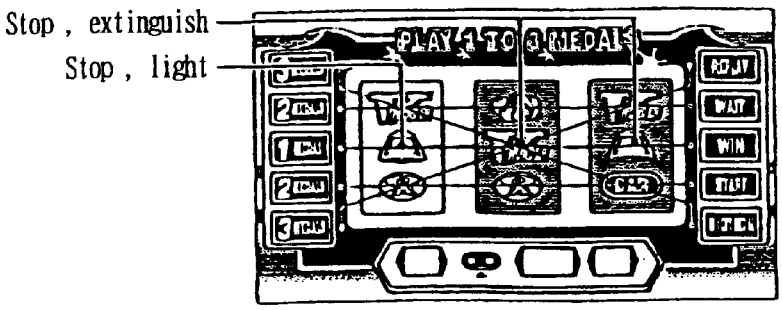

Further, when an informing flag in correspondence with the "4 cherry" hit flag is erected by the informing selection lottery processing, in the control processing of the back lamps of the first reel, the back lamps 57*a*, 57*b* and 57*c* of the first reel 3 are brought into a state where they remain lighted as shown by FIG. 21B. Further, also in this case, the respective back lamps 57*a*, 57*b* and 57*c* are all lighted as shown by FIG. 21A when the respective flags 3 through 5 are rotating. Thereafter, in the control processing of the back lamps of the second reel, the back lamps 57*a*, 57*b* and 57*c* of the second reel 4 are extinguished as shown by FIG. 21C. Further, also in the control processing of the back lamps of the third reel, the back lamps 57*a*, 57*b* and 57*c* of the third reel are extinguished as shown by FIG. 21D.

In connection with the respective operation of the respective stop buttons 16 through 18, the player recognizes a light extinguishing pattern of lighting, extinguishing and extinguishing the respective back lamps 57*a*, 57*b* and 57*c* of the respective reels 3 through 5 in this order by which the player can be informed of the fact that there is a possibility in which the "4 cherry" hit flag of a small hit prize is erected by the inner lottery.

Figure 22A:
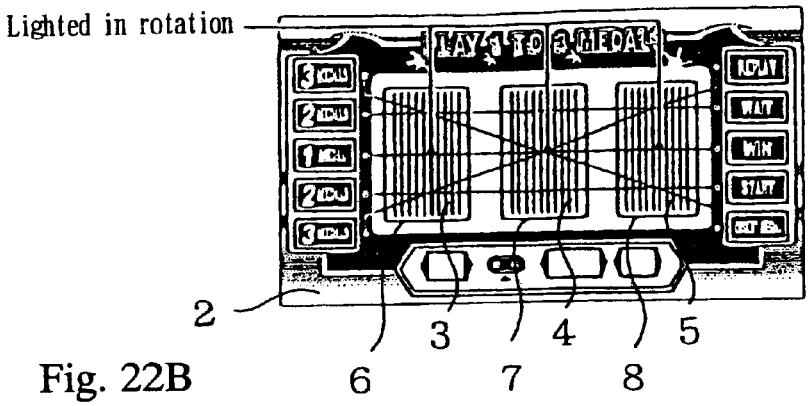
FIGS. 22A, 22B, 22C and 22D are views showing light extinguishing patterns of informing a sixth prize mode informed to the player in game process of the slot machine according to the first and the second respective embodiments.
Figure 22B:
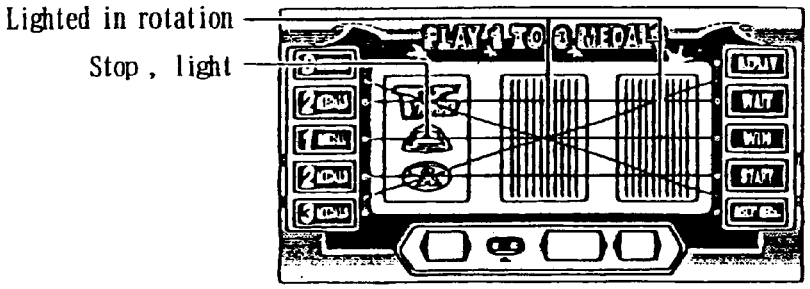
Figure 22C:
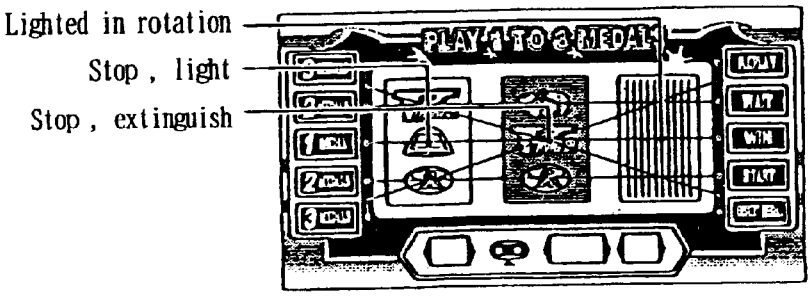
Figure 22D:
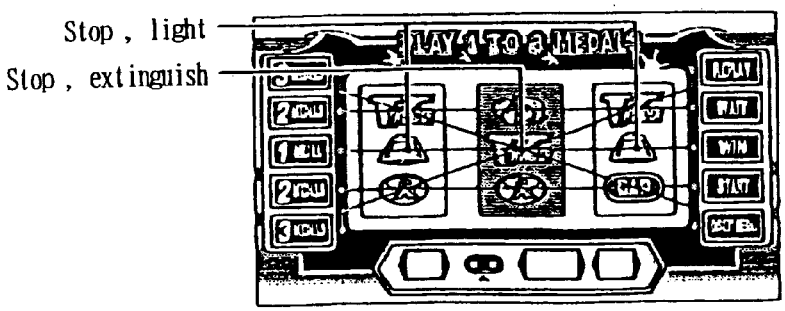

Further, when an informing flag in correspondence with the "2 cherry" hit flag is erected by the informing selection lottery processing, in the control processing of the back lamps of the first reel, the back lamps 57*a*, 57*b* and 57*c* of the first reel 3 are brought into a state where they remain lighted as shown by FIG. 22B. Further, also in this case, the respective back lamps 57*a*, 57*b* and 57*c* are all lighted when the respective reels 3 through 5 are rotating as shown by FIG. 22A. Thereafter, in the control processing of the back lamps of the second reels, the back lamps 57*a*, 57*b* and 57*c* of the second reel 4 are extinguished as shown by FIG. 22C. Further, in the control processing of the back lamps of the third reel, the back lamps 57*a*, 57*b* and 57*c* of the third reel are brought into a state here they remain lighted as shown by FIG. 22D.

In connection with the respective operation of the respective stop buttons 16 through 18, the player recognizes a light extinguishing pattern for lighting, extinguishing and lighting the respective back lamps 57*a*, 57*b* and 57*c* of the respective reels 3 through 5 in this order by which the player can be informed of the fact that there is a possibility in which the "2 cherry" flag of a small hit prize is erected by the inner lottery.

Figure 23A:
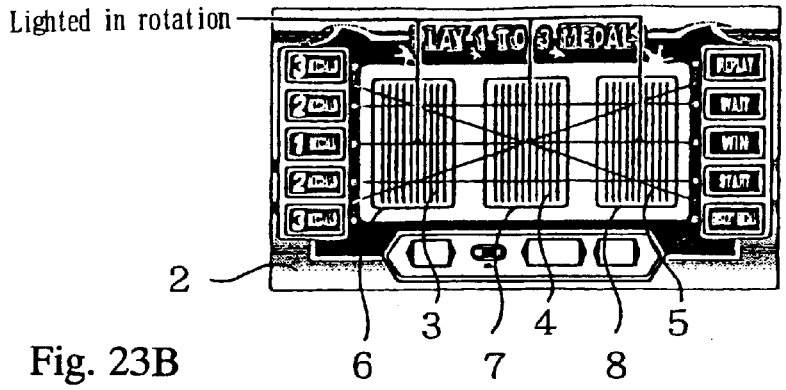
FIGS. 23A, 23B, 23C and 23D are views showing light extinguishing patterns of informing a seventh prize mode informed to the player in game process of the slot machine according to the first and the second respective embodiments.
Figure 23B:
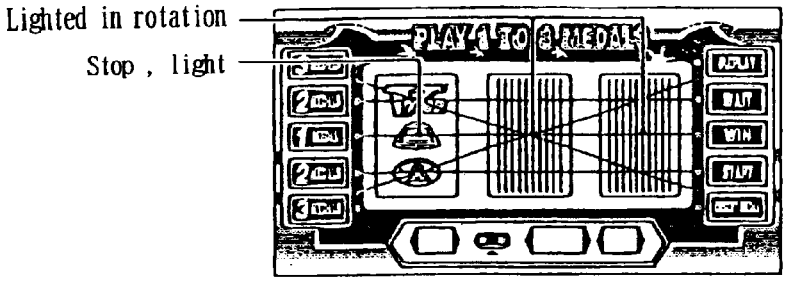
Figure 23C:
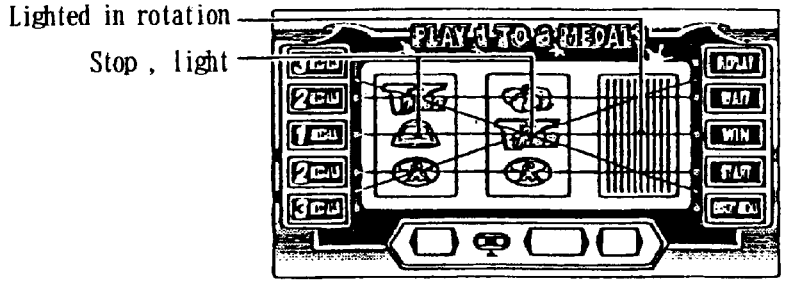
Figure 23D:
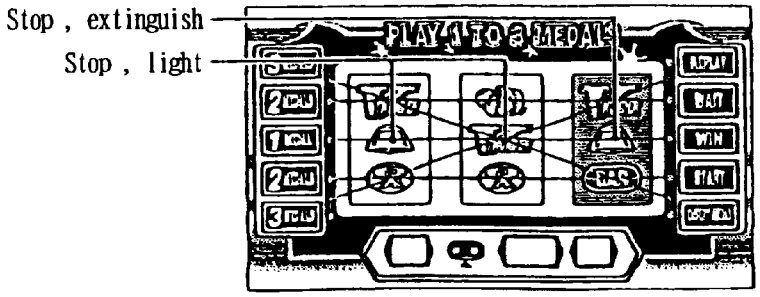

Further, when an informing flag in correspondence with the "replay" hit flag is erected by the informing selection lottery processing, in the control processing of the back lamps of the first reel, the back lamps 57*a*, 57*b* and 57*c* of the first reel 3 are brought into a state in which they remain lighted as shown by FIG. 23B. Further, also in this case, the respective back lamps 57*a*, 57*b* and 57*c* are all lighted when the respective reels 3 through 5 are rotating as shown by FIG. 23A. Thereafter, also in the control processing of the back lamps of the second reel, the back lamps 57*a*, 57*b* and 57*c* of the second reel 4 are brought into a state in which they remain lighted as shown by FIG. 23C. Further, in the control processing of the back lamps of the third reel, the back lamps 57*a*, 57*b* and 57*c* of the third reel are extinguished as shown by FIG. 23D.

In connection with the respective operation of the respective stop buttons 16 through 18, the player recognizes a light extinguishing pattern of lighting, lighting and extinguishing the respective back lamps 57*a*, 57*b* and 57*c* of the respective reels 3 through 5 in this order by which the player can be informed of the fact that there is a possibility in which the "replay" hit flag is erected by the inner lottery.

Figure 24A:
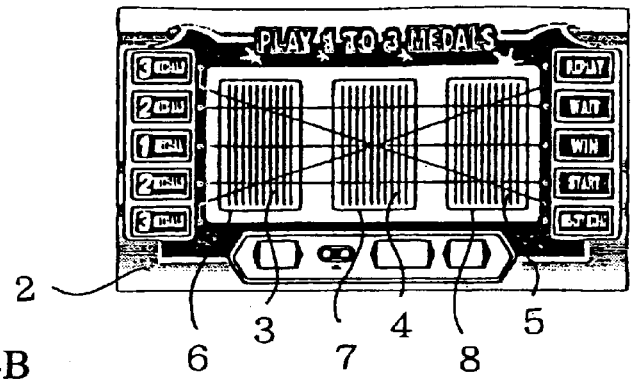
FIGS. 24A, 24B, 24C and 24D are views showing light extinguishing patterns of informing an eighth prize mode informed to the player in game process of the slot machine according to the first and the second respective embodiments.
Figure 24B:
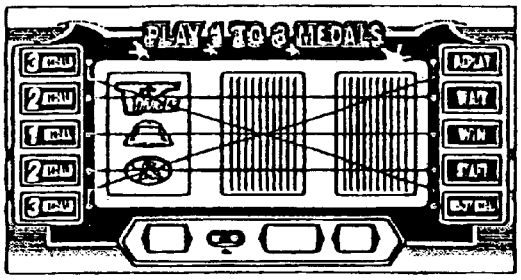
Figure 24C:
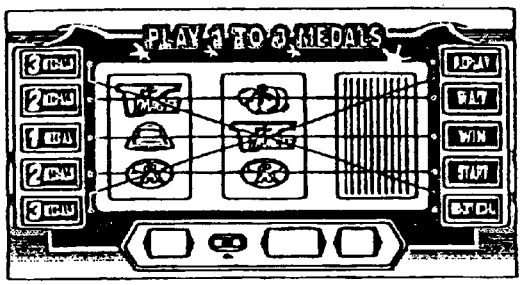
Figure 24D:
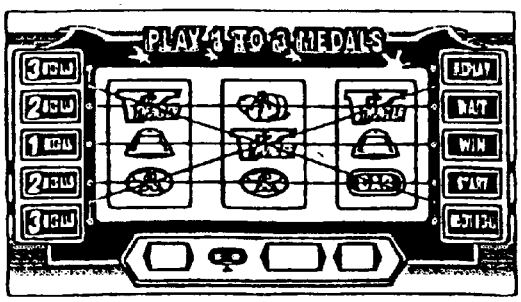

Further, when an informing flag in correspondence with the "blank" hit flag is erected by the informing selection lottery processing, in the control processing of the back lamps of the first reel, the back lamps 57*a*, 57*b* and 57*c* of the first reel 3 are brought into a state in which they remain lighted as shown by FIG. 24B. Further, also in this case, the respective back lamps 57*a*, 57*b* and 57*c* are all lighted when the respective reels 3 through 5 are rotating as shown by FIG. 24A. Thereafter, also in the control processing of the back lamps of the second reel, the back lamps 57*a*, 57*b* and 57*c* of the second reel 4 are brought into a state in which they remain lighted as shown by FIG. 24C. Further, also in the control processing of the back lamps of the third reel, the back lamps 57*a*, 57*b* and 57*c* of the third reel are brought into a state in which they remain lighted as shown by FIG. 24D.

The player recognizes a light extinguishing pattern of successively lighting the respective back lamps 57*a*, 57*b* and 57*c* of the respective reels 3 through 5 where the lamps are not extinguished by which the player can be informed of the fact that the "blank" hit flag is erected by the inner lottery.

In this way, according to the embodiment, the prize mode becomes clear in accordance with operation of the respective stop buttons 16 through 18. That is, according to the operation of the respective stop buttons 16 through 18, not only rotational displays of the respective reels 3 through 5 are successively stopped at the respective columns but also the prize mode determined by the inner lottery is successively informed to the player. As a result, the interest of operating the stop buttons is enhanced.

Further, the informing operation of the prize mode is not carried out in respect of all of the result of the inner lottery but is carried out at a predetermined probability as shown by the informing selection lottery probability table (refer to FIG. 9). Therefore, the prize mode may be informed to the player or may not be informed thereto. Therefore, the informing operation of the prize mode is expected by the player and when the informing operation is performed, the pleasure is enhanced and the interest of operating the stop buttons is further enhanced.

Further, the informing operation is carried out not only for the big hit prize mode but also for the respective prize modes and the player can be informed of the result of the inner lottery other than the big hit prize. Therefore, the operation of the stop buttons can easily be performed.

Further, although according to the above-described embodiment, an explanation has been given of the case in which the present invention is applied to a slot machine, the present invention is not limited thereto but the present invention is applicable to, for example, a pinball game machine such as a pachinko machine or other amusement machines having variable display devices. Among the game machines, there is one having no buttons for operating to stop the variable display and the respective variable display portions are automatically stopped successively at respective columns of the variable display. Also in this case, when the above-described prize mode informing means is operated at timings where the respective columns of the variable display are automatically stopped, an effect similar to that in the above-described embodiment is achieved.

Further, although according to the above-described embodiment, an explanation has been given of the lighting control for simultaneously lighting or extinguishing three of the respective back lamps 57*a*, 57*b* and 57*c* for each of the reels 3 through 5, lighting control for lighting or extinguishing the respective back lamps 57*a*, 57*b* and 57*c* individually may be constituted or lighting control for winking light individually may be constituted.

Figure 25A:
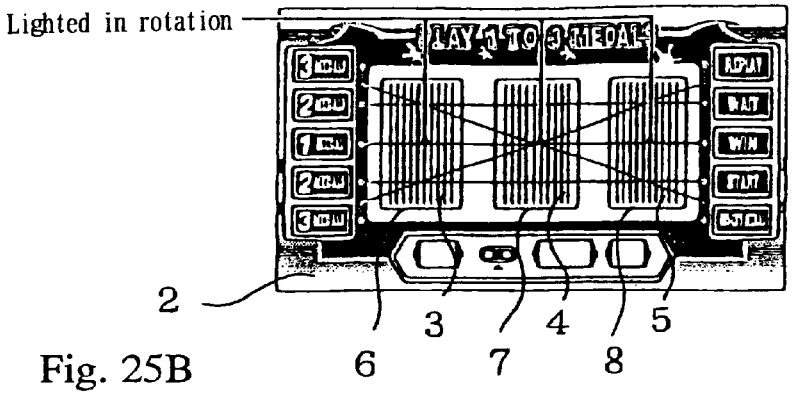
FIGS. 25A, 25B, 25C and 25D are views showing a modified example of light extinguishing patterns of informing the third prize mode shown by FIGS. 19A, 19B, 19C and 19D.
Figure 25B:
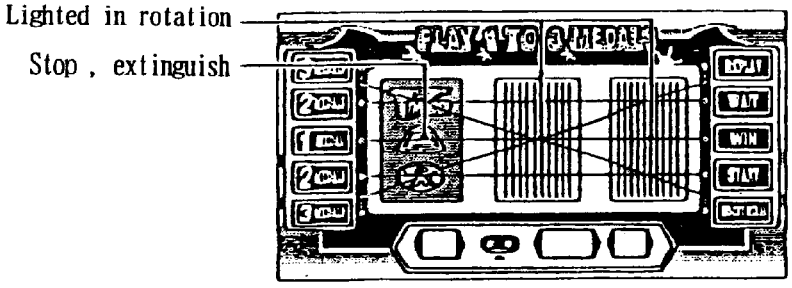
Figure 25C:
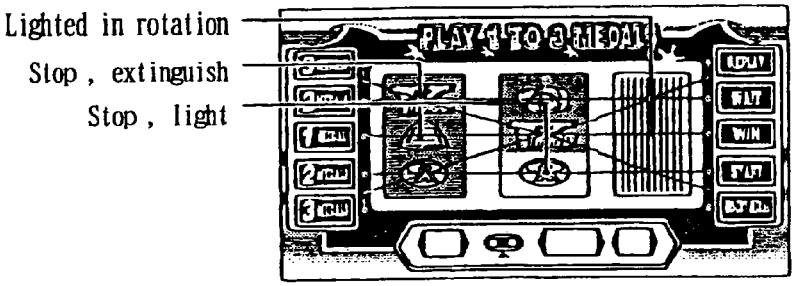
Figure 25D:
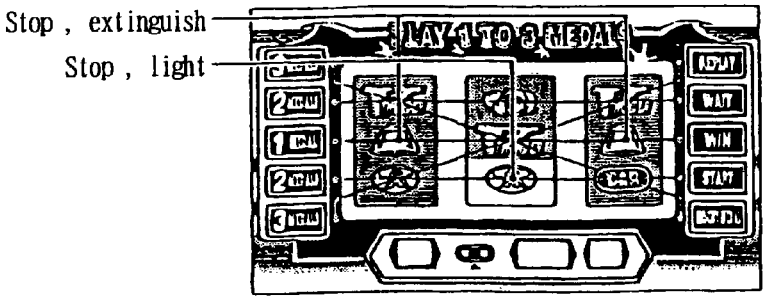

For example, in the above-described embodiment, operation of informing a prize mode in correspondence with the "watermelon" hit flag is carried out as shown by FIGS. 25A, 25B and 25C and 25D. That is, when the respective reels 3 through 5 are rotating, the respective back lamps 57*a*, 57*b* and 57*c* are all lighted as shown by FIG. 25A, when the first reel stop button 16 is operated, as shown by FIG. 25B, the respective back lamps 57*a*, 57*b* and 57*c* of the first reel 3 are controlled to extinguish. Further, when the second reel stop button 17 is operated, as shown by FIG. 25C, only the back lamps 57*a* and 57*b* are controlled to extinguish and the back lamp 57*c* on the lowermost side is brought into a lighted state. Thereafter, when the third reel stop button 18 is operated, as shown by FIG. 25D, the respective back lamps 57*a*, 57*b* and 57*c* are controlled to extinguish.

Figure 26A:
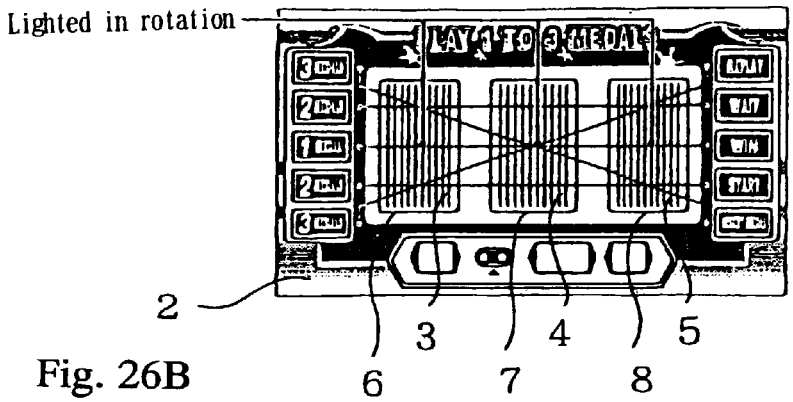
FIGS. 26A, 26B, 26C and 26D are views showing a modified example of light extinguishing patterns of informing the fourth prize mode shown by FIGS. 20A, 20B, 20C and 20D.
Figure 26B:
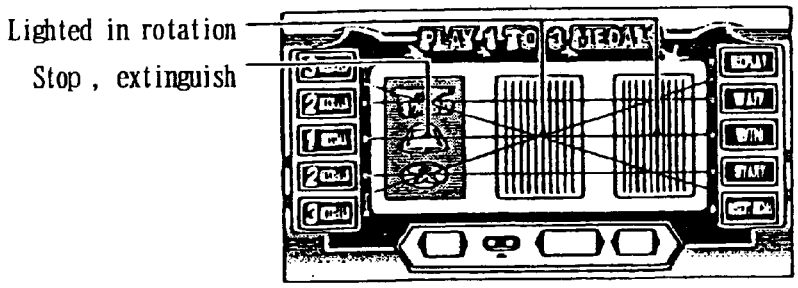
Figure 26C:
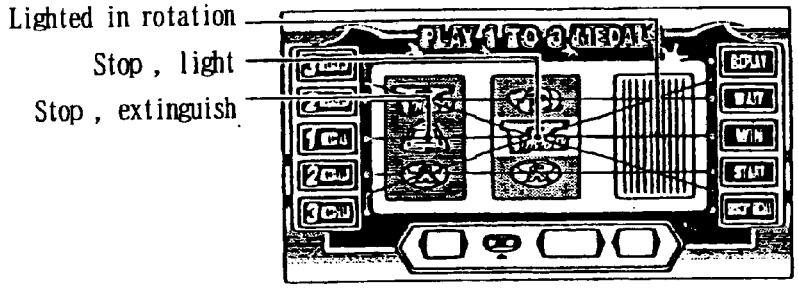
Figure 26D:
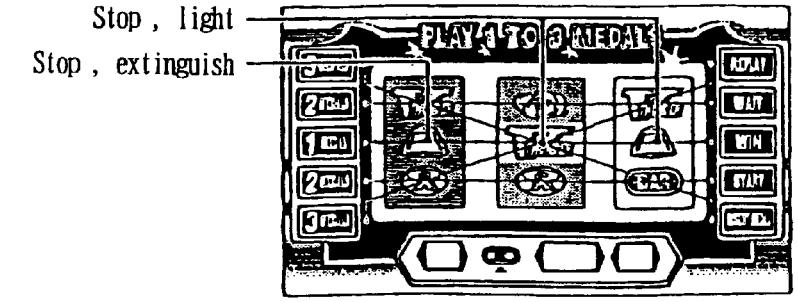

Further, operation of informing a prize mode in correspondence with the "bell" hit flag is carried out as shown by FIGS. 26A, 26B, 26C and 26D. That is, when the respective reels 3 through 5 are rotating, as shown by FIG. 26A, the respective back lamps 57*a*, 57*b* and 57*c* are all lighted, when the first reel stop button 16 is operated, as shown by FIG. 26B, the respective back lamps 57A, 57B and 57C of the first reel 3 are controlled to extinguish. Further, when the second reel stop button 17 is operated, as shown by FIG. 26C, only the back lamps 57*a* and 57*c* are controlled to extinguish and the back lamp 57*b* at the center is brought into a lighted state. Thereafter, when the third reel stop button 18 is operated, as shown by FIG. 26D, the respective back lamps 57*a*, 57*b* and 57*c* are brought into a lighted state.

According to the above-described embodiment, in informing the prize mode in correspondence with the "watermelon" hit flag, as shown by FIGS. 19A, 19B, 19C and 19D, the lighting control is carried out by the pattern of extinguishing, lighting and extinguishing simultaneously three of the back lamps 57*a*, 57*b* and 57*c* of the respective reels 3, 4 and 5 and in informing the prize mode in correspondence with the "bell" hit flag, as shown by FIGS. 20A, 20B, 20C and 20D, the lighting control is carried out by the pattern for extinguishing, lighting and lighting simultaneously three of the back lamps 57*a*, 57*b* and 57*c* of the respective reels 3, 4 and 5. Therefore, according to the above-described embodiment, at a time point at which the second reel 4 is stopped, the lighting control is carried out by the same pattern of extinguishing and lighting the respective back lamps 57*a*, 57*b* and 57*c*. Therefore, according to the above-described embodiment, at a time point at which the second reel 4 is operated, whether the kind of the informed hit flag is "watermelon" or "bell" is not known.

However, by individually controlling to light, the respective back lamps 57*a*, 57*b* and 57*c* in operating the second reel 4 as shown by FIG. 25C and FIG. 26C, whether the kind of the hit flag is "watermelon" or "bell" can be identified when the second reel is operated. Therefore, in operating the third reel 5, symbols for stopping to display can be determined by aiming at any one of the symbols. In this way, by individually controlling to light a total of 9 of the respective back lamps 57*a*, 57*b* and 57*c* of the three reels, a variety of prediction informing patterns can be constituted.

Further, although an explanation has been given of the hit flags for informing prediction by individually lighting the lamps in respect of "watermelon" and "bell", the prediction can be informed similarly also in respect of other hit flag of a small prize, hit flags of a big hit prize and a medium hit prize, a hit flag of "replay" and so on.

Further, portions of lighting the back lamps 57*a*, 57*b* and 57*c* need not to previously fix in accordance with the kind of the informed hit flag. For example, back lamps at portions where prize symbols in accordance with a hit flag for informing a prediction may be controlled to light. For example, when a hit flag for informing a prediction is "watermelon" and the symbol of "watermelon" is stopped at an upper stage of the reel, the back lamp 57*a* on the rear side of the symbol "watermelon" is controlled to light. Further, when the symbol "watermelon" is stopped to slip to a lower stage of the reel, the back lamp 57*c* on the rear side of the symbol "watermelon" is controlled to light.

Further, only when a prize symbol in accordance with a hit flag for informing a prediction is stopped on the effective prize line, the symbol may be individually lighted by any of the back lamps 57*a*, 57*b* and 57*c*. For example, when the game is carried out by one sheet bet, only when a prize symbol in correspondence with a hit flag for informing a prediction is stopped on the center prize line L1, the back lamp 57*b* is individually lighted.

Specifically, assume a case in which the current game is one sheet bet and the prize line L1 is made effective and a random number value sampled in accordance with operating the start lever 15 is 100. In this case, first, the prize mode informing selection lottery probability table (refer to FIG. 9) is referred and establishment of the BB hit flag is determined. Next, operation of the stop buttons 16 through 18 is carried out by the player and there are a case in which a prize symbol in correspondence with the BB hit flag can be drawn to the effective prize line L1 and a case in which it cannot be drawn depending on the stop operation by the player.

First, an explanation will be given of the case in which a prize symbol in correspondence with the BB hit flag is drawn to the effective prize line L1. For example, when a symbol of the BB prize of the left reel 3 is drawn and stopped on the effective prize line L1 by first stopping operation, the center back lamp 57*b* of the left reel 3 is lighted. Successively, when the symbol of the BB prize of the center reel 4 is drawn and stopped on the effective prize line L1 by second stopping operation, the center back lamp 57*b* of the center reel 4 is lighted. At this occasion, the player recognizes that the symbols of the BB prize are stopped on the effective prize line L1 and the respective back lamps 57*b* are lighted by which the BB hit is anticipated and expectancy is promoted.

Next, an explanation will be given of the case in which the prize symbol in accordance with the BB hit flag cannot be drawn to the effective prize line L1. For example, even when the left reel 3 is stopped by the first stopping operation, the BB prize symbol is not drawn on the effective prize line L1 and therefore, even when the BB hit flag is established, the back lamp 57*b* of the left reel 3 is not lighted. Successively, even when the center reel 4 is stopped by the second stopping operation, the BB prize symbol is not drawn on the effective prize line L1 and therefore, the back lamp 57*b* of the center reel is not similarly lighted.

In the case in which even when the BB hit flag is determined as an informing mode by the informing selection lottery probability table in this way, the informed prize symbol is not stopped on the effective prize line, a constitution in which the hit flag is not informed can also be constructed.

The actual control in the case of adopting such a constitution is carried out, for example, in the following way. First, a number of drive pulses for supplying to the stepping motor 55 in operating the stop button is read from RAM 33 and the rotational position of the reel is determined. Further, by comparing the symbol table (refer to FIG. 8) with the rotational position of the reel, what symbols are stopped on the respective prize lines is determined. Next, which prize lines are the effective prize lines of the current game is determined and successively, for which prize mode the hit flag is established is grasped. Thereafter, whether the prize mode is informed is determined as mentioned above.

By such lighting control, when a player notices that only specific symbols are lighted by successively operating the respective stop buttons 16 through 18, the player can recognize that there is a possibility in which a prize hit flag is erected by a combination of the symbols. Accordingly, an effect similar to that in the above-described embodiment can be achieved also by the lighting control.

Further, although according to the above-described embodiment, an explanation has been given of the case in which the back lamps 57*a*, 57*b* and 57*c* are used as informing means, the informing means according to the present invention is not limited thereto. For example, there may be constructed a constitution in which the informing means is constituted by the speaker 39 in place of the back lamps 57*a*, 57*b* and 57*c* and the result of the inner lottery is informed by sound emitted from the speaker 39. In this case, sound is referred to buzzer sound, synthesized sound or music which can be identified by auditory sense.

For example, a pattern of sound emitted from the speaker 39 is changed in correspondence with an extinguishing or a lighting pattern of the back lamp 57. The player can discriminate the kind of a hit flag which is displayed by a prediction such as the "watermelon" hit flag or the "bell" hit flag in accordance with the kind of pattern of the sound. As an example, single sound of "beep" is emitted in accordance with lighting the back lamps 57*a*, 57*b* and 57*c* and consecutive sound of "beep, beep, beep" is emitted in accordance with extinguishing thereof. In this case, the informing operation may be carried out by only the sound emitted from the speaker 39 or may be carried out by a combination of light emission of the back lamps 57*a*, 57*b* and 57*c* and the sound emitted from the speaker 39.

Further, according to the above-described embodiment, the "watermelon" hit flag is informed by the pattern of extinguishing, lighting and extinguishing the respective back lamps 57*a*, 57*b* and 57*c* of the respective reels 3 through 5 in this order as shown by FIGS. 19A, 19B, 19C and 19D and the "bell" hit flag is informed by the pattern of extinguishing, lighting and lighting thereof as shown by FIGS. 20A, 20B, 20C and 20D. Therefore, at a time point at which the second reel 4 is stopped, the respective back lamps are controlled to light or extinguish by the same "extinguishing and lighting" pattern and therefore, at the time point, whether the hit flag is "watermelon" or "bell" cannot be identified. However, at the timing of stopping the second reel 4, in the case of prediction of the "watermelon" hit flag, synthesized sound of "watermelon!" is emitted from the speaker 39 and synthesized sound of "bell!" is emitted from the speaker 39 in the case of prediction of "bell" hit flag. According to such a constitution in which information by the speaker 39 is auxiliarily added to information by the back lamps 57*a*, 57*b* and 57*c*, the kind of the hit flag can be known when the second reel is stopped.

Further, when the speaker 39 constitutes single informing means, the prediction of "watermelon" may be informed by respectively emitting synthesized sound of "wa" in operating to stop the first reel, synthesized sound of "ter" in operating to stop the second reel and synthesized sound of "melon" in operating to stop the third reel.

Further, the liquid crystal display unit 24 may constitute informing means. When the liquid crystal display unit 24 constitutes informing means, the prize mode is informed to the player by displaying, for example, symbols in correspondence with a hit flag for informing a prediction by the liquid crystal display unit 24. Or, the kind of a hit flag may be informed by making a character enter the liquid crystal display unit 24 and in accordance with motion of the character or a difference in development of a developed story.

Further, the stop buttons 16 through 18 may constitute informing means. In this case, solenoids or the like for impacting button portions are installed on the rear side of operating portions of the respective stop buttons 16 through 18 and a prediction is informed by tactile sense by applying vibration which differs in accordance with the kind of an established hit flag on the finger of the player.

Further, according to the above-described embodiment, in connection with the respective operation of the stop buttons 16 through 18, the respective back lamps 57*a*, 57*b* and 57*c* of the respective reels 3 through 5 are controlled to light or wink by which a prize mode is informed. However, the prize mode may be informed when any one of the stop buttons 16 through 18, for example, a randomly selected or fixed one of the stop buttons 16 through 18 is operated. For example, the respective back lamps 57*a*, 57*b* and 57*c* of the first stop reel 3 may be displayed to wink by a specific mode when the first stop button 16 is operated and sound in accordance with the prize mode may be emitted from the speaker 39 along therewith. Further, similar thereto, the prize mode may be informed in connection with operating any two randomly selected or fixed stop buttons.

An effect similar to the above-described embodiment can be achieved also by the respective informing means.

Next, an explanation will be given of a second embodiment in which a game machine according to the present invention is applied to a slot machine.

Figure 27:
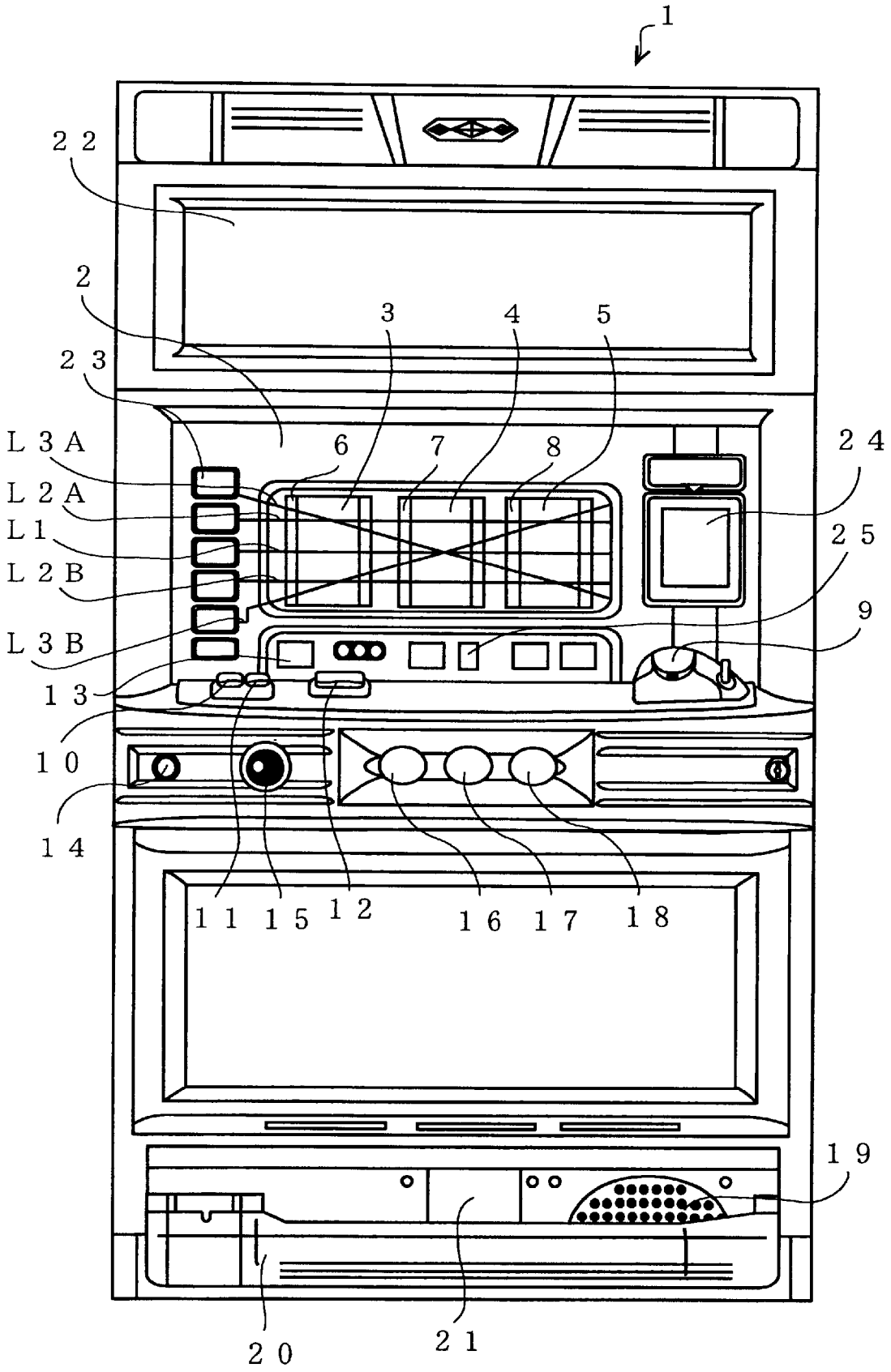
FIG. 27 is a front view showing an outlook of the slot machine according to the second embodiment of the present invention.

FIG. 27 is a front view of the slot machine 1 according to the second embodiment. Further, in the drawing, portions the same as or corresponding to those in FIG. 2 are attached with the same notations and an explanation thereof will be omitted.

The slot machine according to the second embodiment is installed with a notifying lamp 25 on the front panel 2 right under the respective reels 3, 4 and 5. The notifying lamp 25 is lighted when an inner hit flag of BB or RB game is erected and a predetermined condition, mentioned later, is established and notifies the player that the bonus game is hit by the lottery at inside of the machine.

Figure 28:
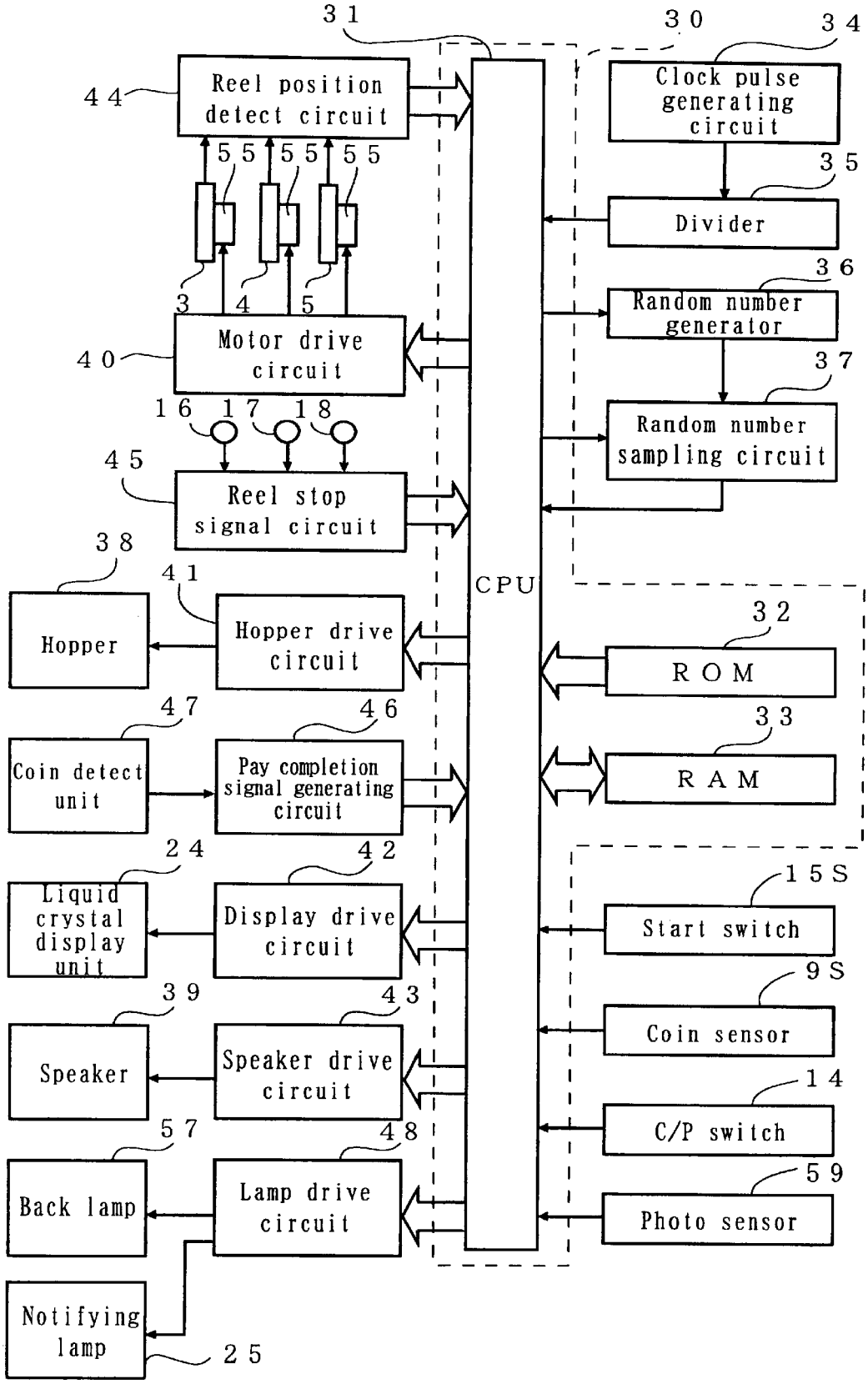
FIG. 28 is a block diagram showing a constitution of principal control circuits of the slot machine shown by FIG. 26.

FIG. 28 shows a circuit constitution including a control unit for controlling operation of processing the game in the slot machine 1 according to the second embodiment and peripheral devices (actuators) electrically connected thereto. Further, portions the same as or corresponding to those in FIG. 6 in the drawing are attached with the same notations and an explanation thereof will be omitted. In the slot machine according to the second embodiment, the notifying lamp 25 is connected to the lamp drive circuit 48 and the notifying lamp 25 is driven by the lamp drive circuit 48.

Also in the embodiment, the lamp drive circuit 48, the back lamps 57*a*, 57*b* and 57*c* and the micon 30 constitute informing means for informing the player of a prize mode by successively producing display of the respective reels 3 through 5 at a predetermined probability in connection with stopping the rotational display of the respective reels 3 through 5 by operating the respective stop buttons 16 through 18. There are 8 kinds in display modes produced by the informing means.

FIG. 15 as well as FIG. 18 through FIG. 24 explained above show display modes the same as 8 kinds of the display modes produced by the informing means. The display mode shown by FIGS. 24A, 24B, 24C and 24D is the display mode of "reel lamp extinguishing pattern 1", the display mode shown by FIGS. 23A, 23B, 23C and 23D is that of "reel lamp extinguishing pattern 2", the display pattern shown by FIGS. 22A, 22B, 22C and 22D is that of "reel lamp extinguishing pattern 3", the display mode shown by FIGS. 21A, 21B, 21C and 21D is that of "reel lamp extinguishing pattern 4", the display pattern shown by FIGS. 20A, 20B, 20C and 20D is that of "reel lamp extinguishing pattern 5", the display pattern shown by FIGS. 19A, 19B, 19C and 19D is that of "reel lamp extinguishing pattern 6", the display pattern shown by FIGS. 18A, 18B, 18C and 18D is that of "reel lamp extinguishing pattern 7" and the display pattern shown by FIGS. 15A, 15B, 15C and 15D is that of "reel lamp extinguishing pattern 8".

Further, the speaker 39, the speaker drive circuit 43 and the micon 30 constitute sound emitting means for emitting effective sound having a previously determined kind or length and the sound emitting means also constitutes the above-described informing means according to the embodiment. The sound emitting means emits reel stop sound 1 through 4 having four kinds of lengths in accordance with a reel stop sound selecting table shown by FIG. 29.

That is, reel stop sound 1 is selected in the case in which the back lamps 57*a*, 57*b* and 57*c* of a reel which is requested to stop, are requested to light when operation of the first stop button is detected and reel stop sound 2 is selected when they are requested to extinguish. Further, the reel stop sound 1 is selected in the case in which the back lamps 57*a*, 57*b* and 57*c* of a reel which is requested to stop, are requested to light when operation of the second stop button is detected and when they are requested to extinguish, reel stop sound 3 is selected. Further, the reel stop sound 1 is selected in the case in which the back lamps 57*a*, 57*b* and 57*c* of a reel which is requested to stop, are requested to light when operation of the third stop button is detected and when they are requested to extinguish, reel stop sound 4 is selected.

FIGS. 30A, 30B and 30C show timing charts of emitting the reel stop sound 1. The reel stop sound 1 is single sound having a length of 327.60 (ms) as shown by FIG. 30B. The timing of emitting the sound is when there is no request for extinguishing the back lamps 57*a*, 57*b* and 57*c* of any of the reels 3 through 5 which is requested to stop as shown by FIG. 30A in a timing of detecting operation of any of the stop buttons 16 through 18 shown by FIG. 30C. Further, a timing of extinguishing the reel stop sound 1 is when a time period of 327.60 (ms) has elapsed from the sound emitting timing or when operation of a successive one of the stop button is detected before elapse of the time period.

For example, when operation of the second stop button is detected before elapse of the time period of 327.60 (ms) from when operation of the first stop button was detected as shown by FIG. 31D, the reel stop sound 1 shown by FIG. 31B is extinguished. FIG. 31C represents reel stop sound which is successively selected and a length thereof is varied between 327.60 through 589.68 (ms) in accordance with the kind of the selected one of the reel stop sounds 1 through 4. Further, FIG. 31A shows a state in which the back lamps 57*a*, 57*b* and 57*c* of a reel which is requested to stop, are lighted by operating the first stop button.

FIGS. 32A, 32B and 32C show timing charts of emitting the reel stop sound 2. As shown by FIG. 32B, the reel stop sound 2 is single sound having a length of 393.12 (ms). The timing of emitting sound is when the back lamps 57*a*, 57*b* and 57*c* of any of the reels 3 through 5 which is requested by the first stop request, are requested to extinguish as shown by FIG. 32A at a timing of detecting operation of the stop button shown by FIGS. 32C. Further, a timing of extinguishing the reel stop sound 2 is when a time period of 393.12 (ms) has elapsed from the sound emitting timing or when operation of a successive one of the stop buttons is detected before elapse of the time period.

For example, as shown by FIG. 33D, when operation of the second stop button is detected before elapse of time period of 393.12 (ms) from when the operation of the first stop button is detected, the reel stop sound 2 shown by FIG. 33B is extinguished. FIG. 33C represents reel stop sound which is successively selected and a length thereof is varied between 327.60 through 589.68 (ms) in accordance with the kind of a selected one of the reel stop sounds 1 through 4. Further, FIG. 33A shows a state in which the back lamps 57*a*, 57*b* and 57*c* of the first stop reel which is requested to stop by operating the first stop button, are lighted.

FIGS. 34A, 34B and 34C show timing charts of emitting the reel stop sound 3. As shown by FIG. 34B, the reel stop sound 3 is single sound having a length of 499.59 (ms). The timing of emitting sound is when the back lamps 57*a*, 57*b* and 57*c* of any of the reels 3 through 5 which is requested to stop by the second stop request, are requested to extinguish as shown by FIG. 34A at a timing of detecting operation of the stop button as shown by FIG. 34C. Further, a timing of extinguishing the reel stop sound 3 is when a time period of 499.59 (ms) has elapsed from the sound emitting timing or when operation of a successive one of the stop buttons is detected before elapse of the time period.

For example, when operation of the third stop button is detected before elapse of the time period of 499.59 (ms) from when operation of the second stop button was detected as shown by FIG. 35D, the reel stop sound 3 shown by FIG. 35B is extinguished. FIG. 35C represents reel stop sound which is successively selected and a length thereof is varied between 327.60 through 589.68 (ms) in accordance with the kind of a selected one of the reel stop sounds 1 through 4. Further, FIG. 35A shows a state in which the back lamps 57*a*, 57*b* and 57*c* of the second stop reel which is requested to stop by operating the second stop button, are lighted.

FIGS. 36A, 36B and 36C show timing charts of emitting the reel stop sound 4. The reel stop sound 4 is single sound having a length of 589.68 (ms) as shown by FIG. 36B. The timing of emitting the sound is when the back lamps 57*a*, 57*b* and 57*c* of any of the reels 3 through 4 which is requested to stop by the third stop request, are requested to extinguish as shown by FIG. 36A at a timing of detecting operation of the stop button as shown by FIG. 36C. Further, a timing of extinguishing the reel stop sound 4 is when a time period of 589.68 (ms) has elapsed from a timing of emitting the sound.

Further, the sound emitting means may emit any of 4 kinds of reel stop sound 1 through 4 at each time of producing display of each column of the reels 3 through 5 by cooperatively producing means in accordance with a reel stop selecting table shown by FIG. 37.

That is, in the case in which the back lamps 57*a*, 57*b* and 57*c* of a reel which is requested to stop, are requested to light when operation of the first stop button is detected, a sound scale "do" is selected as reel stop sound 1 and when they are requested to extinguish, a sound scale "re" is selected as reel stop sound 2. Further, in the case in which the back lamps 57*a*, 57*b* and 57*c* of a reel which is requested to stop, are requested to light when operation of the second stop button is detected, the sound scale "do" of the reel stop sound 1 is selected and when they are requested to extinguish, a sound scale "mi" is selected as reel stop sound 3. Further, in the case in which the back lamps 57*a*, 57*b* and 57*c* of a reel which is requested to stop, are requested to light when operation of the third stop button is detected, the sound scale "do" is selected as the reel stop sound 1 and when they are requested to extinguish, a sound scale "fa" is selected as reel stop sound 4.

Similar to the first embodiment, ROM 32 shown by FIG. 28 is stored with a procedure of game processing executed by the slot machine as a sequence program and in addition to, stored with the prize probability table, the symbol table, the prize symbol combination table, the demonstration lottery table selecting table, the demonstration lottery table and the above-described reel stop sound selecting table shown by FIG. 29 or FIG. 37 and so on by being respectively classified.

Similar to the first embodiment, the prize probability table constitutes random number classifying means for classifying random numbers sampled by the sampling circuit 37 to the respective prize modes and is constituted as shown by, for example, FIG. 7 mentioned above. Also in this case, the random number generator 36, the sampling circuit 37, the prize probability table and the micon 30 constitute prize mode determining means. Further, similar to the first embodiment, the symbol table is also conceptually shown by FIG. 8. Further, the prize symbol combination table is constituted also similar to that in the first embodiment.

Further, the demonstration lottery table selecting table and the demonstration lottery table constitute informing mode selecting means for selecting kinds of patterns of extinguishing the back lamps of the reels which the informing means controls to light in accordance with a prize mode determined by the prize mode determining means. The lottery processing of selecting the informing mode by the informing mode selecting means is carried out at a timing successive to the timing of the prize mode probability lottery shown by FIG. 14K.

The demonstration lottery table selecting table shown by FIG. 38 is for selecting the demonstration lottery tables of No. 0 through No. 17 shown by FIG. 39 through FIG. 41 from a game state and a hit flag. The game state becomes clear by referring to a storing region of game level status (GMLVSTS) shown by FIG. 42A. The GMLVSTS storing region is stored as data of 1 byte in RAM 33. The game state is stored at bits 0 through 4 and the game state which is made ON by setting data to 1 is the game state of that time. As shown by GMLVSTS, according to the kind of the game state, there are five kinds of "RB operation", "BB operation", "general game", "inner hit of RB" and "inner hit of BB".

A hit flag becomes clear by referring to a storing region of a flag counter (FLGCTR) shown by FIG. 42B. Also the FLGCTR storing region is stored as data of 1 byte in RAM 33. A hit flag at that time is indicated by 1 byte data of 00 through 07 of 16-adic.

For example, when data of bit 2 of GMLVSTS is set to 1 (04H) and data of FLGCTR is 07H, the game state is general game and the hit flag is BB. Accordingly, the demonstration lottery table at that time is No. 7 demonstration lottery table from the demonstration lottery table selecting table. The demonstration lottery table of No. 7 is shown by FIG. 40 and the kind of the pattern of extinguishing the back lamps of the reels is selected by lottery, mentioned later, using the lottery values indicated by the table. When a combination of a column of a lottery value 18 is selected by the demonstration lottery table of No. 7, the reel lamp extinguishing pattern becomes pattern 5.

Further, when a combination of a column of a lottery value 55 is selected by the demonstration lottery table of No. 7 in the above-described case in which the game level status is general game and the flag counter is inner hit of BB, the reel lamp extinguishing pattern becomes pattern 1. Further, when data of bit 2 of GMLVSTS is set to 1 and data of FLGCTR is 00H, the game state is general game and the hit flag becomes a blank. The demonstration lottery table at that time becomes a demonstration lottery table of No. 0 from the demonstration lottery table selecting table.

The demonstration lottery table of No. 0 is shown by FIG. 39 and when a column of a lottery value 100 is selected by lottery from the table, the reel lamp extinguishing pattern becomes pattern 1 as a production mode combination at that time. That is, even in the game establishing different hit flags, depending on a value of a random number for determining a pattern for informing a prediction, the same prediction informing pattern may appear.

In this way, the kind of a hit flag is informed to the player in accordance with the kind of the reel lamp extinguishing pattern which is determined by the game state at that time and the reliability is not uniform. For example, even when the prediction informing operation of the BB flag hit in general game is carried out as mentioned above, the BB flag is not necessarily be hit at that time. That is, the probability of informing a prediction when the BB flag is hit in general game is X (=0 through 100) % and the probability of informing a predication even when the BB flag is not hit in general game is (100−X) %.

Further, the probability of informing a prediction of RB or BB flag hit in inner hit of RB or inner hit of BB is previously determined to a predetermined value in a range of 0 through 100%. According to the embodiment, there are two kinds of pattern 7 and pattern 8 in light extinguishing patterns in which informing operation of predicting RB or BB flag hit is carried out at a probability of 100% in inner hit of RB and inner hit of BB. That is, the light extinguishing pattern 7 or the light extinguishing pattern 8 appears only when the RB or BB flag is hit and not when the RB or BB flag is not hit.

Kinds of light extinguishing patterns of fixing RB or BB game are previously stored in a predetermined region of ROM 32.

Further, the micon 30, the lamp drive circuit 48 and the notifying lamp 25 constitute notifying means for notifying informing information to the player by display of a displayer (notifying lamp 25 in the embodiment) when the informing information in correspondence with a specific prize mode (inner hit of RB or BB in the embodiment) which is determined by the prize mode determining means is informed to the player by the informing means at the probability of 100%.

Next, an explanation will be given of the operation of the game machine controlled by the micon 30 according to the present invention.

Figure 43:
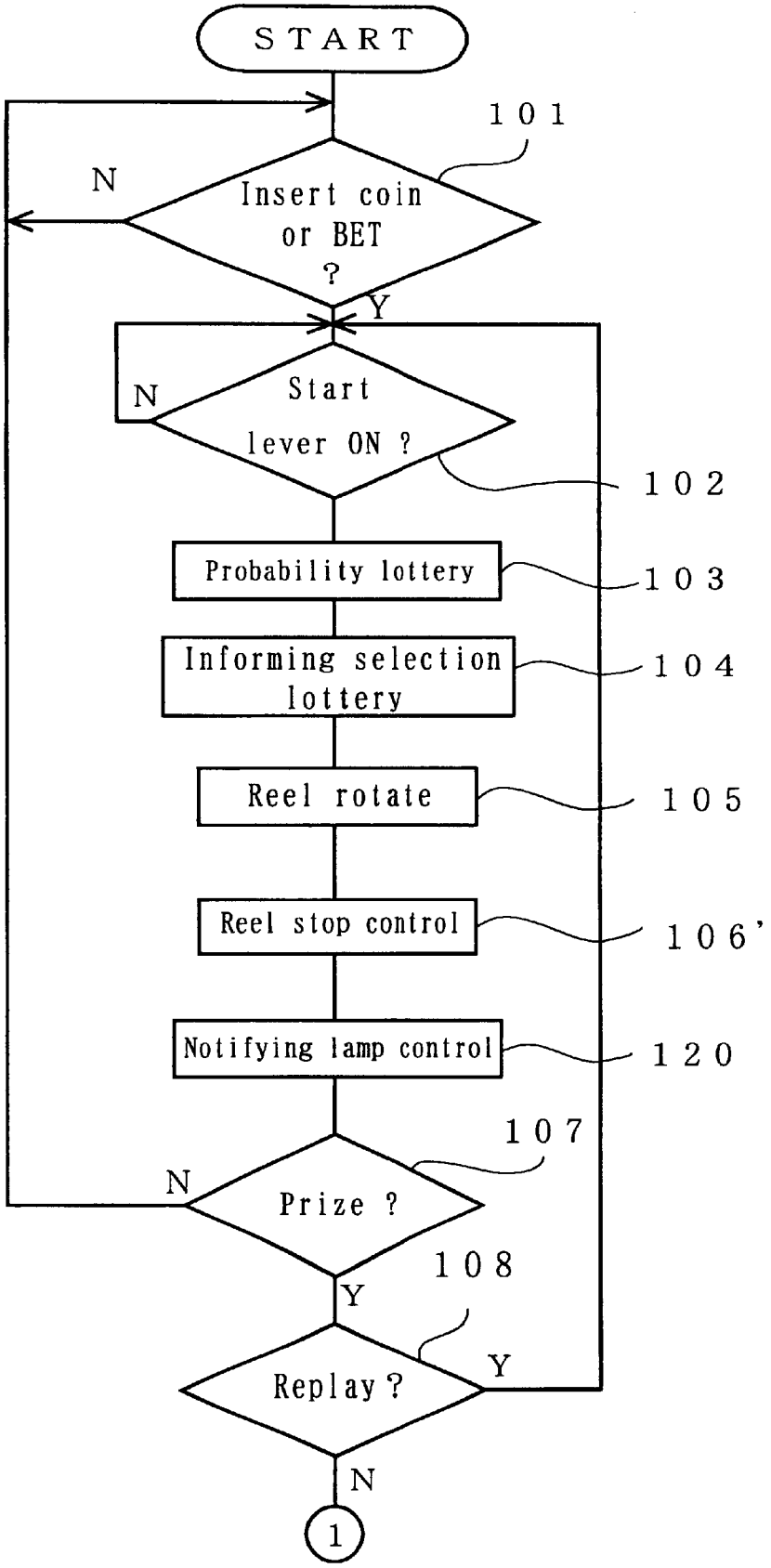
FIG. 43 is a first flowchart showing game process of the slot machine according to the second embodiment.

FIG. 43 is a flowchart showing an outline of a former half of the game processing and successive to the processing, a latter half of the game processing shown by FIG. 12 mentioned above is carried out. According to the game processing of the second embodiment, the informing selection lottery processing (step 104') and the reel stop control processing (step 106') differ from those of the first embodiment and a notifying lamp control processing (step 120) is added after the reel stop control processing which is different from the first embodiment.

In the game processing, firstly, whether the coin BET is carried out is determined by CPU 31 (refer to step 101 of FIG. 43) and when coins are inserted or the BET is carried out, successively, whether a start signal is inputted from the start switch 15S by operating the start lever 15 is determined (step 102).

When the determination is "YES", the probability lottery processing is carried out by the prize mode determining means (step 103). In respect of the prize mode determined by the prize mode determining means, data of either one of 8 kinds of "blank", "2 cherry", "4 cherry", "bell", "watermelon", "replay", "RB" and "BB" is written and temporarily stored to FLGCTR (refer to FIG. 42B) mentioned above.

Successive to the prize determining processing, the informing selection lottery processing of the prize mode is carried out (step 104'). The informing selection lottery processing of the prize mode is carried out in accordance with a flowchart shown by FIG. 44.

Figure 44:
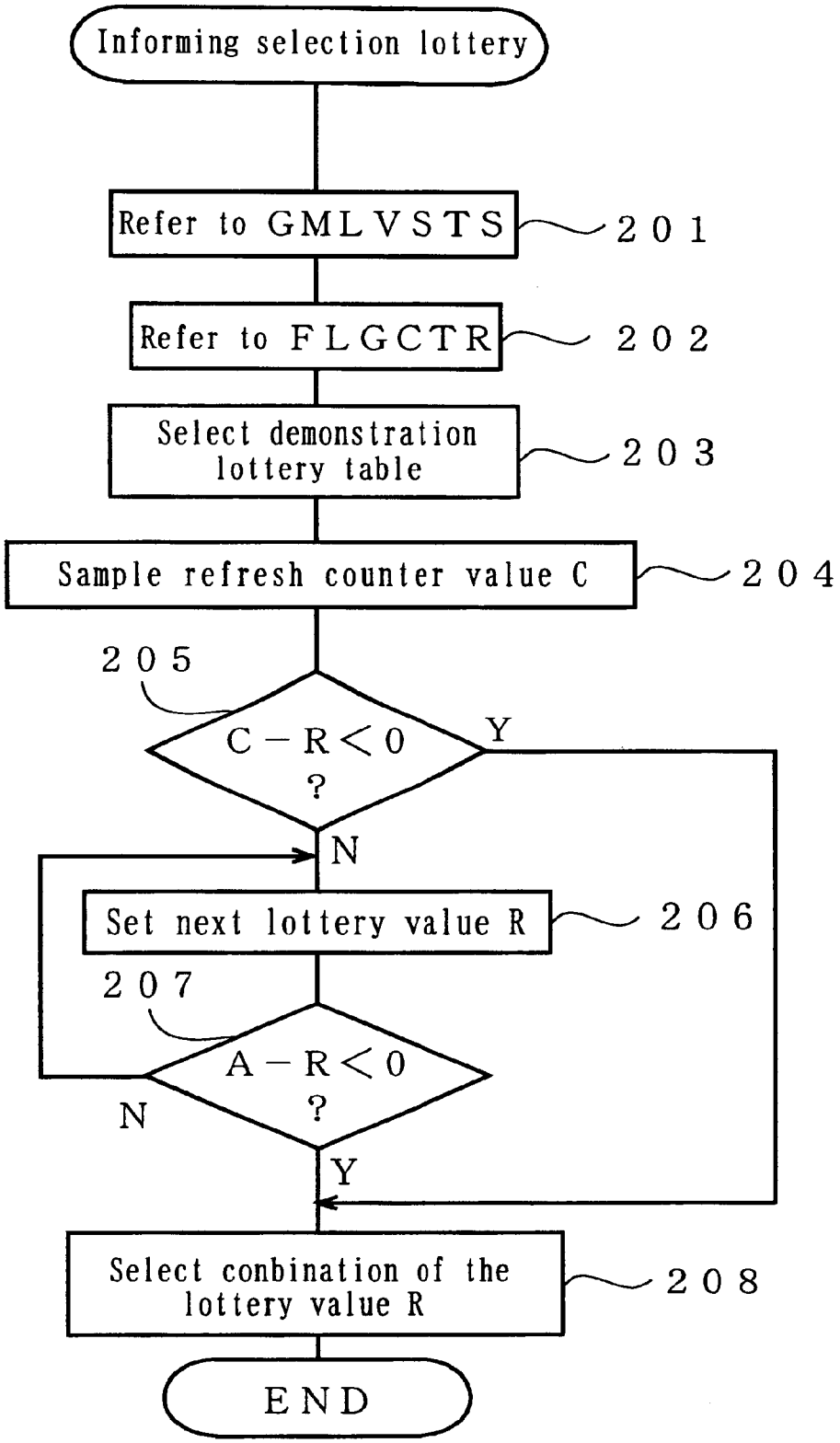
FIG. 44 is a flowchart showing content of information selection lottery processing shown by FIG. 43.

First, the GMLVSTS region (refer to FIG. 42A) stored in RAM 33 is referred and the game state at that time is grasped (step 201 of FIG. 44). Next, data stored to the FLGCTR region is referred and the kind of the hit flag is grasped (step 201).

Next, either one of the demonstration lottery tables of No. 0 through No. 17 is selected by referring to the demonstration lottery table selection table (refer to FIG. 38) from the game state at that time and the kind of the hit flag (step 203). Next, a count value C is sampled at an arbitrary timing from a counter for refreshing RAM 33 at constant time periods (step 204).

The count value C is varied in a range of 0 through 127 and the random number lottery for selecting the informing mode is carried out by using the sampled count value C. That is, a lottery value R at the topmost column in the demonstration lottery table selected at step 203 is subtracted from count value C and positiveness or negativeness of subtraction result A (=C−R) is determined (step 205). When the subtraction result A is not negative, successively, a lottery value at a successive column of the table is set to the lottery value R (step 206) and thereafter, subtraction of A−R is carried out and the positiveness or negativeness of the result A (=A−R) is determined (step 207). The operation is carried out until the subtraction result A becomes negative and when it becomes negative, a reel lamp extinguishing pattern of the column of the lottery value R is selected as a production mode for informing a prediction (step 208).

For example, when the BB flag is hit in general game, as mentioned above, the demonstration lottery table of No. 7 is selected and the selection lottery processing of the production mode at this occasion is carried out as follows. First, when 50 is sampled as the refresh counter value C at step 204, in the subtraction of C−R at step 205, a lottery value 55 at the topmost column is firstly set to the lottery value R and the subtraction result is formed as A=50−55=−5. The subtraction result A is negative and therefore, a reel lamp extinguishing pattern 1 at the column of the lottery value 55 is selected to the prediction informing mode. Further, when 4 cherry is hit in inner hit of RB, a demonstration lottery table of No. 10 is selected (refer to FIG. 38) and the selection lottery processing of the production mode combination at this occasion is carried 20 out as follows. First, when 40 is sampled as a refresh counter value C, in the subtraction of C−R, a lottery value 10 at the topmost column is firstly set to the lottery value R and the subtraction result is formed as A=40−10=30. The subtraction result is positive and accordingly, successively, a lottery value 50 at a successive column of the table is set to the lottery value R and positiveness and negativeness of the subtraction result of A=30−50=−20 is determined. The subtraction result A is negative and accordingly, a reel lamp extinguishing pattern 7 at a column of the lottery value 50 is selected as the prediction informing mode.

Next, the rotating processing of the first reel 3, the second reel 4 and the third reel 5 is carried out (step 105 of FIG. 43) and the respective reels 3, 4 and 5 start rotating simultaneously. Successive to the reel rotating processing, stop control of the respective reels 3, 4 and 5 is carried out (step 106'). An outline of the reel stop control processing is shown by a flowchart of FIG. 45. Further, in respect of the reel stop control explained here, for convenience, an explanation will be given of a case in which the first reel stop button 16, the second reel stop button 17 and the third reel stop button 18 are operated in this order and the respective reels 3 through 5 are stopped in the order of the first reel 3, the second reel 4 and the third reel 5. However, the order of stopping the respective reels 3 through 5 is not limited thereto but, for example, they may be stopped by a random operational order as in, for example, the first reel stop button 16, the third reel stop button 18 and the second reel stop button 17.

Figure 45:
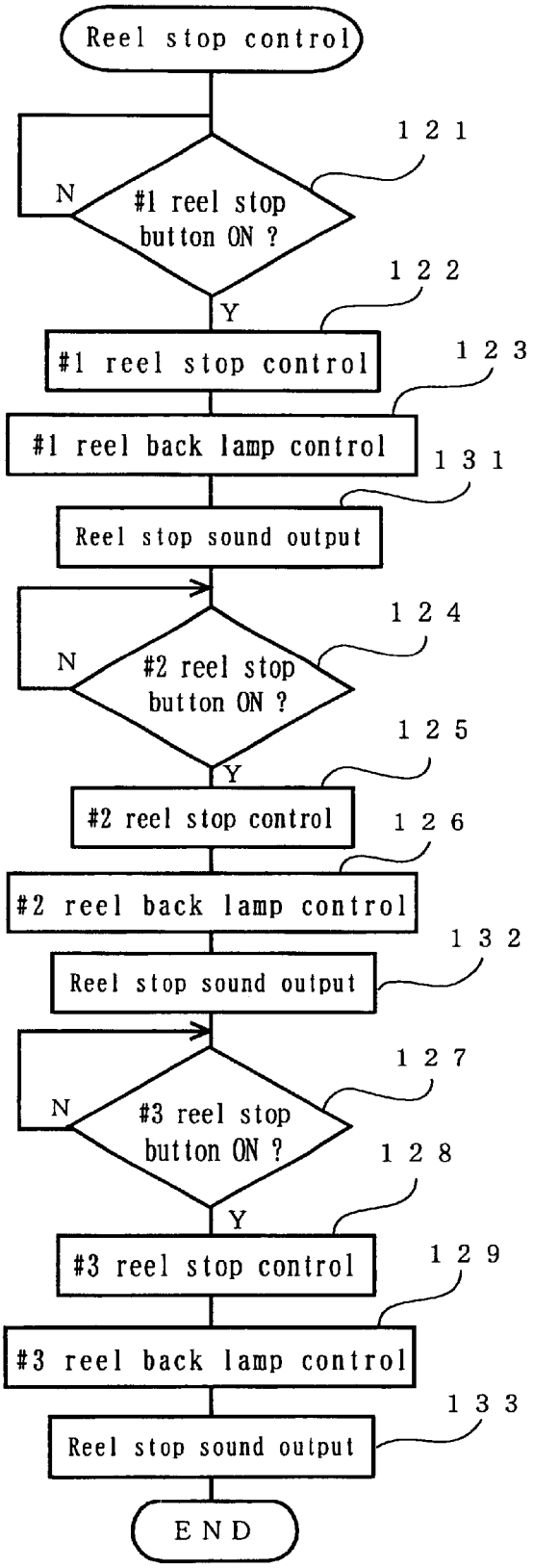
FIG. 45 is a flowchart showing content of reel stop control processing shown by FIG. 43.

The operation of the respective stop buttons 16 through 18 by the player is detected by CPU 31 via the reel stop signal circuit 45 as mentioned above and when ON operation of the first reel stop button 16 is detected at step 121 of FIG. 45, the stop control processing of the first reel 3 is carried out as mentioned above (step 122). Next, the control processing of the back lamps of the first reel is carried out (step 123). The control processing is carried out in accordance with the reel light extinguishing pattern on the demonstration lottery table selected by the informing selection lottery processing at step 1041 mentioned above and the back lamps 57*a*, 57*b* and 57*c* built in the first reel 3 are controlled to light in accordance with the selected reel lamp extinguishing pattern.

For example, in the above-described case in which the BB flag is hit in general game and the reel lamp extinguishing pattern 1 at the column of the lottery value 55 of the demonstration lottery table No. 7 is selected, the respective back lamps 57*a*, 57*b* and 57*c* of the first reel 3 are not extinguished as shown by FIG. 24B. Further, in the above-described case in which 4 cherry is hit in inner hit of RB and the reel lamp extinguishing pattern 7 of the column of the lottery value 50 of the demonstration lottery table No. 10 is selected, the respective back lamps 57*a*, 57*b* and 57*c* of the first reel 3 are extinguished as shown by FIG. 18B.

Next, the reel stop sound emitting processing (step 131) is carried out. As mentioned above, the kind of reel stop sound emitted by the sound emitting means is selected in accordance with the reel stop sound selection table.

For example, in the above-described case in which the BB flag is hit in general game and the reel lamp extinguishing pattern 1 of the column of the lottery value 55 of the demonstration lottery table No. 7 is selected, the respective lamps 57*a*, 57*b* and 57*c* of the first stop reel 3 are not extinguished as mentioned above and are brought into a lighted state. Accordingly, when the table shown by FIG. 29 is used as the reel stop sound selection table, the reel stop sound 1 having the length of 327.60 (ms) is selected and sound is emitted as shown by FIG. 30B when the timing of operating the first stop button 16 is detected. Further, when the table shown by FIG. 37 is selected as the reel stop sound selection table, the reel stop sound 1 having the sound level of "do" is selected and is emitted at a similar timing.

Further, in the above-described case in which 4 cherry is hit in inner hit of RB and the reel lamp extinguishing pattern 7 at the column of the lottery value 50 of the demonstration lottery table No. 10 is selected, the respective back lamps 57*a*, 57*b* and 57*c* of the first stop reel 3 are extinguished as mentioned above. Accordingly, when the table shown by FIG. 29 is used as the reel stop sound selection table, the reel stop sound 2 having the length of 393.12 (ms) is selected and is emitted as shown by FIG. 32B when the timing of operating the first stop button 16 is detected. Further, when the table shown by FIG. 37 is used as the reel stop sound election table, the reel stop sound 2 having the sound level of "re" is selected and emitted at a similar timing.

Next, whether the stop button 17 of the second reel 4 is made ON is detected (step 124) and when ON operation of the stop button 17 is detected, the stop control processing of the second reel 4 is carried out as mentioned above (step 125). Next, the control processing of the back lamps of the second reel is carried out (step 126). Also in the control processing, the back lamps 57*a*, 57*b* and 57*c* built in the second reel 4 are controlled to light in accordance with the reel lamp extinguishing pattern selected by the informing selection lottery processing at step 104' mentioned above.

For example, in the above-described case in which the BB flag is hit in general game and the reel lamp extinguishing pattern 1 at the column of the lottery value 55 of the demonstration lottery table No. 7 is selected, as shown by FIG. 24C, the respective back lamps 57*a*, 57*b* and 57*c* of the second reel 4 are not extinguished. Further, in the above-described case in which 4 cherry is hit in inner hit of RB and the reel lamp extinguishing pattern 7 at the column of the lottery value 50 of the demonstration lottery table No. 10 is selected, the respective back lamps 57*a*, 57*b* and 57*c* of the second reel 4 are extinguished as shown by FIG. 18C.

Next, the reel stop sound emitting processing (step 132) is carried out. The kind of the reel stop sound is also selected in accordance with the reel stop sound selection table.

For example, in the above-described case in which the BB flag is hit in general game and the reel lamp extinguishing pattern 1 at the column of the lottery value 55 of the demonstration lottery table No. 7 is selected, the respective back lamps 57*a*, 57*b* and 57*c* of the second stop reel 4 are not extinguished as mentioned above and are brought into a lighted state. Therefore, when the table shown by FIG. 29 is used as the reel stop sound selection table, the reel stop sound 1 having the length of 327.60 (ms) is selected and is emitted as shown by FIG. 30B when the timing of operating the second stop button 17 is detected. Further, when the table shown by FIG. 37 is used as the reel stop sound selection table, the reel stop sound 1 having the sound level of "do" is selected and is emitted at a similar timing.

Further, in the above-described case in which 4 cherry is hit in inner hit of RB and the reel lamp extinguishing pattern 7 at the column of the lottery value 50 of the demonstration lottery table No. 10 is selected, the respective back lamps 57*a*, 57*b* and 57*c* of the second stop reel 4 are extinguished as mentioned above. Therefore, when the table shown by FIG. 29 is used as the reel stop sound selection table, the reel stop sound 3 having the length of 499.59 (ms) is selected and is emitted as shown by FIG. 34B when the timing of operating the second stop button 17 is detected. Further, when the table shown by FIG. 37 is used as the reel stop sound selection table, the reel stop sound 3 having the sound level of "mi" is selected and is emitted at a similar timing.

Next, whether the stop button 18 of the third reel 5 is made ON is detected (step 127) and when ON operation of the stop button 18 is detected, the stop control processing of the third reel 5 is carried out as mentioned above (step 128). When the reel stop control processing has been finished, the control processing of the back lamps of the third reel is carried out (step 129). Also in the control processing, the back lamps 57*a*, 57*b* and 57*c* built in the third reel 5 are controlled to light in accordance with the reel lamp extinguishing pattern having the production mode combination selected by the informing selection lottery processing at step 104' mentioned above.

For example, in the above-described case in which the BB flag is hit in general game and the reel lamp extinguishing pattern 1 at the column of the lottery value 55 of the demonstration lottery table No. 7 is selected, the back lamps 57*a*, 57*b* and 57*c* of the third reel 5 are not extinguished as shown by FIG. 24D. Therefore, the respective back lamps 57*a*, 57*b* and 57*c* of the first reel 3, the second reel 4 and the third reel 5 are not extinguished in connection with the operation of the respective stop buttons 16, 17 and 18 and are brought into a state where they remain lighted.

Further, in the above-described case in which 4 cherry is hit in inner hit of RB and the reel lamp extinguishing pattern 7 at the column of the lottery value 50 of the demonstration lottery table No. 10 is selected, as shown by FIG. 18D, the respective back lamps 57*a*, 57*b* and 57*c* of the third reel 5 are not extinguished. Accordingly, the respective back lamps 57*a*, 57*b* and 57*c* of the first reel 3, the second reel 4 and the third reel 5 are extinguished, extinguished and lighted in this order in connection with the operation of the respective stop button 16, 17 and 18.

Next, the reel stop sound emitting processing (step 133) is carried out. The kind of the reel stop sound is also selected in accordance with the reel stop sound selection table as mentioned above.

For example, in the above-described case in which the BB flag is hit in general game and the reel lamp extinguishing pattern 1 at the column of the lottery value 55 of the demonstration lottery table No. 7 is selected, the respective back lamps 57*a*, 57*b* and 57*c* of the third stop reel 5 are not extinguished as mentioned above and are brought into a lighted state.

Therefore, when the table shown by FIG. 29 is used as the reel stop sound selection table, the reel stop sound 1 having the length of 327.60 (ms) is selected and is emitted as shown by FIG. 30B when the timing of operating the third stop button 18 is detected. As a result, in connection with the operation of the respective stop buttons 16, 17 and 18, the respective back lamps 57*a*, 57*b* and 57*c* of the first, the second the third reels 3, 4 and 5 are successively lighted as mentioned above and a series of sound having the same length is emitted by 3 times as, for example, "beep, beep, beep".

Further, when the table shown by FIG. 37 is used as the reel stop sound selection table, the reel stop sound 1 having the sound level of "do" is selected and emitted. As a result, in connection with the operation of the respective stop buttons 16, 17 and 18, the back lamps 57*a*, 57*b* and 57*c* of the first, the second and the third reels 3, 4 and 5 are successively lighted and a series of sound having the same sound level is emitted by 3 times as "do, do, do".

Further, in the above-described case in which 4 cherry is hit in inner hit of RB and the reel lamp extinguishing pattern 7 at the column of the lottery value 50 of the demonstration lottery table No. 10 is selected, the respective back lamps 57*a*, 57*b* and 57*c* of the third stop reel 5 are not extinguished as mentioned above.

Accordingly, when the table shown by FIG. 29 is used as the reel stop sound selection table, the reel stop sound 1 having the length of 327.60 (ms) is selected and emitted as shown by FIG. 30B when the timing of operating the third stop button 18 is detected. As a result, in connection with the operation of the respective stop buttons 16, 17 and 18, the respective back lamps 57*a*, 57*b* and 57*c* of the first, the second and the third reels 3, 4 and 5 are extinguished, extinguished and lighted in this order as mentioned above and a series of sound having different lengths are emitted by 3 times, for example, "beep, beeep, be".

Further, when the table shown by FIG. 37 is used as the reel stop sound selection table, the reel stop sound 1 having the sound level of "do" is selected and emitted. As a result, in connection with the operation of the respective stop buttons 16, 17 and 18, the respective back lamps 57*a*, 57*b* and 57*c* of the first, the second and the third reels 3, 4 and 5 are extinguished, extinguished and lighted in this order as mentioned above and a series of sound having different sound levels are emitted by 3 times as "re, mi, do".

Figure 46:
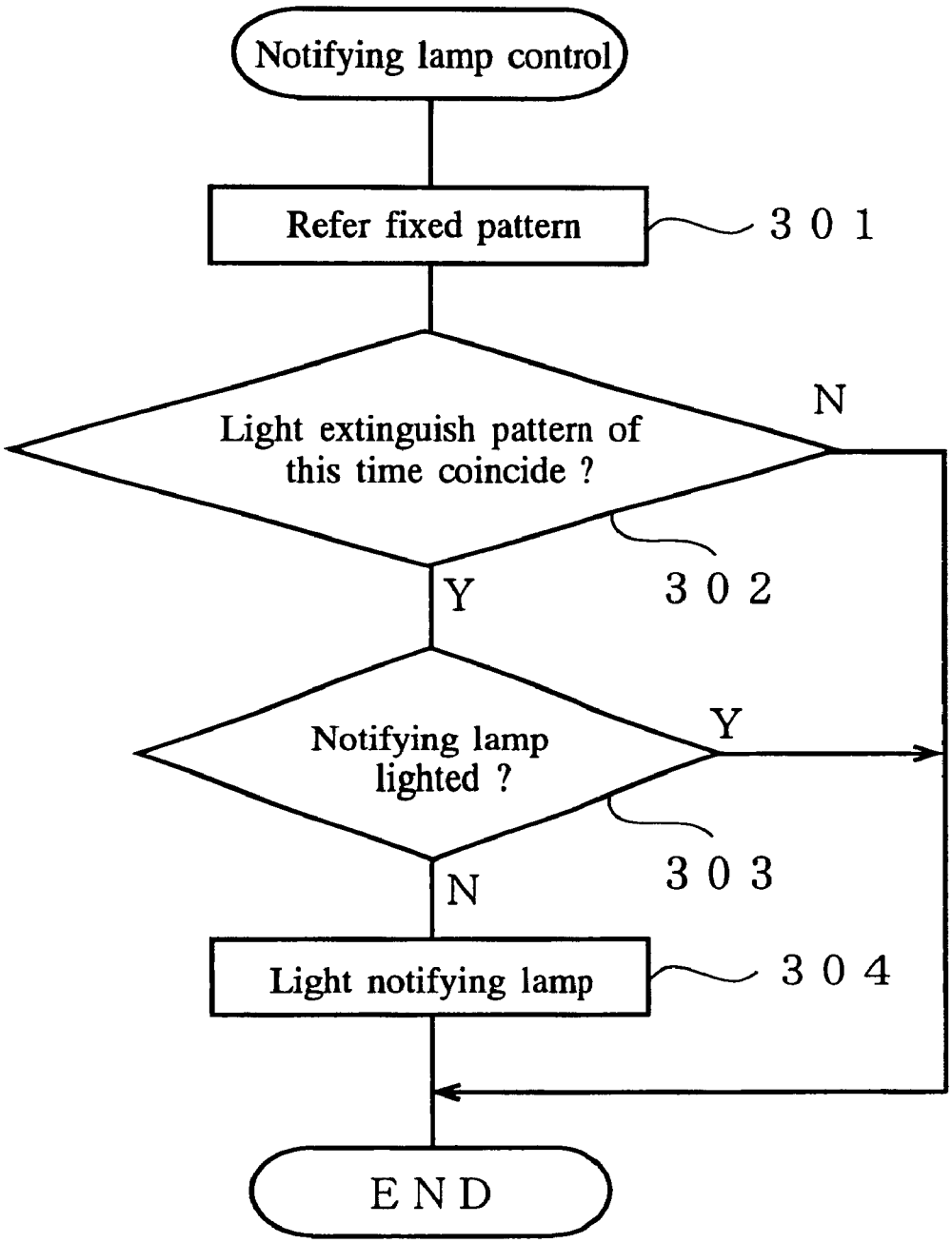
FIG. 46 is a flowchart showing content of notifying lamp control processing shown by FIG. 43.

When the reel stop control processing at step 106' of FIG. 42 has been finished in this way, successively, light control of the notifying lamp 25 is carried out (step 120 of FIG. 43). The notifying lamp control is carried out in accordance with a flowchart shown by FIG. 46.

First, fixed patterns (light extinguishing patterns 7, 8) stored to ROM 32 are referred (step 301) and whether the reel lamp extinguishing pattern at the current time coincides with any of the fixed patterns is determined (step 302). When they do not coincide with each other, the processing is finished. When they coincide with each other, successively, whether the notifying lamp 25 is being currently lighted is determined (step 303) and when it is not lighted, the notifying lamp 25 is controlled to light by the lamp drive circuit 48 (step 304). When it is being lighted, the processing is finished.

For example, in the above-described case in which 4 cherry is hit in inner hit of RB and the reel lamp extinguishing pattern 7 at the column of the lottery value 50 of the demonstration lottery table No. 10 is produced, the reel lamp extinguishing pattern coincides with one of the fixed patterns stored to ROM 32. Therefore, in this case, the lamp drive circuit 48 is driven by control of the micon 30 and the notifying lamp 25 is lighted.

In this case, the micon 30, the lamp drive circuit 48 and the notifying lamp 25 constitute notifying means for notifying to the player informing information by light display of the notifying lamp 25 when the inner hit of RB or BB determined by the prize mode determining means is informed to the player by the above-described production at the probability of 100%.

FIGS. 47A, 47B, 47C, 47D and 47E are timing chart diagrams for lighting the notifying lamp 25. The notifying lamp 25 is lighted at a timing shown by FIG. 47A when the fixed pattern for fixing BB or RB has been finished displaying at a timing shown by FIG. 47B. Further, when the inner hit flag of BB or RB is made ON as shown by FIG. 47C and a combination of symbols of BB or RB is stopped and displayed when the respective reels 3 through 5 are stopped and BB or RB prize is caused at a timing shown by FIG. 47D, the notifying lamp 25 is extinguished at a timing shown by FIG. 47E when pay out of coins by the prize is finished.

In this way, by lighting the notifying lamp 25 on the condition of displaying the fixed pattern, the player can recognize that the informing prediction currently displayed is the prediction informing that inner hit of BB or RB is caused at the probability of 100%.

When the above-described notifying lamp control has been finished, the game processing determines whether the display after stopping all the reels constitutes a predetermined prize combination of symbols in reference to the prize symbol combination table (step 107 of FIG. 43). When the prize is not gained, the determination at step 107 becomes "NO" and the processing returns to the initial step 101. Further, in the case of replay game (game again) as a result of determination of prize, the processing returns to a processing waiting for operation of the start lever 15 at step 102 (step 108).

In the case of prize which is not replay game, a predetermined number of coins are paid out to the coin tray 20 by the hopper 38 (step 110 of FIG. 12). Next, whether BB game is caused is determined (step 111) and when BB game is caused, the BB game is executed (step 112). Further, when the BB game is not caused, successively, whether RB game is caused is determined (step 113), when RB game is caused, the RB game is executed (step 114). Thereafter, the above-described processings are repeated and the slot machine game is carried out.

Also in the embodiment, the prize mode determined by the inner lottery is informed to the player in connection with operation of the stop buttons 16 through 18. That is, in connection with stopping the respective reels 3 through 5 by operating the respective stop buttons 16 through 18, the display mode of the respective back lamps 57*a*, 57*b* and 57*c* (reel lamp extinguishing pattern) is successively produced by the informing means and the prize mode is informed to the player.

For example, in the above-described case in which 4 cherry is hit in inner hit of RB and the light extinguishing pattern 7 at the column of the lottery value 50 of the demonstration lottery table No. 10 is selected, in the midst of operating to stop respectively the first reel 3, the second reel 4 and the third reel 5, the player recognizes that the respective back lamps 57*a*, 57*b* and 57*c* are extinguished, extinguished and lighted in this order by visual sense and recognizes a series of sound having, for example, different lengths of "beep, beeep, be" by auditory sense.

Also in the embodiment, in accordance with successive stop of rotation of the respective reels 3 through 5 at the respective columns by operating the respective stop buttons 16 through 18, the kind of a hit flag determined by the inner lottery is successively informed to the player. Therefore, although conventionally, a result of the lottery determined by the random number lottery at inside of the machine has not been known at all in respect of a prize mode other than a big hit prize until patterns are actually stopped and displayed at the respective windows, according to the embodiment, the player can predict the prize mode to some degree.

Further, according to the embodiment, when inner hit of BB or RB is informed at the probability of 100%, the player is informed of the fact that the inner hit of BB or RB is caused by light display of the notifying lamp 25. When the inner hit of BB or RB is informed at a probability smaller than 100%, that is, in the case in which even when the inner hit of BB or RB is caused by the inner lottery, the inner hit is not necessarily informed, the result of the inner lottery is not notified by light display of the notifying lamp 25. Therefore, even when the result of the inner lottery of causing inner hit of BB or RB is not displayed at the notifying lamp 25, the player can be informed of a result of the inner lottery of causing the inner hit of BB or RB by a display mode of the respective back lamps 57*a*, 57*b* and 57*c* which is informed in connection with operating the stop buttons 16 through 18.

Therefore, different from the conventional game machine in which a result of the inner lottery for causing a big hit prize is mechanically informed to the player, according to the game machine of the embodiment, the player can feel the pleasure of searching the result of the inner lottery as in searching, for example, "reach spot".

Further, in the explanation in the above-described embodiments, at each time of producing display of the respective reels 3 through 5, the sound generating means constituting the informing means emits reel stop sound having a previously determined kind or length. However, the structure of the respective stop buttons 16 through 18 may be constituted by a tactile sense type button structure which vibrates in operation by using solenoids or the like and in place of the above-described sound emitting means, or along with the above-described sound emitting means, the respective stop buttons 16 through 18 may vibrate in a previously determined mode at each time of producing display of the respective reels 3 through 5.

Further, although in the explanation of the above-described embodiments, an explanation has been given of the case in which the notifying lamp 25 constituting the notifying means is installed on the front panel of the machine exclusive for notification, establishment of a flag of a specified prize mode may be notified by using an existing display device. For example, establishment of a specified flag may be notified by emitting special sound from the speaker 39. Or, establishment of a specified flag may be notified by vibrating the respective reels 3 through 5.

Further, the notifying means may be realized by informing means for informing prediction of establishment of flags of respective prize modes. For example, establishment of a specified flag may be notified by displaying a mode of winking the respective back lamps 57*a*, 57*b* and 57*c* of the respective reels 3 through 5 by a specified informing mode when all of the respective reels 3 through 5 have been stopped.

Further, the liquid crystal display unit 24 may be used as informing means for informing prediction of establishment of flags of respective prize modes and further, the liquid crystal display unit 24 may be used as notifying means. That is, instead of informing a prediction by a production combination of a display mode of the reel back lamps or the like, the prediction may be informed by making a character or the like enter the liquid crystal display unit 24 and by a combination of changes in display of the character or the prediction may be informed by a combination of changes of display of a background image thereof. Further, notification by notifying means may be carried out by displaying display of the liquid crystal display unit 24 by a specified mode different from informing a prediction.

For example, although according to the above-described second embodiment and the above-described first embodiment, the respective back lamps 57*a*, 57*b* and 57*c* of the respective reels 3 through 5 are displayed by 8 kinds of the reel lamp extinguishing patterns 1 through 8 and prediction of establishment of flags of respective prize modes is informed, the prediction may be informed by 8 kinds of operational patterns 1 through 8 of a character which is made to enter the liquid crystal display unit 24 as shown by FIGS. 48A through FIG. 55D.

FIGS. 48A, 48B, 48C and 48D show operation al pattern 1 in correspondence with the reel lamp extinguishing pattern 1 (refer to FIGS. 24A, 24B, 24C and 24D) mentioned above, showing a display mode in correspondence with the "blank" hit flag. Three bodies of a character "Kumichan" of a girl are always displayed on the liquid crystal display unit 24 and when the respective stop buttons 16 through 18 are not operated, all of the three bodies disposed on the left, at the center and on the right are in the basic attitudes shown by FIG. 48A.

Figure 48A:
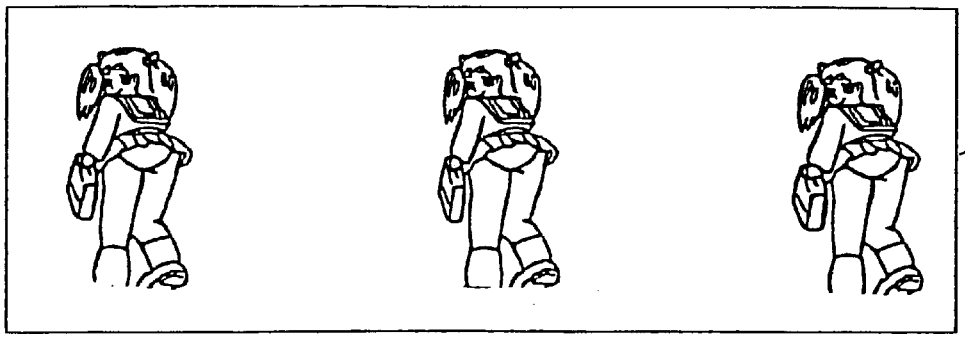
FIGS. 48A, 48B, 48C and 48D are views showing character operation patterns of a first prize mode informed to the player in game process of the slot machine according to the first modified mode of the first and the second respective embodiments.
Figure 48B:
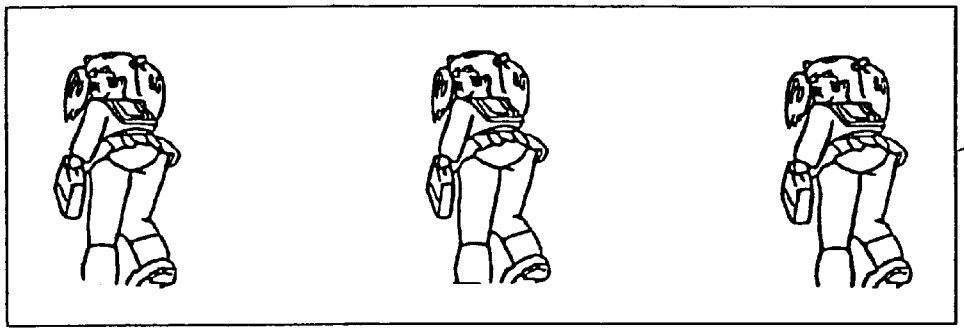
Figure 48C:
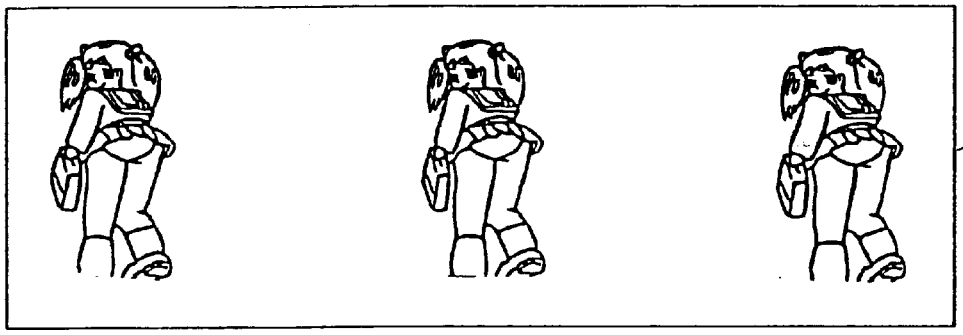
Figure 48D:
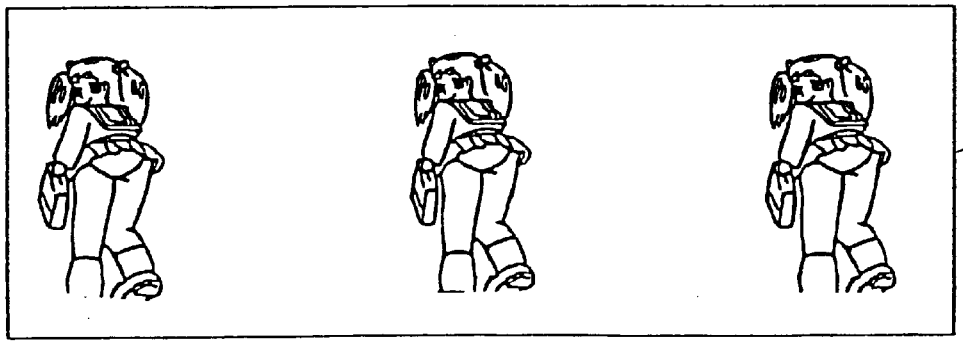

When the "blank" hit flag is erected and the first reel stop button 16 is operated in the first embodiment or when the light extinguishing pattern 1 is selected from the demonstration lottery table as a prediction informing mode and the first reel stop button 16 is operated, the attitudes of the character of the liquid crystal display unit 24 are as shown by FIG. 48B and no change is caused in the respective basic attitudes of the three bodies. Next, when the second reel stop button 17 is operated, the attitudes of the character are as shown by FIG. 48C and similarly, no change is caused in the respective basic attitudes of the three bodies, further, when the third reel stop button 18 is operated, the attitudes of the character are as shown by FIG. 48D and also no change is caused in the respective basic attitudes of the three bodies.

Figure 49A:
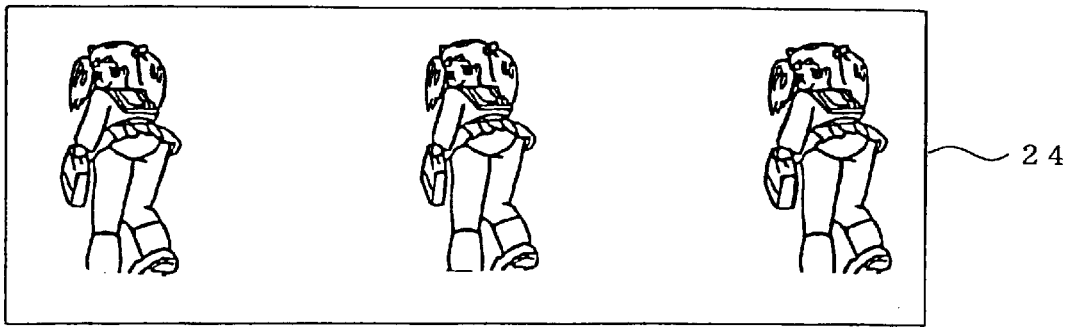
FIGS. 49A, 49B, 49C and 49D are views showing character operation patterns of a second prize mode informed to the player in game process of the slot machine according to the first modified mode of the first and the second respective embodiments.

FIGS. 49A, 49B, 49C and 49D show operational pattern 2 in correspondence with the reel lamp extinguishing pattern 2 (refer to FIGS. 23A, 23B, 23C and 23D) mentioned above, showing a display mode in correspondence with the "replay" hit flag. Also in this pattern, when the respective reel stop buttons 16 through 18 are not operated, all of the three bodies displayed on the liquid crystal display unit 24 are in the basic attitudes as shown by FIG. 49A.

Figure 49B:
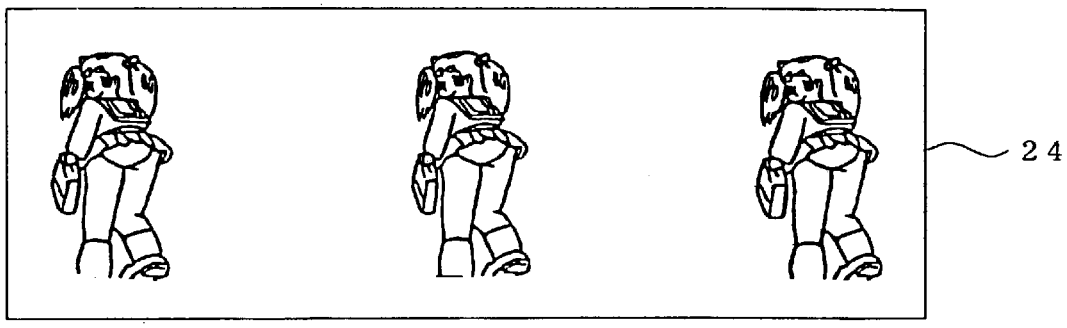
Figure 49C:
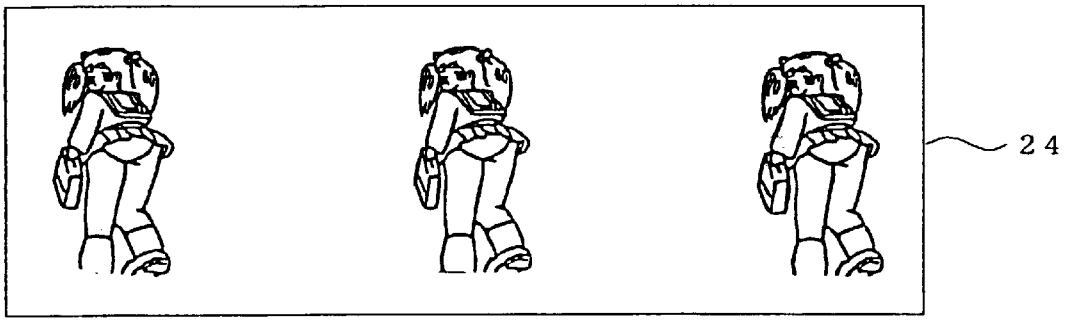
Figure 49D:
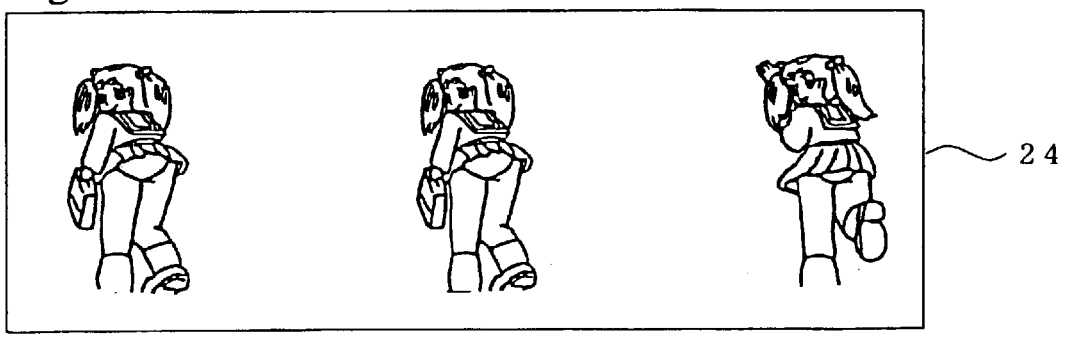

When the "replay" hit flag is erected and the first reel stop button 16 is operated in the first embodiment or when the light extinguishing pattern 2 is selected from the demonstration lottery table as a prediction informing mode and the first reel stop button 16 is operated in the second embodiment, the attitudes of the character in the liquid crystal display unit 24 are as shown by FIG. 49B and no change is caused in the respective basic attitudes of the three bodies. Next, when the second reel stop button 17 is operated, the attitudes of the character are as shown by FIG. 49C, similarly, no change is caused in the respective basic attitudes of the three bodies, further, when the third reel stop button 18 is operated, the attitudes of the character are as shown by FIG. 49D and the right foot of the character disposed on the right is slightly raised backwardly.

FIGS. 50A, 50B, 50C and 50D show operational pattern 3 in correspondence with the reel lamp extinguishing pattern 3 (refer to FIGS. 22A, 22B, 22C and 22D) mentioned above, showing a display mode in correspondence with the "2 cherry" hit flag. Also in this pattern when the respective reel stop buttons 16 through 18 are not operated, all of the three bodies displayed on the liquid crystal display unit 24 are in the basic attitudes shown by FIG. 50A.

Figure 50A:
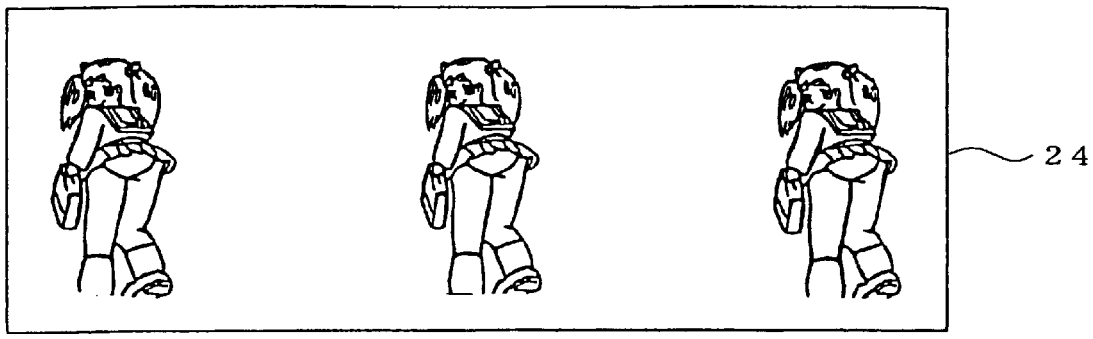
FIGS. 50A, 50B, 50C and 50D are views showing character operation patterns of a third prize mode informed to the player in game process of the slot machine according to the first modified mode of the first and the second respective embodiments.
Figure 50B:
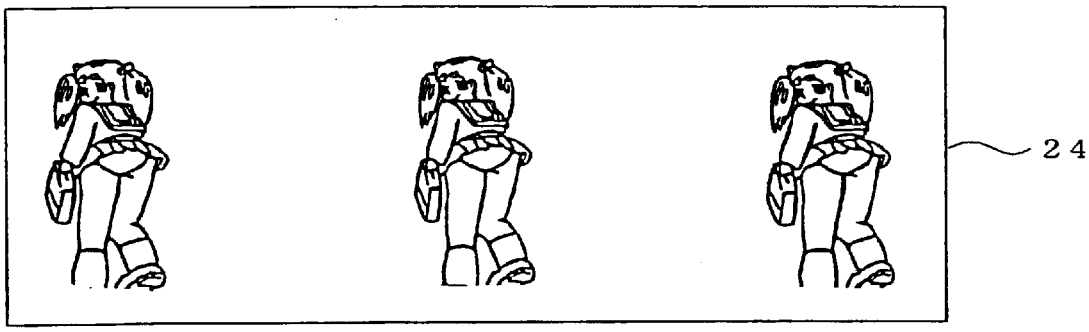
Figure 50C:
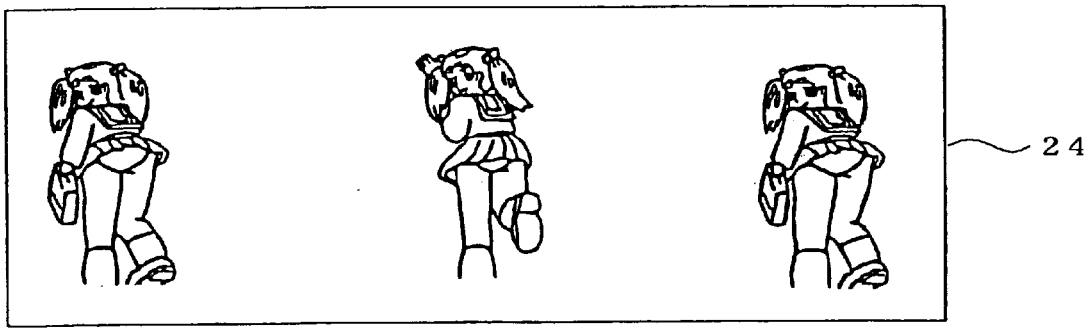
Figure 50D:
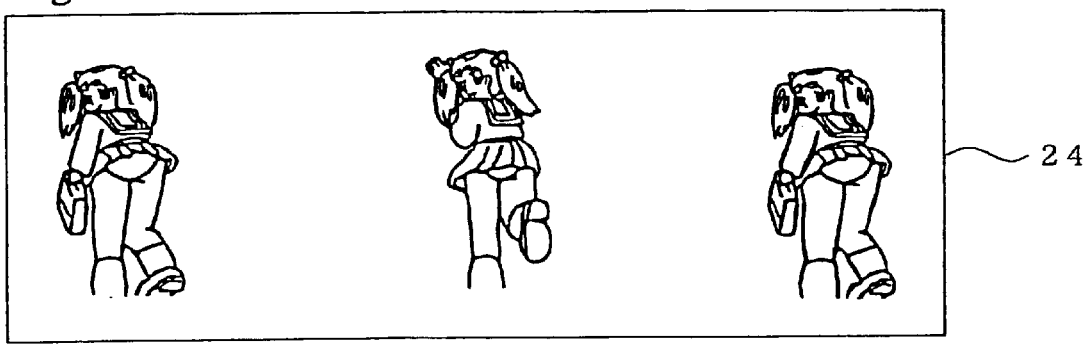

When the "2 cherry" hit flag is erected and the first reel stop button 16 is operated in the first embodiment or when the light extinguishing pattern 3 is selected from the demonstration lottery table as a prediction informing mode and the first reel stop button 16 is operated in the second embodiment, the attitudes of the character of the liquid crystal display unit 24 are as shown by FIG. 50B and no change is caused in the respective basic attitudes of the three bodies. Next, when the second reel stop button 17 is operated, the attitudes of the character are as shown by FIG. 50C and the right foot of the character disposed at the center is slightly raised backwardly. Further, when the third reel stop button 18 is operated, the attitudes of the character are as shown by FIG. 50D and no change is caused in the respective attitudes.

FIGS. 51A, 51B, 51C and 51D show operational pattern 4 in correspondence with the reel lamp extinguishing pattern 4 (refer to FIGS. 21A, 21B, 21C and 21D) mentioned above, showing a display mode in correspondence with the "4 cherry" hit flag. Also in this embodiment, when the respective reel stop buttons 16 through 18 are not operated, all of the three bodies displayed on the liquid crystal display unit 24 are in the basic attitudes shown by FIG. 51A.

Figure 51A:
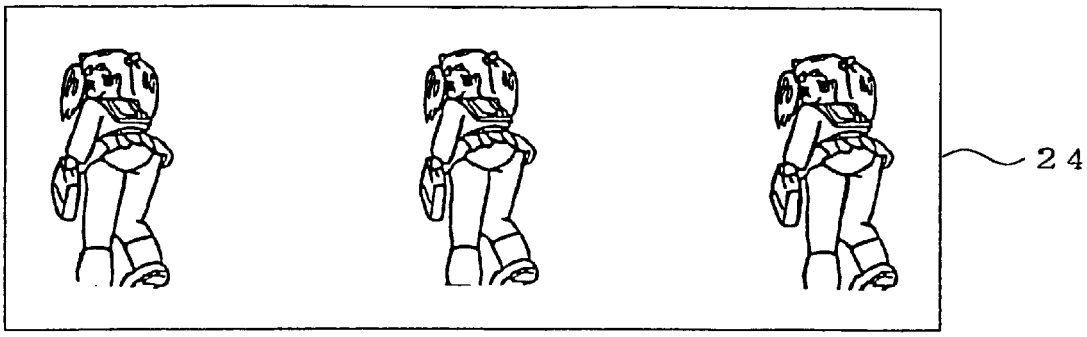
FIGS. 51A, 51B, 51C and 51D are views showing character operation patterns of a fourth prize mode informed to the player in game process of the slot machine according to the first modified mode of the first and the second respective embodiments.
Figure 51B:
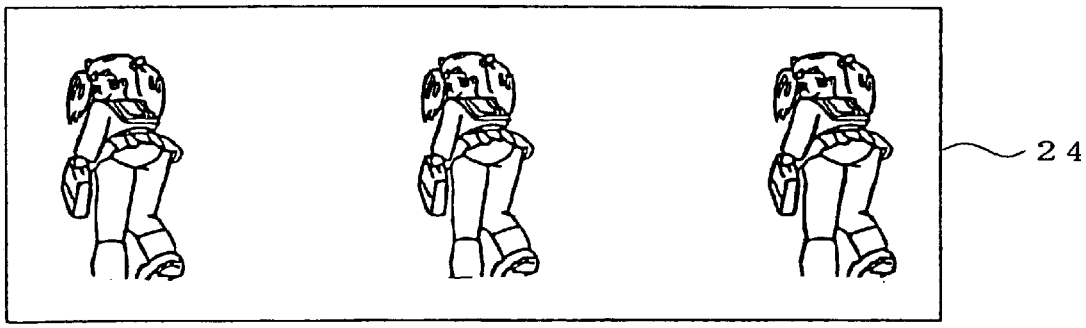
Figure 51C:
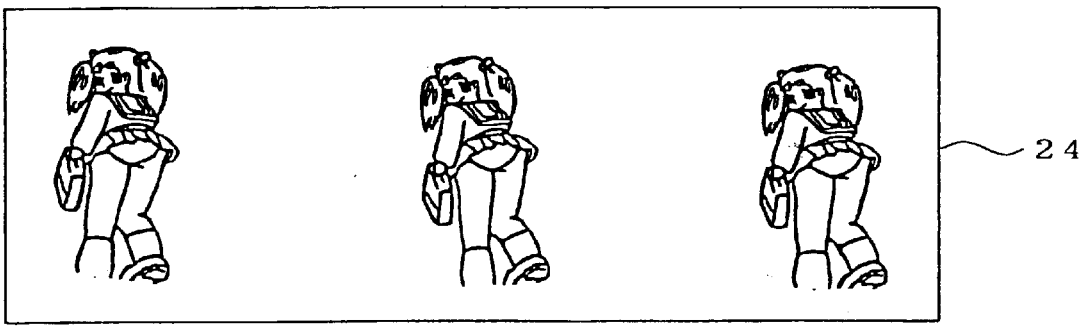
Figure 51D:
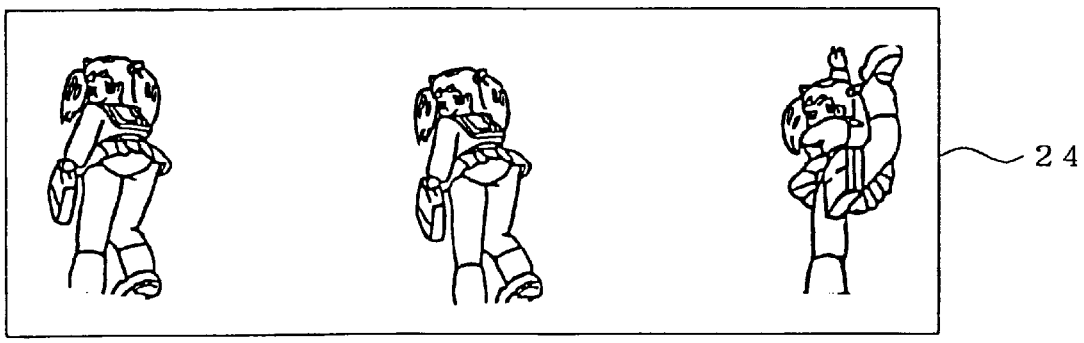

When the "4 cherry" hit flag is erected and the first reel stop button 16 is operated in the first embodiment or when the light extinguishing pattern 4 is selected from the demonstration lottery table as a prediction informing mode and the first reel stop button 16 is operated in the second embodiment, the attitudes of the character of the liquid crystal display unit 24 are as shown by FIG. 51B and no change is caused in the basic attitudes of the three bodies. Next, when the second reel button 17 is operated, the attitudes of the character are as shown by FIG. 51C and similarly, no change is caused in the respective basic attitudes. When the third reel stop button 18 is operated, the attitudes of the character are as shown by FIG. 51D and the right foot of the character disposed on the right is significantly raised backwardly.

FIGS. 52A, 52B, 52C and 52D show operational pattern 5 in correspondence with the reel lamp extinguishing pattern 5 (refer to FIGS. 20A, 20B, 20C and 20D) mentioned above, showing a display mode in correspondence with the "bell" hit flag. Also in this pattern, when the respective stop buttons 16 through 18 are not operated, all of the three bodies displayed in the liquid crystal display unit 24 are in the basic attitudes shown by FIG. 52A.

Figure 52A:
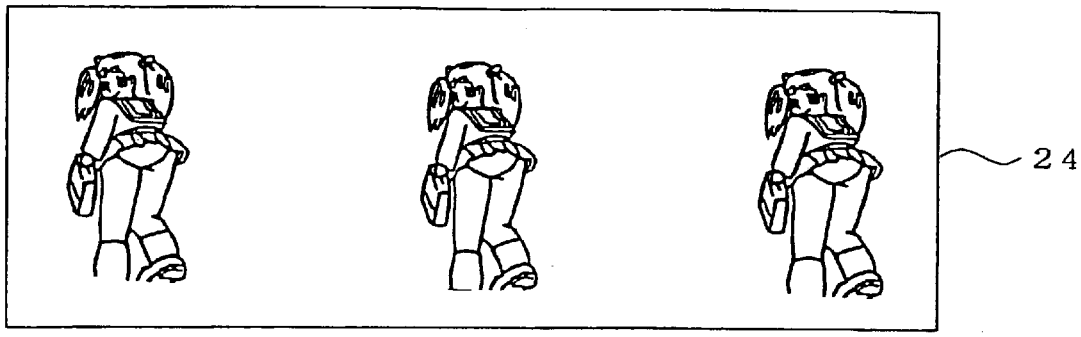
FIGS. 52A, 52B, 52C and 52D are views showing character operation patterns of a fifth prize mode informed to the player in game process of the slot machine according to the first modified mode of the first and the second respective embodiments.
Figure 52B:
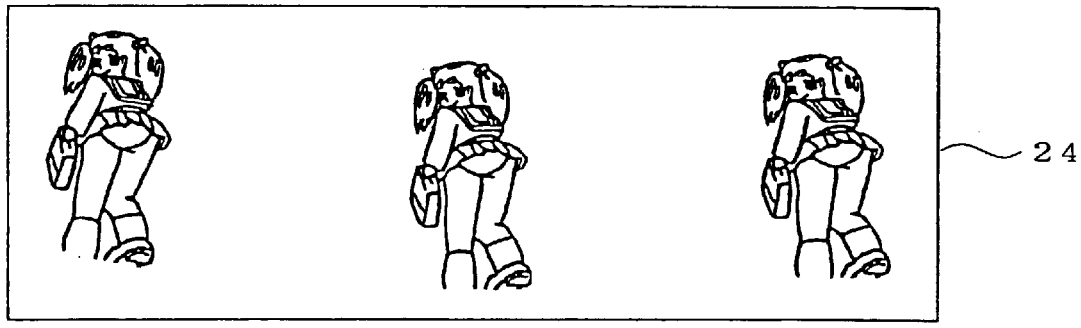
Figure 52C:
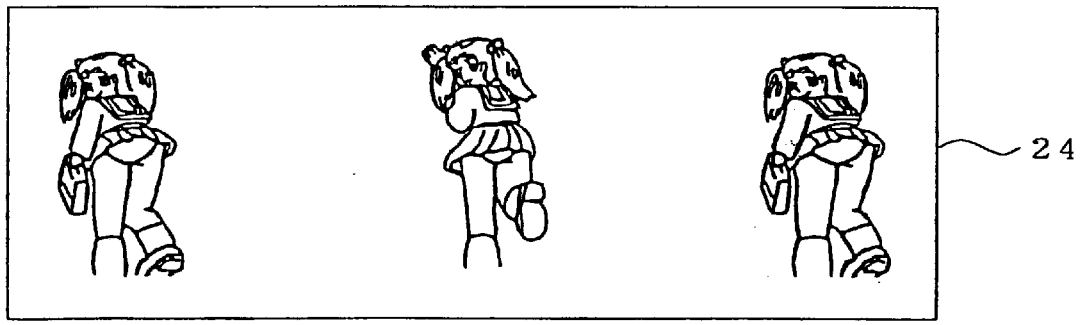
Figure 52D:
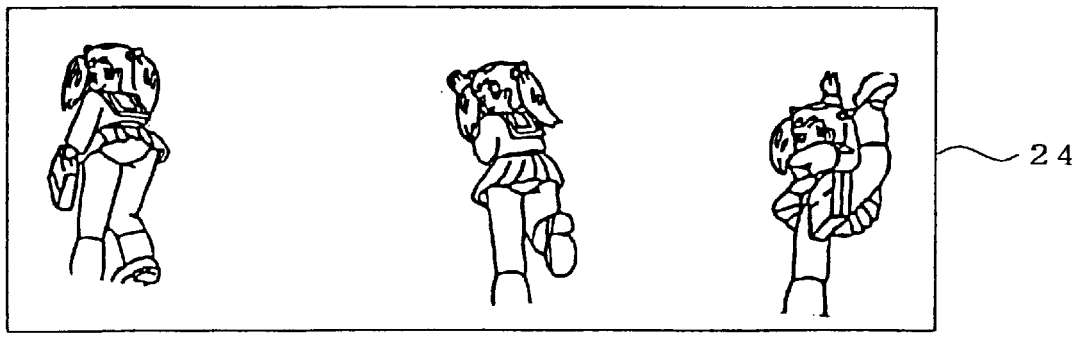

When the "bell" hit flag is erected and the first reel stop button 16 is operated in the first embodiment or when the light extinguishing pattern 5 is selected from the demonstration lottery table as a predication informing mode and the first reel stop button 16 is operated in the second embodiment, the attitudes of the character of the liquid crystal display unit 24 are as shown by FIG. 52B and no change is caused in the respective basic attitudes of the three bodies. Next, when the second reel stop button 17 is operated, the attitudes of the character are as shown by FIG. 52C and the right foot of the character disposed at the center is slightly raised backwardly. Further, when the third reel stop button 18 is operated, the attitudes of the character are as shown by FIG. 52D and the right foot of the character disposed on the right is significantly raised backwardly.

FIGS. 53A, 53B, 53C and 53D show operational pattern 6 in correspondence with the reel lamp extinguishing pattern 6 (refer to FIGS. 19A, 19B, 19C and 19D) mentioned above, showing a display mode in correspondence with the "watermelon" hit flag. Also in this embodiment, when the respective reel stop buttons 16 through 18 are not operated, all of the three bodies displayed on the liquid crystal display unit 24 are in the basic attitudes shown by FIG. 53A.

Figure 53A:
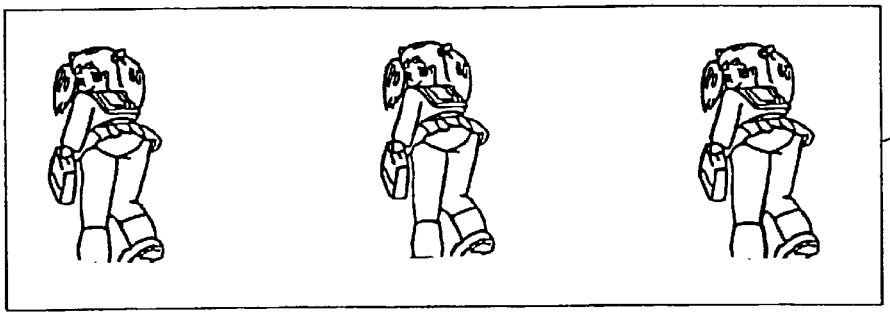
FIGS. 53A, 53B, 53C and 53D are views showing character operation patterns of a sixth prize mode informed to the player in game process of the slot machine according to the first modified mode of the first and the second respective embodiments.
Figure 53B:
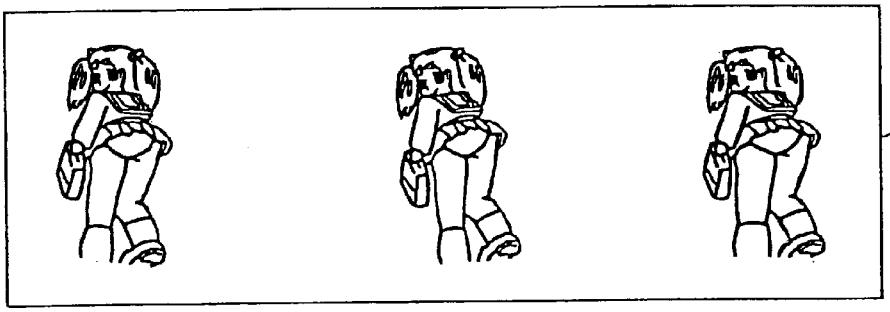
Figure 53C:
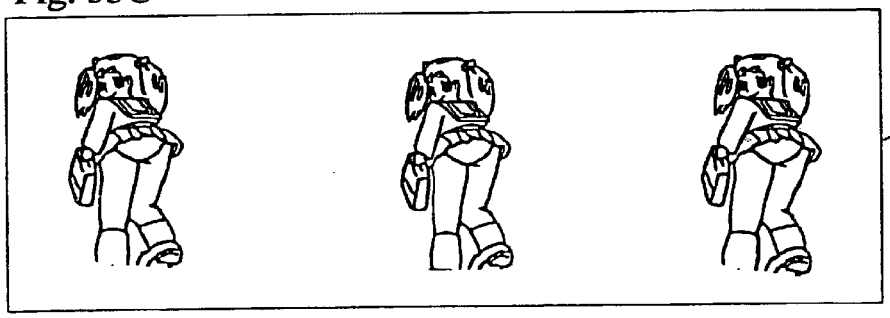
Figure 53D:
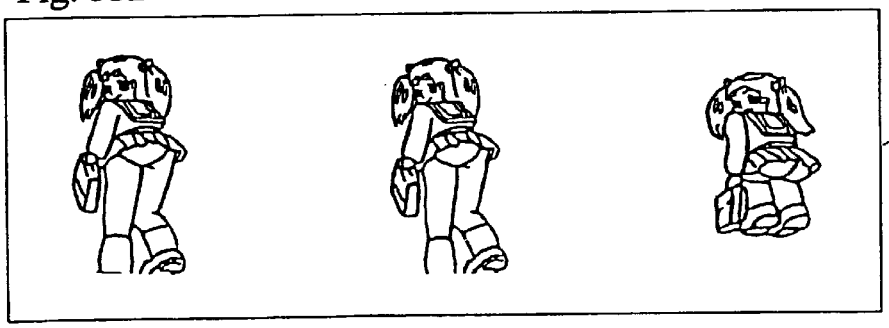

When the "watermelon" hit flag is erected and the first reel stop button 16 is operated in the first embodiment or when the light extinguishing pattern 6 is selected from the demonstration lottery table and the first reel stop button 16 is operated in the second embodiment, the attitudes of the character of the liquid crystal display unit 24 are as shown by FIG. 53B and no change is caused in the respective basic attitudes of the three bodies. Next, when the second reel stop button 17 is operated, the attitudes of the character are as shown by FIG. 53C and similarly, no change is caused in the attitudes of the character. When the third reel stop button 18 is operated, the attitudes of the character are as shown by FIG. 53D and the character disposed on the right jumps while holding the feet.

FIGS. 54A, 54B, 54C and 54D show operational pattern 7 in correspondence with the reel lamp extinguishing pattern 7 (refer to FIGS. 18A, 18B, 18C and 18D) mentioned above, showing a display mode in correspondence with the "RB" hit flag. Also in this embodiment, when the respective reel stop buttons 16 through 18 are not operated, all of the three bodies displayed on the liquid crystal display unit 24 are in the basic attitudes shown by FIG. 54A.

Figure 54A:
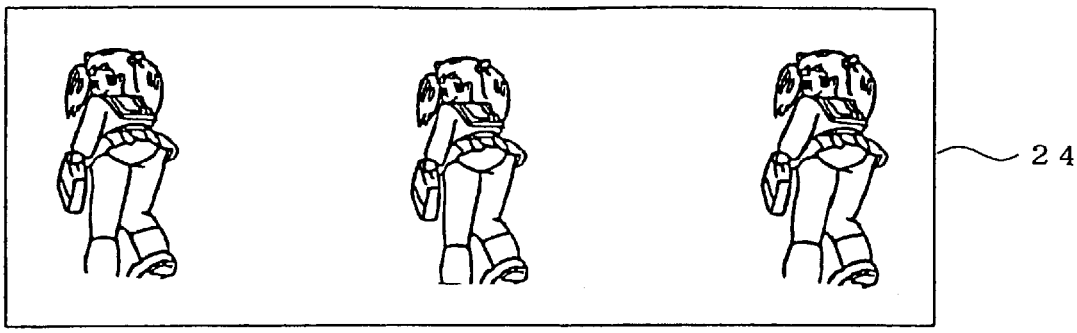
FIGS. 54A, 54B, 54C and 54D are views showing character operation patterns of a seventh prize mode informed to the player in game process of the slot machine according to the first modified mode of the first and the second respective embodiments.
Figure 54B:
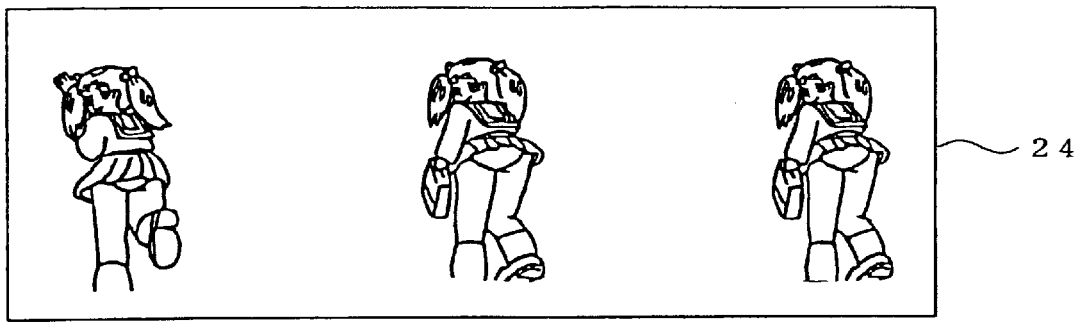
Figure 54C:
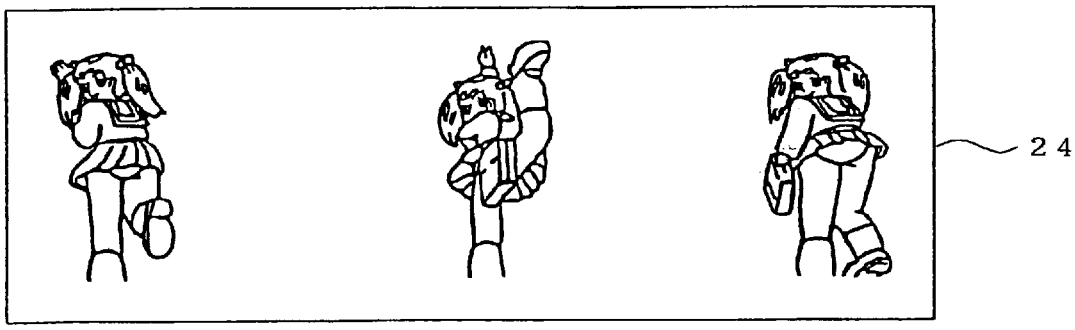
Figure 54D:
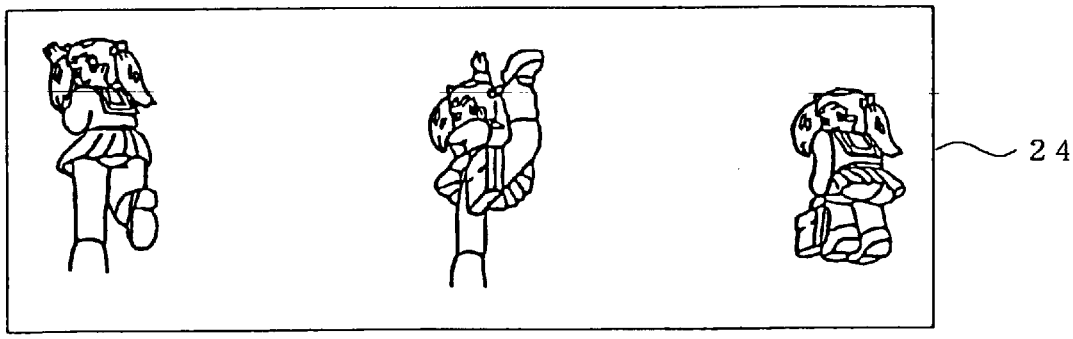

When the "RB" hit flag is erected and the first reel stop button 16 is operated in the first embodiment or when the light extinguishing pattern 7 is selected from the demonstration lottery table as a prediction informing mode and the first reel stop button 16 is operated in the second embodiment, the attitudes of the character of the liquid crystal display unit are as shown by FIG. 54B and the right foot of the character disposed on the left is slightly raised backwardly. Next, when the second reel stop button 17 is operated, the attitudes of the character are as shown by FIG. 54C and the right foot of the character disposed at the center is significantly raised backwardly. Further, when the third reel stop button 18 is operated, the attitudes of the character are as shown by FIG. 54D and the character disposed on the right jumps while holding the feet.

FIGS. 55A, 55B, 55C and 55D show operational pattern 8 in correspondence with the reel lamp extinguishing pattern 8 (refer to FIGS. 15A, 15B, 15C and 15D) mentioned above, showing a display mode in correspondence with the "BB" hit flag. Also in this pattern, when the respective reel stop buttons 16 through 18 are not operated, all of the three bodies displayed on the liquid crystal display unit 24 are in the basic attitudes shown by FIG. 55A.

Figure 55A:
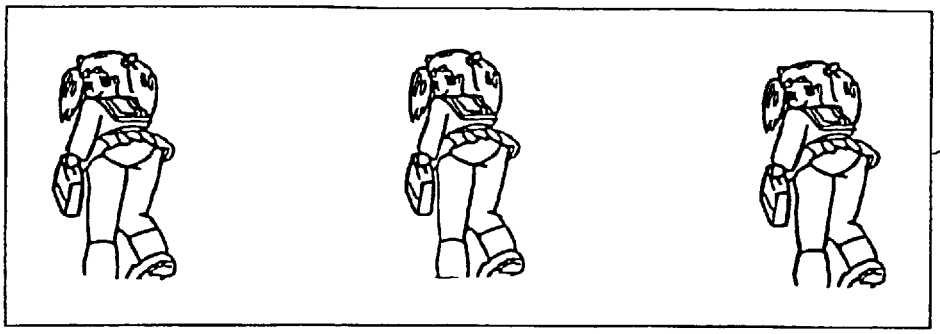
FIGS. 55A, 55B, 55C and 55D are views showing character operation patterns of an eighth prize mode informed to the player in game process of the slot machine according to the first modified mode of the first and the second respective embodiments.
Figure 55B:
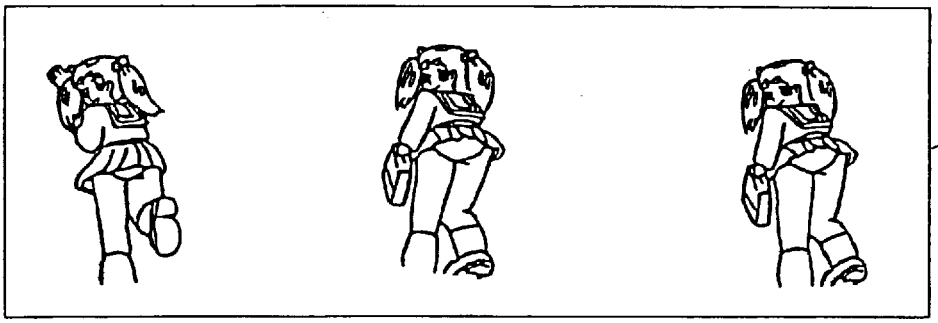
Figure 55C:
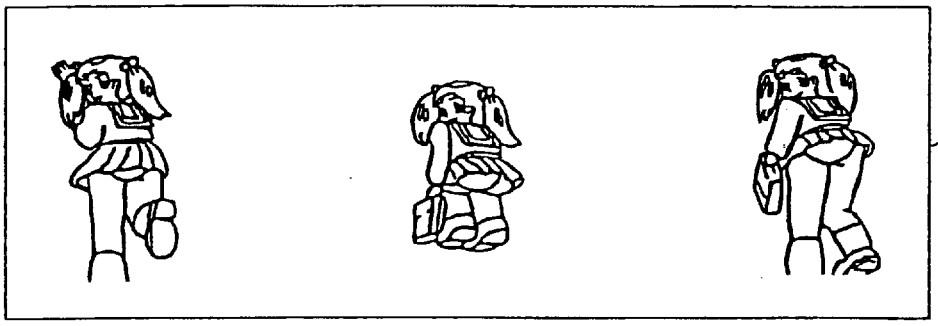
Figure 55D:
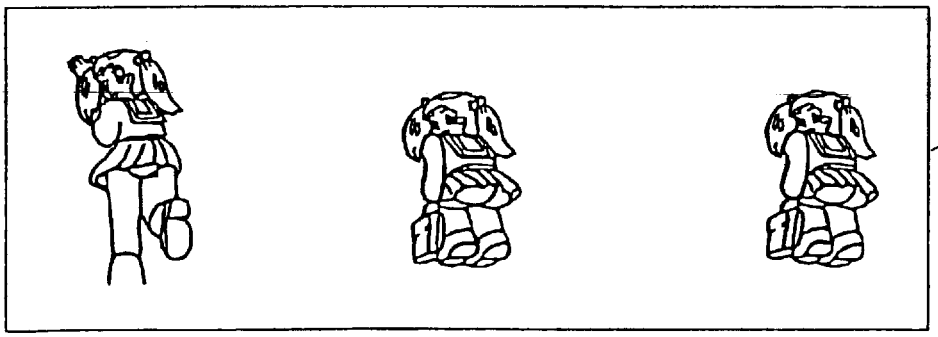

When the "BB" hit flag is erected and the first reel stop button 16 is operated in the first embodiment or when the light extinguishing pattern 8 is selected from the demonstration lottery table as a prediction informing mode and the first reel stop button 16 is operated in the second embodiment, the attitudes of the character of the liquid crystal display unit 24 are as shown by FIG. 55B and the right foot of the character disposed on the left is slightly raised backwardly. Next, when the second reel stop button 17 is operated, the attitudes of the character are as shown by FIG. 55C and the character disposed at the center jumps while holding the feet. Further, when the third reel stop button 18 is operated, the attitudes of the character are as shown by FIG. 55D and also the character disposed on the right jumps while holding the feet.

Further, a prediction may be informed by 8 kinds of operational patterns 1 through 8 of the character which is made to enter the liquid crystal display unit 24 shown by FIGS. 56A through 63D.

Figure 56A:
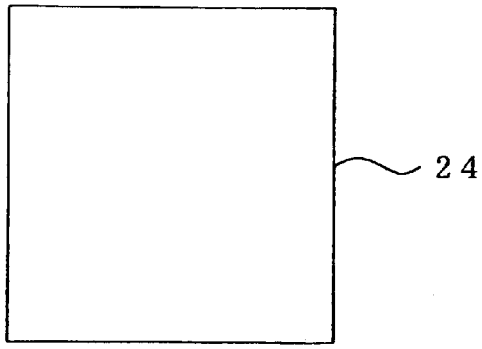
FIGS. 56A, 56B, 56C and 56D are views showing character operation patterns of the first prize mode informed to the player in game process of the slot machine according to a second modified mode of the first and the second respective embodiments.

FIGS. 56A, 56B, 56C and 56D show operational pattern 1 in correspondence with the reel lamp extinguishing pattern 1 (refer to FIGS. 24A, 24B, 24C and 24D) mentioned above, showing a display mode in correspondence with the "blank" hit flag. When the respective reel stop buttons 16 through 18 are not operated, nothing is displayed on the liquid crystal display unit 24 as shown by FIG. 56A.

Figure 56B:
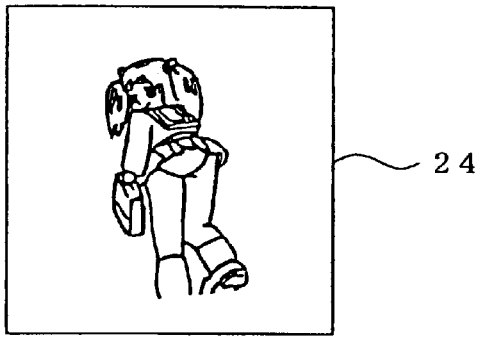
Figure 56C:
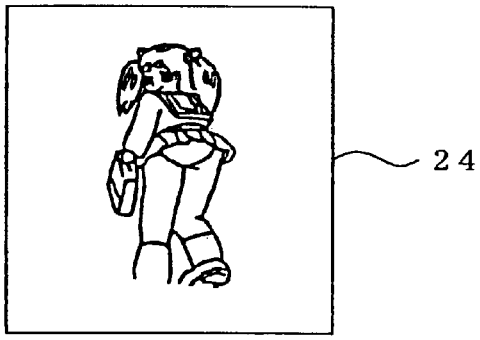
Figure 56D:
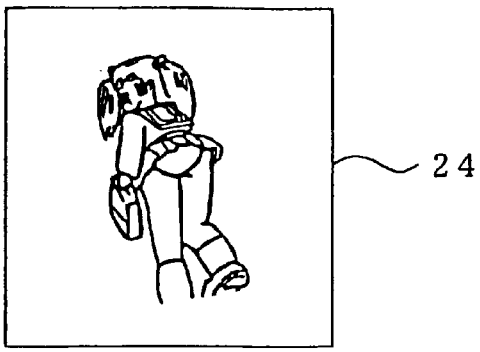

When the "blank" hit flag is erected and the first reel stop button 16 is operated in the first embodiment or when the light extinguishing pattern 1 is selected from the demonstration lottery table as a prediction informing mode in the second embodiment, when the first reel stop button 16 is operated, the basic attitude of the character "Kumichan" of a girl is displayed on the liquid crystal display unit 24 as shown by FIG. 56B. Next, when the second reel stop button 17 is operated, the attitude of the character is as shown by FIG. 56C and no change is caused in the attitude and when the third reel stop button 18 is operated, the attitude of the character is as shown by FIG. 56D and also no change is caused in the attitude.

Figure 57A:
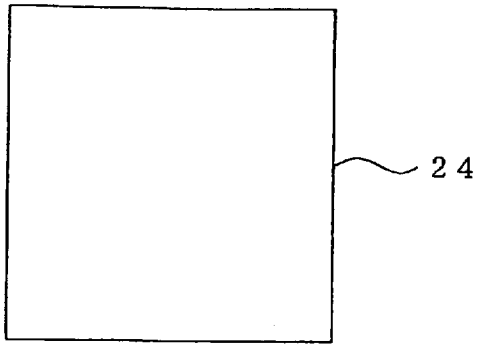
FIGS. 57A, 57B, 57C and 57D are views showing character operation patterns of the second prize mode informed to the player in game process of the slot machine according to the second modified mode of the first and the second respective embodiments.

FIGS. 57A, 57B, 57C and 57D show operational pattern 2 in correspondence with the reel lamp extinguishing pattern 2 (refer to FIGS. 23A, 23B, 23C and 23D) mentioned above, showing a display mode in correspondence with the "replay" hit flag. Also in this pattern, when the respective stop buttons 16 through 18 are not operated, nothing is displayed on the liquid crystal display unit 24 as shown by FIG. 57A.

Figure 57B:
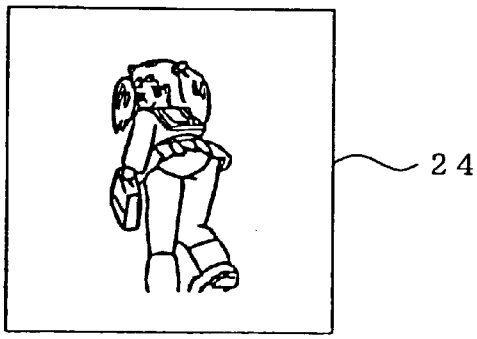
Figure 57C:
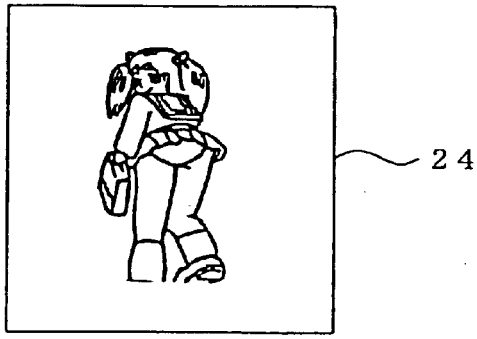
Figure 57D:
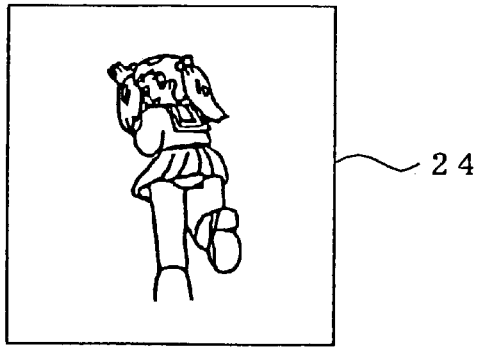

When the "replay" hit flag is erected and the first reel stop button 16 is operated in the first embodiment or when the light extinguishing pattern 2 is selected from the demonstration lottery table as a prediction informing mode and the first reel stop button 16 is operated in the second embodiment, the basic attitude of the character shown by FIG. 57B is displayed on the liquid crystal display 24. Next, when the second reel stop button 17 is operated, the attitude of the character is as shown by FIG. 57C and no change is caused in the attitude and further, when the third reel stop button 18 is operated, the attitude of the character is as shown by FIG. 5 7D and the right foot of the character is slightly raised backwardly.

Figure 58A:
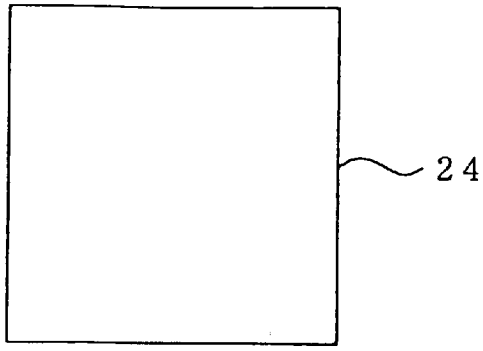
FIGS. 58A, 58B, 58C and 58D are views showing character operation patterns of the third prize mode informed to the player in game process of the slot machine according to the second modified mode of the first and the second respective embodiments.

FIGS. 58A, 58B, 58C and 58D show operational pattern 3 in correspondence with the reel lamp extinguishing pattern 3 (refer to FIGS. 22A, 22B, 22C and 22D) mentioned above, showing a display mode in correspondence with the "2 cherry" hit flag. Also in this embodiment, when the respective stop buttons 16 through 18 are not operated, nothing is displayed on the liquid crystal display unit 24 as shown by FIG. 58A.

Figure 58B:
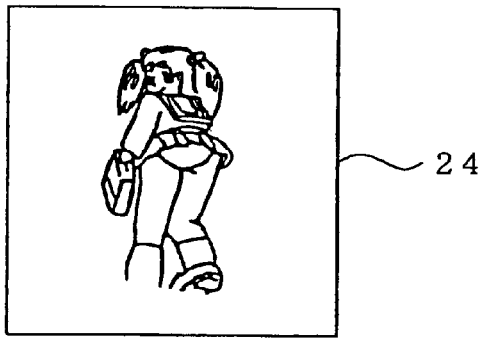
Figure 58C:
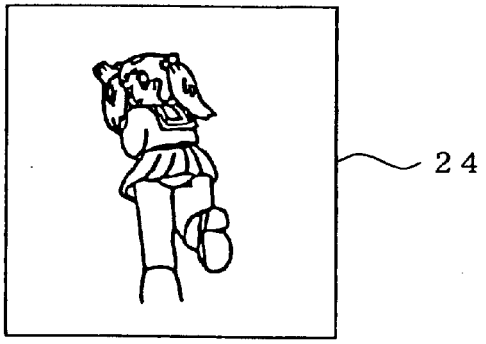
Figure 58D:
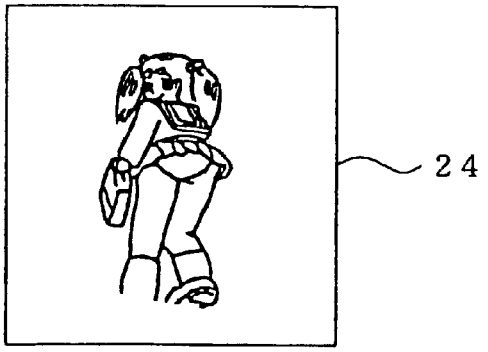

When the "2 cherry" hit flag is erected and the first reel stop button 16 is operated in the first embodiment or when the light extinguishing pattern 3 is selected from the demonstration lottery table as a prediction informing mode and the first reel stop button 16 is operated in the second embodiment, the basic attitude of the character shown by FIG. 58B is displayed on the liquid crystal display unit 24. Next, when the second reel stop button 17 is operated, the attitude of the character is as shown by FIG. 58C and the right foot of the character is slightly raised backwardly. Further, when the third reel stop button is operated, the attitude of the character is as shown by FIG. 58D and the attitude returns to the basic attitude.

Figure 59A:
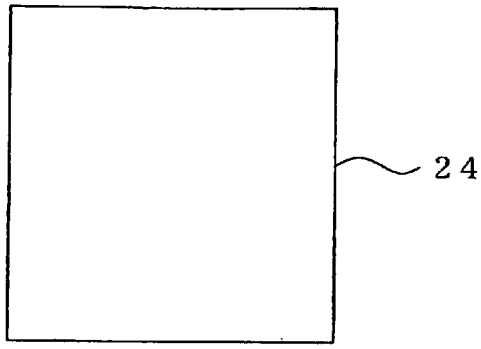
FIGS. 59A, 59B, 59C and 59D are views showing character operation patterns of the fourth prize mode informed to the player in game process of the slot machine according to the second modified mode of the first and the second respective embodiments.

FIGS. 59A, 59B, 59C and 59D show operational pattern 4 in correspondence with the reel lamp extinguishing pattern 4 (refer to FIGS. 21A, 21B, 21C and 21D), showing a display mode in correspondence with the "4 cheery" hit flag. Also in this pattern when the respective reel stop buttons 16 through 18 are not operated, nothing is displayed on the liquid crystal display unit 24 as shown by FIG. 59A.

Figure 59B:
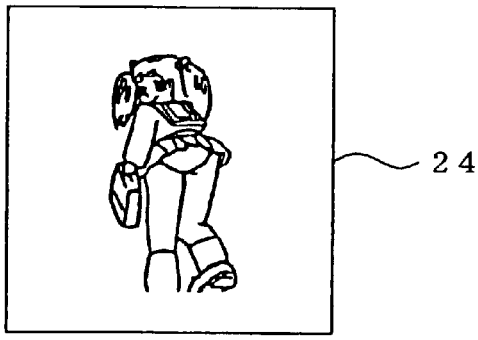
Figure 59C:
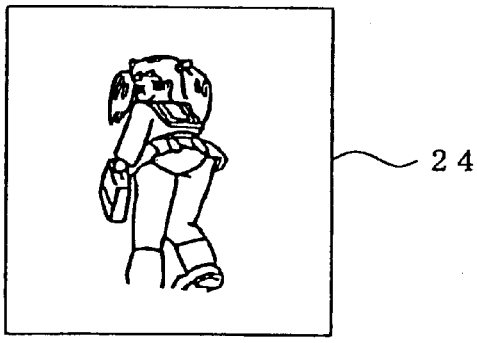
Figure 59D:
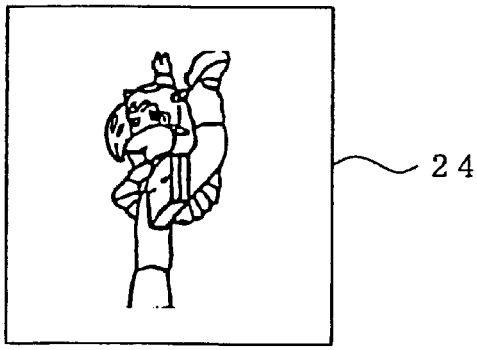

When the "4 cherry" hit flag is erected and the first reel stop button 16 is operated in the first embodiment or when the light extinguishing pattern 4 is selected from the demonstration lottery table as a prediction informing mode and the first reel stop button 16 is operated in the second embodiment, the basic attitude of the character shown by FIG. 59B is displayed on the liquid crystal display unit 24. Next, when the second reel stop button 17 is operated, the attitude of the character is as shown by FIG. 59C and no change is caused in the attitude. Further, when the third reel stop button 18 is operated, the attitude of the character is as shown by FIG. 59D and the right foot of the character is significantly raised backwardly.

Figure 60A:
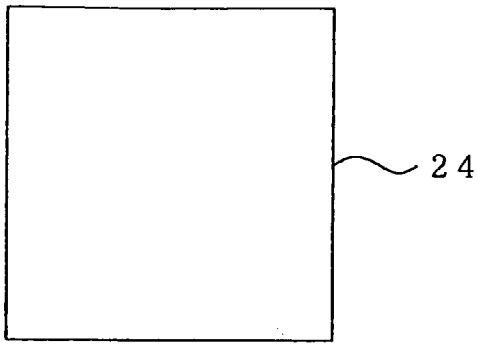
FIGS. 60A, 60B, 60C and 60D are views showing character operation patterns of the fifth prize mode informed to the player in game process of the slot machine according to the second modified mode of the first and the second respective embodiments.

FIGS. 60A, 60B, 60C and 60D show operational pattern 5 in correspondence with the reel lamp extinguishing pattern 5 (refer to FIGS. 20A, 20B, 20C and 20D) mentioned above, showing a display mode in correspondence with the "bell" hit flag. Also in this pattern, when the respective reel stop buttons 16 through 18 are not operated, nothing is displayed on the liquid crystal display unit 24 as shown by FIG. 60A.

Figure 60B:
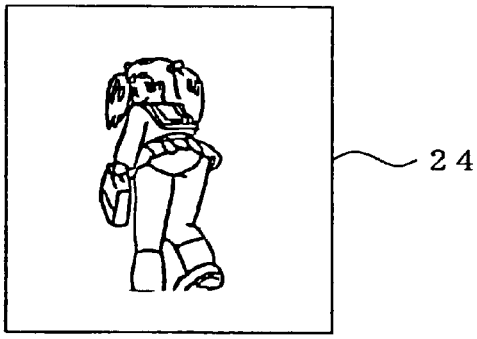
Figure 60C:
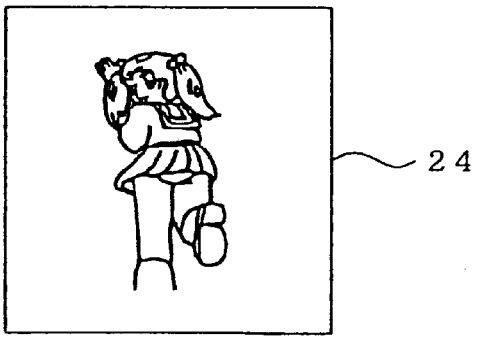
Figure 60D:
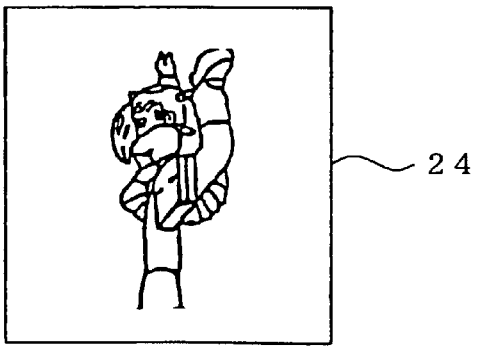

When the "bell" hit flag is erected and the first reel stop button 16 is operated in the first embodiment or when the light extinguishing pattern 5 is selected from the demonstration lottery table as a prediction informing mode and the first reel stop button 16 is operated in the second embodiment, the basic attitude of the character shown by FIG. 60B is displayed on the liquid crystal display unit 24. Next, when the second reel stop button 17 is operated, the attitude of the character is as shown by FIG. 60C and the right foot of the character is slightly raised backwardly. Further, when the third reel stop button 18 is operated, the attitude of the character is as shown by FIG. 60D and the right foot of the character is significantly raised backwardly.

Figure 61A:
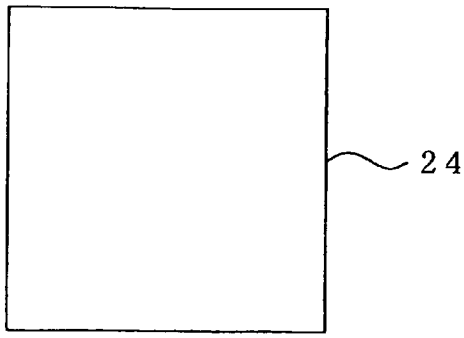
FIGS. 61A, 61B, 61C and 61D are views showing character operation patterns of the sixth prize mode informed to the player in game process of the slot machine according to the second modified mode of the first and the second respective embodiments.

FIGS. 61A, 61B, 61C and 61D show operational pattern 6 in correspondence with the reel lamp extinguishing pattern 6 (refer to FIGS. 19A, 19B, 19C and 19D) mentioned above, showing a display mode in correspondence with the "watermelon" hit flag. Also in this embodiment, when the respective reel stop buttons 16 through 18 are not operated, nothing is displayed on the liquid crystal display 24 as shown by FIG. 61A.

Figure 61B:
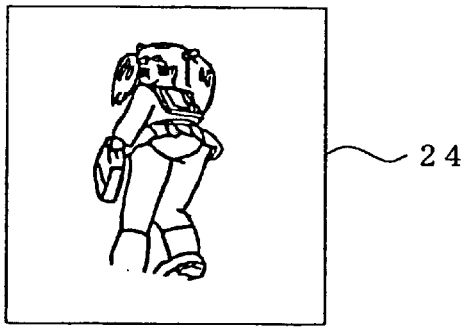
Figure 61C:
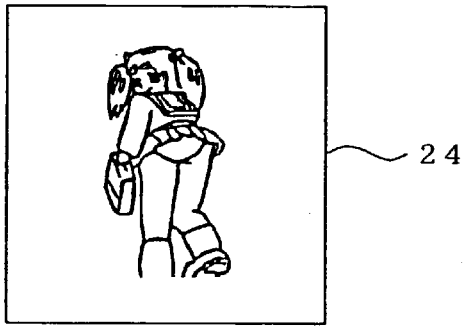
Figure 61D:
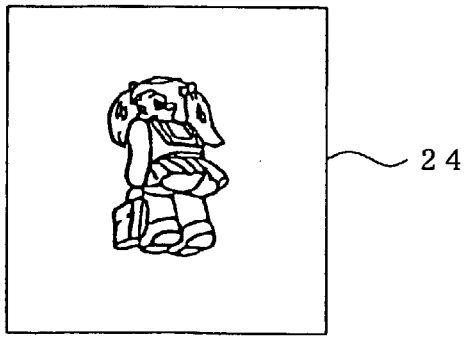

When the "watermelon" hit flag is erected and the first reel stop button 16 is operated in the first embodiment or when the light extinguishing pattern 6 is selected from the demonstration lottery table as a prediction informing mode and the first reel stop button 16 is operated in the second embodiment, the attitude of the character shown by FIG. 61B is displayed on the liquid crystal display unit 24. Next, when the second reel stop button 17 is operated, the attitude of the character is as shown by FIG. 61C and no change is caused in the attitude of the character. Further, when the third reel stop button 18 is operated, the attitude of the character is as shown by FIG. 61D and the character jumps while holding the feet.

Figure 62A:
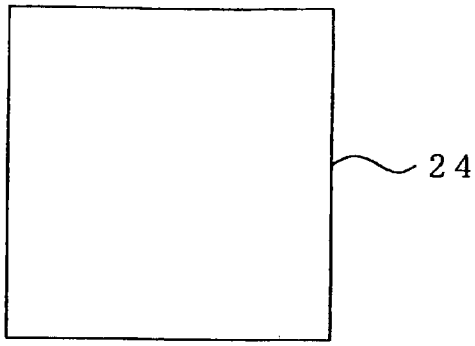
FIGS. 62A, 62B, 62C and 62D are views showing character operation patterns of the seventh prize mode informed to the player in game process of the slot machine according to the second modified mode of the first and the second respective embodiments.

FIGS. 62A, 62B, 62C and 62D show operational pattern 7 in correspondence with reel lamp extinguishing pattern 7 (refer to FIGS. 18A, 18B, 18C and 18D) mentioned above, showing a display mode in correspondence with the "RB" hit flag. Also in this embodiment, when the respective reel stop buttons 16 through 18 are not operated, nothing is displayed on the liquid crystal display unit 24 as shown by FIG. 62A.

Figure 62B:
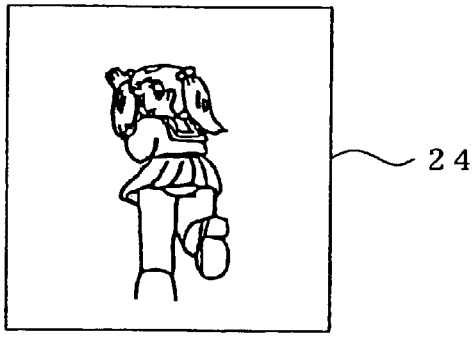
Figure 62C:
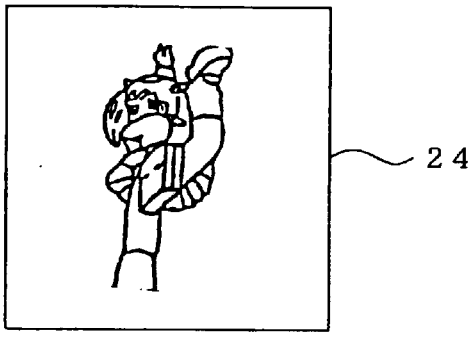
Figure 62D:
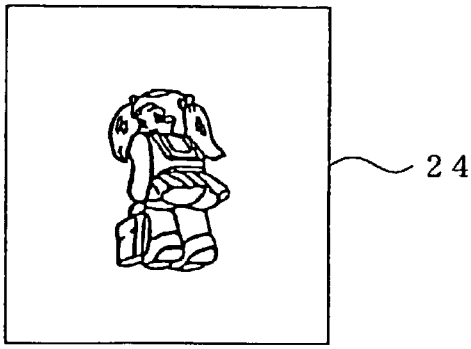

When the "RB" hit flag is erected and the first reel stop button 16 is operated in the first embodiment or when the light extinguishing pattern 7 is selected from the demonstration lottery table as a prediction informing mode and the first reel stop button 16 is operated in the second embodiment, the character slightly raising the right foot backwardly shown by FIG. 62B is displayed on the liquid crystal display unit 24. Next, when the second reel stop button 17 is operated, the attitude of the character is as shown by FIG. 62C and the right foot of the character is significantly raised backwardly. Further, when the third reel stop button 18 is operated, the attitude of the character is as shown by FIG. 62D and the character is in the attitude in which the character jumps while holding the feet.

Figure 63A:
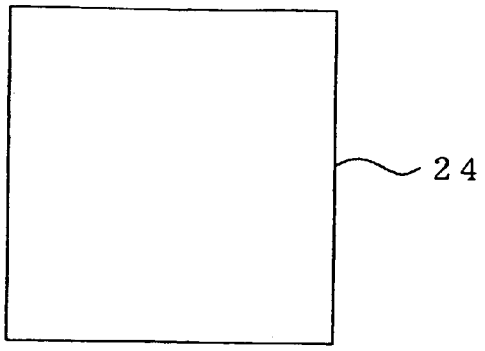
FIGS. 63A, 63B, 63C and 63D are views showing character operation patterns of the eighth prize mode informed to the player in game process of the slot machine according to the second modified mode of the first and the second respective embodiments.

FIGS. 63A, 63B, 63C and 63D show operational pattern 8 in correspondence with the reel lamp extinguishing pattern 8 (refer to FIGS. 15A, 15B, 15C and 15D) mentioned above, showing a display mode in correspondence with the "BB" hit flag. Also in this pattern, when the respective reel stop buttons 16 through 18 are not operated, nothing is displayed in the liquid crystal display unit 24 as shown by FIG. 63A.

Figure 63B:
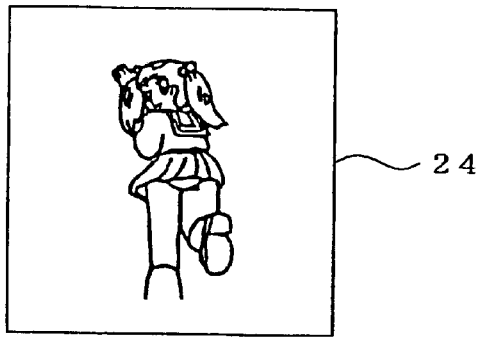
Figure 63C:
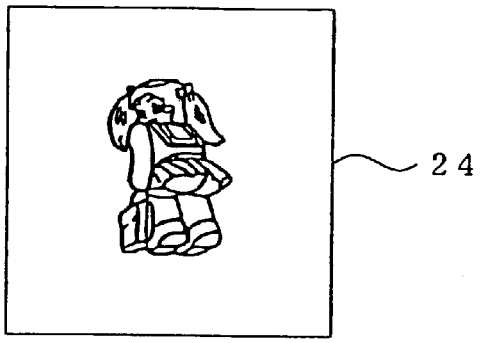
Figure 63D:
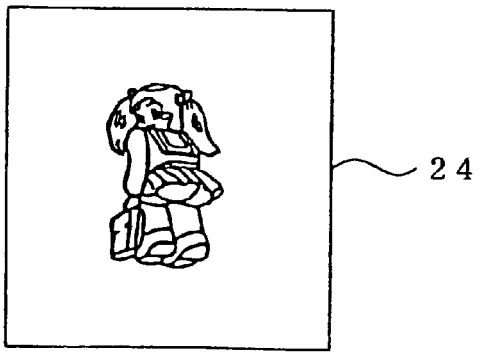

When the "BB" hit flag is erected and the first reel stop button 16 is operated in the first embodiment or when the light extinguishing pattern 8 is selected from the demonstration lottery table as a prediction informing mode and the first reel stop button 16 is operated in the second embodiment, the character slightly raising the right foot backwardly shown by FIG. 63B is displayed on the liquid crystal display unit 24. Next, when the second reel stop button 17 is operated, the attitude of the character is as shown by FIG. 63C and the character is in the attitude in which the character jumps while holding the feet. Further, when the third reel stop button 18 is operated, the attitude of the character is as shown by FIG. 63D and the attitude in which the character jumps while holding the feet is continued.

Also in the case in which 8 kinds of the operational patterns 1 through 8 of the character are displayed on the liquid crystal display unit 24 in this way and prediction of establishment of flags of the respective prize modes is informed, similar to the second embodiment mentioned above, inner hit of BB or RB may be notified to the player with the operational pattern 7 and operational pattern 8 as fixed patterns.

Further, although an explanation has been given of the case in which the game machine according to the present invention is applied to a slot machine in the above-described embodiments as mentioned above, the present invention is not limited thereto but is applicable to, for example, a pinball game machine such as a pachinko machine or amusement machines having variable display devices.

When the present invention is applied to a pachinko machine, flow of the game such as operation of the start lever, sampling of a random number for determining a prize mode and starting to rotate reels in the slot machines of the above-described respective embodiments, is replaced by flow of game such as input of pachinko balls to a specified prize slot, sampling of a random number for determining a prize mode and starting to rotate slot machine reels integrated into the pachinko machine. Further, operation of paying out coins which is carried out when patterns of reels are stopped and displayed to constitute a specific mode in the slot machines of the above-described respective embodiments, is replaced by rewarding a special prize in the pachinko game as in providing a large number of balls to the player by opening a variable prize device of attacker or tulip in the pachinko machine.

Although the present invention has been explained in reference to the embodiments, it is apparent for those skilled in the art that many changes and modifications can be made without departing from the spirit and scope of the invention, as clear from the following claims.

What is claimed is:

1. A game machine comprising:

a variable display device for variably displaying various patterns in a plurality of columns;

prize mode determining means which determines a prize mode of a game with reference to a probability table comprising data for classifying a drawing random number into an individual prize mode, and which erects a hit flag of a prize mode to which the drawing random number belongs;

stopping means for stopping variable display of the variable display device at each of the respective columns; and informing means for informing a player of a kind of a hit flag of a prize mode determined by a random number lottery with reference to an informing determination table, which is different from said probability table, for determining the prize mode to be informed, at a predetermined probability determined by the random number lottery with reference to the informing determination table, in connection with an output of a request from the stopping means to stop the variable display of at least one column.

2. A game machine according to claim 1:

wherein the informing means informs the kind of the hit flag of the prize mode to be informed to a player at the predetermined probability when patterns in correspondence with the prize mode determined by the informing means are stopped at predetermined positions of the variable display device.

3. A game machine according to claim 2:

wherein the informing means informs the player of the kind of the hit flag of the prize mode to be informed, the hit flag being different from the hit flag erected by said prize mode determining means, at a predetermined probability determined by the random number lottery with reference to the informing determination table.

4. A game machine according to claim 3, further comprising:

notifying means for notifying the player, in conjunction with said informing means, about the kind of the hit flag of a specific prize mode determined by said informing means in a predetermined informing mode on condition that the specific prize mode is determined by said informing means.

5. A game machine according to claim 4:

wherein the notifying means is realized by a specific informing mode by the informing means.

6. A game machine according to claim 4:

wherein the specific prize mode is a big hit or a medium hit inner prize mode.

7. A game machine according to claim 4:

wherein the notifying means notifies the kind of the prize mode to the player by display of a lighting device.

8. A game machine according to claim 7:

wherein the notifying means continues displaying the lighting device until game of the specific prize mode is finished.

9. A game machine according to claim 4:

wherein the notifying means notifies the player about the kind of the hit flag of the specific prize mode in a predetermined informing mode on condition that the specific prize mode to be informed to the player at a probability of 100% is determined by said informing means.

10. A game machine according to claim 9, further comprising:

informing mode selecting means for selecting the kind of the hit flag of the prize mode to be informed; and wherein the informing means informs the kind of the hit flag selected by the informing mode selecting means to the player at the predetermined probability and the notifying means compares the kind of the hit flag selected by the informing mode selecting means with the predetermined kind of the hit flag to be informed to the player at the probability of 100% and notifies the kind of the hit flag when the kinds of the hit flags coincide with each other.

11. A game machine according to claim 3, further comprising:

informing mode selecting means for selecting the kind of the hit flag of the prize mode to be informed; and wherein the informing means informs to the player the kind of the hit flag selected by the informing mode selecting means at the predetermined probability.

12. A game machine according to claim 11 or claim 10:

wherein the informing determination table which is used by said informing means for determining the prize mode to be informed is an informing selection lottery probability table comprising data for classifying the drawing random number into individual prize mode to be informed;

said informing mode selection means selects the prize mode to be informed with reference to the informing selection lottery probability table and selects the hit flag in accordance with the selected prize mode.

13. A game machine according to claim 11 or claim 10:

wherein the informing mode selecting means selects a demonstration lottery table comprising the informing determination table used by said informing means for determining the prize mode to be informed in accordance with a game state and a prize mode determined by said prize mode determining means with reference to a demonstration lottery table selecting table, said demonstration lottery table selecting table comprising data for classifying a combination of the game state and the prize mode into individual demonstration lottery table, and further wherein said information mode selecting means selects a hit flag of a prize mode to be informed in accordance with the drawing random number with reference to the selected demonstration lottery table.

14. A game machine according to claim 2:

wherein the prize mode determining means comprises:

random number generating means for generating random numbers in constant ranges;

random number sampling means for sampling an arbitrary random number among the random numbers generated by the random number generating means; and random number classifying means for classifying the random number sampled by the random number sampling means into individual prize modes.

15. A game machine according to claim 2:

wherein the stopping means comprises:

a plurality of stop buttons installed in correspondence with each variable display column; and wherein informing means informs a player of the hit flag of the prize mode to be informed at the predetermined probability based on operating each stop button.

16. A game machine according to claim 15:

wherein the stop buttons comprise tactile sensing buttons which vibrate a player's fingertip in operation and the informing means vibrates the stop buttons at a predetermined mode when the variable display is operated to stop by the stopping means.

17. A game machine according to claim 2:

wherein the stopping means stops said variable displays automatically for the individual columns, and wherein the informing means informs the hit flag of the prize mode to be informed the predetermined probability based on an automatic output of a request from the stopping means to stop the variable display.

18. A game machine according to claim 2:

wherein the game machine is a slot machine.

19. A game machine according to claim 2:

wherein the variable display device comprises:

a plurality of rotating reels illustrated with the various patterns at outer peripheries thereof; and a plurality of light sources installed at the respective rotating reels for illuminating the patterns which the respective rotating reels display by stopping the respective rotating reels from a rear side;

wherein the informing means informs the hit flag of the prize mode to be informed to the player at the predetermined probability by lighting the respective light sources by the modes which differ in accordance with the hit flag of the prize mode to be informed based on the output of the request from the stopping means to stop the variable display.

20. A game machine according to claim 2:

wherein the informing means emits an effective sound of a predetermined kind or length which differs in accordance with the hit flag of the prize mode to be informed based on the output of the request from the stopping means to stop the variable display.

21. A game machine according to claim 1:

wherein said stopping means includes a plurality of stop buttons provided with said individual variable display columns, and wherein said stopping means stops said variable display for the individual columns corresponding to operation timing of a stop button, and further wherein said stopping means controls the display of the combination of the patterns statically on an effective prize line of said variable display device in accordance with the prize mode, such that when the stop button is not operated at the operation timing, the combination of the patterns corresponding to the hit flag is not displayed on the effective prize line.

* * * * *